US010538834B2

(12) United States Patent
Wen et al.

(10) Patent No.: US 10,538,834 B2
(45) **Date of Patent: *Jan. 21, 2020**

(54) HIGH-STRENGTH 6XXX ALUMINUM ALLOYS AND METHODS OF MAKING THE SAME

(71) Applicant: Novelis Inc., Atlanta, GA (US)

(72) Inventors: Wei Wen, Powder Springs, GA (US); Hany Ahmed, Atlanta, GA (US); Rajeev Kamat, Marietta, GA (US); Corrado Bassi, Valais (CH); Guillaume Florey, Valais (CH); Cyrille Bezencon, Valais (CH); Juergen Timm, Steisslingen (DE); David Leyvraz, Sierre (CH); Aude Despois, Valais (CH); Sazol Kumar Das, Acworth, GA (US)

(73) Assignee: NOVELIS INC., Atlanta, GA (US)

( * ) Notice: Subject to any disclaimer, the term of this patent is extended or adjusted under 35 U.S.C. 154(b) by 303 days.

This patent is subject to a terminal disclaimer.

(21) Appl. No.: 15/381,707

(22) Filed: Dec. 16, 2016

(65) Prior Publication Data

US 2017/0175240 A1 Jun. 22, 2017

Related U.S. Application Data

(60) Provisional application No. 62/269,385, filed on Dec. 18, 2015.

(51) Int. Cl.
*C22C 21/02* (2006.01)
*C22C 21/06* (2006.01)
(Continued)

(52) U.S. Cl.
CPC ..... *C22F 1/057* (2013.01); *B22D 7/005* (2013.01); *C22C 21/02* (2013.01); *C22C 21/08* (2013.01);
(Continued)

(58) Field of Classification Search
CPC ..... C22C 21/02; C22C 21/06; C22C 21/08; C22C 21/14; C22C 21/16; C22C 21/18;
(Continued)

(56) References Cited

U.S. PATENT DOCUMENTS 4,580,032 A 4/1986 Carkhuff
4,589,932 A 5/1986 Park
(Continued)

FOREIGN PATENT DOCUMENTS

EP 1170118 A1 1/2002
EP 1195449 A2 4/2002
(Continued)

OTHER PUBLICATIONS

Canadian Application No. 2,981,329 , "Office Action", dated Oct. 3, 2018, 4 pages.
(Continued)

*Primary Examiner* — Cam N. Nguyen
(74) *Attorney, Agent, or Firm* — Kilpatrick Townsend & Stockton LLP

(57) ABSTRACT

Disclosed are high-strength aluminum alloys and methods of making and processing such alloys. More particularly, disclosed is a 6XXX series aluminum alloy exhibiting improved mechanical strength, formability, corrosion resistance, and anodized qualities. An exemplary method includes homogenizing, hot rolling, solutionizing, and quenching. In some cases, the processing steps can further include annealing and/or cold rolling.

11 Claims, 45 Drawing Sheets

TENSILE PROPERTIES OF TB1-TB4 ALLOYS IN T4 TEMPER

(51) Int. Cl.

| | |
|---|---|
| ***C22C 21/08*** | (2006.01) |
| ***C22C 21/14*** | (2006.01) |
| ***C22C 21/16*** | (2006.01) |
| ***C22C 21/18*** | (2006.01) |
| ***C22F 1/043*** | (2006.01) |
| ***C22F 1/047*** | (2006.01) |
| ***C22F 1/057*** | (2006.01) |
| ***C22F 1/05*** | (2006.01) |
| ***B22D 7/00*** | (2006.01) |

(52) U.S. Cl.
CPC ..... *C22C 21/14* (2013.01); *C22C 21/16* (2013.01); *C22C 21/18* (2013.01); *C22F 1/043* (2013.01); *C22F 1/047* (2013.01)

(58) Field of Classification Search
CPC ..... C22F 1/043; C22F 1/047; C22F 1/057; C22F 1/05
See application file for complete search history.

(56) References Cited

U.S. PATENT DOCUMENTS

| | | | | |
|---|---|---|---|---|
| 4,637,842 | A | 1/1987 | Jeffrey et al. | |
| 5,620,652 | A * | 4/1997 | Tack | B23K 35/286 420/532 |
| 5,662,750 | A | 9/1997 | Shen et al. | |
| 6,004,506 | A | 12/1999 | Chu et al. | |
| 6,120,623 | A | 9/2000 | Gupta et al. | |
| 6,231,809 | B1 | 5/2001 | Matsumoto et al. | |
| 6,280,543 | B1 | 8/2001 | Zonker et al. | |
| 6,537,392 | B2 | 3/2003 | Magnusen et al. | |
| 6,695,935 | B1 * | 2/2004 | Haszler | C22C 21/06 148/440 |
| 8,728,256 | B2 * | 5/2014 | Che | B22F 1/007 148/438 |
| 8,758,529 | B2 * | 6/2014 | Wang | C22C 21/02 148/417 |
| 9,217,622 | B2 * | 12/2015 | Mooy | C22C 21/06 |
| 9,828,652 | B2 * | 11/2017 | Kamat | C21D 9/46 |
| 9,834,828 | B2 * | 12/2017 | Doty | C22C 21/14 |
| 9,870,841 | B2 * | 1/2018 | Yoshida | C22F 1/04 |
| 9,890,443 | B2 | 2/2018 | Lin et al. | |
| 10,096,394 | B2 * | 10/2018 | Sekiya | C22C 21/00 |
| 2002/0017344 | A1 | 2/2002 | Gupta et al. | |
| 2003/0143102 | A1 | 7/2003 | Matsuoka et al. | |
| 2004/0094249 | A1 | 5/2004 | Uchida et al. | |
| 2004/0177902 | A1 | 9/2004 | Mergen et al. | |
| 2004/0187985 | A1 | 9/2004 | Matsumoto et al. | |
| 2008/0145266 | A1 | 6/2008 | Chen et al. | |
| 2008/0175747 | A1 | 7/2008 | Kajihara et al. | |
| 2009/0242088 | A1 | 10/2009 | Takaki et al. | |
| 2010/0059151 | A1 | 3/2010 | Iwamura et al. | |
| 2011/0250469 | A1 | 10/2011 | De Smet et al. | |
| 2012/0055590 | A1 | 3/2012 | Kamat et al. | |
| 2012/0055591 | A1 | 3/2012 | Kamat et al. | |
| 2013/0334091 | A1 | 12/2013 | Sawtell et al. | |
| 2014/0003993 | A1 | 1/2014 | Matsumoto et al. | |
| 2014/0248177 | A1 | 9/2014 | Kamat et al. | |
| 2014/0290809 | A1 | 10/2014 | Hori et al. | |
| 2014/0366997 | A1 | 12/2014 | Kamat et al. | |
| 2014/0366998 | A1 | 12/2014 | Kamat et al. | |
| 2014/0366999 | A1 | 12/2014 | Kamat et al. | |
| 2015/0007909 | A1 | 1/2015 | Matsumoto et al. | |
| 2015/0050520 | A1 | 2/2015 | Niikura et al. | |
| 2015/0316210 | A1 | 11/2015 | Nakai et al. | |
| 2015/0354044 | A1 | 12/2015 | Shishido et al. | |
| 2015/0376741 | A1 * | 12/2015 | Kobayashi | C22C 21/00 420/535 |
| 2017/0175239 | A1 | 6/2017 | Ahmed et al. | |
| 2018/0044755 | A1 * | 2/2018 | Kamat | C21D 9/46 |

FOREIGN PATENT DOCUMENTS

| | | | |
|---|---|---|---|
| EP | 2055473 | A1 | 5/2009 |
| EP | 2075348 | A1 | 7/2009 |
| FR | 2922222 | A1 | 4/2009 |
| GB | 650905 | | 3/1951 |
| JP | H0543974 | | 2/1993 |
| JP | 05112840 | | 5/1993 |
| JP | H06136478 | | 5/1994 |
| JP | H06240424 | | 8/1994 |
| JP | 2005240113 | | 10/1995 |
| JP | 09209068 | | 8/1997 |
| JP | 10130768 | | 8/1997 |
| JP | 2000129382 | | 5/2000 |
| JP | 2000160310 | | 6/2000 |
| JP | 2005042187 | | 2/2005 |
| JP | 2006009140 | | 1/2006 |
| JP | 2007009262 | A | 1/2007 |
| JP | 2008045192 | | 2/2008 |
| JP | 2013542320 | | 11/2013 |
| JP | 2015034330 | | 2/2015 |
| JP | 2015528856 | | 10/2015 |
| KR | 20130103423 | | 9/2013 |
| RU | 2218437 | | 12/2003 |
| RU | 2221891 | | 1/2004 |
| RU | 71175 | | 2/2008 |
| RU | 2326181 | | 6/2008 |
| RU | 2327758 | | 6/2008 |
| RU | 2394113 | | 7/2010 |
| RU | 2537052 | | 12/2014 |
| WO | 9527091 | | 10/1995 |
| WO | 9801591 | | 1/1998 |
| WO | 9859086 | A1 | 12/1998 |
| WO | 0003052 | A1 | 1/2000 |
| WO | 0015859 | A1 | 3/2000 |
| WO | 0070115 | A1 | 11/2000 |
| WO | 0192591 | A2 | 12/2001 |
| WO | 02099151 | A2 | 12/2002 |
| WO | 2004001086 | A1 | 12/2003 |
| WO | 2005049878 | | 6/2005 |
| WO | 2005100623 | A2 | 10/2005 |
| WO | 2008123355 | A1 | 10/2008 |
| WO | 2008152919 | A1 | 12/2008 |
| WO | 2009059826 | A1 | 5/2009 |
| WO | 2009093559 | A1 | 7/2009 |
| WO | 2009119724 | A1 | 10/2009 |
| WO | 2009123011 | A1 | 10/2009 |
| WO | 2010029572 | A1 | 3/2010 |
| WO | 2010119070 | A2 | 10/2010 |
| WO | 2012033954 | A2 | 3/2012 |
| WO | 2012070803 | A2 | 5/2012 |
| WO | 2012169317 | | 12/2012 |
| WO | 2013118734 | A1 | 8/2013 |
| WO | 2013133978 | A1 | 9/2013 |
| WO | 2014046010 | A1 | 3/2014 |
| WO | 2014126073 | A1 | 8/2014 |
| WO | 2014168147 | A1 | 10/2014 |
| WO | 2015030598 | A1 | 3/2015 |
| WO | 2015034024 | A1 | 3/2015 |
| WO | 2015098484 | A1 | 7/2015 |
| WO | 2015109893 | A1 | 7/2015 |
| WO | 2015127805 | A1 | 9/2015 |
| WO | 2015133004 | A1 | 9/2015 |
| WO | 2015144302 | A1 | 10/2015 |
| WO | 2015146654 | A1 | 10/2015 |
| WO | 2015151886 | A1 | 10/2015 |
| WO | 2015151907 | A1 | 10/2015 |

OTHER PUBLICATIONS

International Application No. PCT/US2016/067194 , "International Preliminary Report on Patentability", dated Jun. 28, 2018, 9 pages.
Niranjani, V. L., et al., "Development of high strength Al—Mg—Si AA6061 alloy through cold rolling and ageing," Materials Science and Engineering A, 2009, pp. 169-174, vol. 515, Elsevier.
"International Alloy Designations and Chemical Composition Limits for Wrought Aluminum and Wrought Aluminum Alloys," Reg-

(56) References Cited

OTHER PUBLICATIONS istration Record Series: Teal Sheets, Feb. 1, 2009, The Aluminum Association, Inc., 35 pages.
International Patent Application No. PCT/US2016/067194, Invitation to Pay Additional Fees and Partial International Search Report dated May 9, 2017, 11 pages.
International Patent Application No. PCT/US2016/067194, International Search Report and Written Opinion dated Jul. 3, 2017, 13 pages.
Korean Application No. 10-2017-7030132 , "Office Action", dated Jan. 22, 2019, 23 pages.
Australian Application No. 2016369535 , "First Examination Report", dated Mar. 21, 2019, 3 pages.
Korean Application No. 10-2017-7030132 , "Office Action", dated Apr. 4, 2019, 6 pages.
Russian Application No. 2018121947 , "Office Action", dated Apr. 24, 2019, 7 pages.
Daiming , "Metal Material Science", Southwest Jiaotong University Press, Jun. 30, 2014, 5 pages.
European Application No. 16840352.5 , "Office Action", dated Aug. 7, 2019, 9 pages.
Jiarong , "Q&A on Production Technology of Aluminum Alloy Casting", Metallurgical Industry Press, Jan. 31, 2008, 6 pages.
Korean Application No. 10-2017-7030132 , "Office Action", dated Aug. 20, 2019, 6 pages.
Korean Application No. 10-2019-7015995 , "Office Action", dated Aug. 20, 2019, 6 pages.
Wang et al., "Improving the Strength and Ductility of Al—Mg—Si—Cu Alloys by a Novel Thermo-Mechanical Treatment", Materials Science and Engineering: A, vol. 607, Jun. 23, 2014, pp. 313-317.
Yuanyuan , "New Materials, Science and Technology Metallic Material Volume", South China University of Technology Press, Sep. 30, 2012, 6 pages.
Canadian Application No. 2,981,329 , "Office Action", dated Jul. 4, 2019, 5 pages.
Japanese Application No. 2017-551195 , "Office Action", dated Jun. 4, 2019, 9 pages.
Chinese Application No. 201680019400.4 , "Office Action", dated May 20, 2019, 25 pages.
Korean Application No. 10-2017-7030132 , "Office Action", dated Jun. 17, 2019, 14 pages.
Korean Application No. 10-2019-7015995 , "Office Action", dated Jun. 17, 2019, 18 pages.
KR10-2019-7015995 , "Notice of Decision to Grant", Oct. 1, 2019, 2 pages.
RU2018121947 , "Office Action", Sep. 24, 2019, 12 pages.

* cited by examiner

TENSILE PROPERTIES OF TB1-TB4 ALLOYS IN T4 TEMPER

BENDABILITY OF TB1-TB4 ALLOYS IN T4 TEMPER

TENSILE PROPERTIES OF TB1-TB4 ALLOYS IN T6 TEMPER (A) F → T4

(B) F → O → T4

ODF OF TEXTURE AFTER PROCESSING (A) F → T4 AND (B) F → O → T4

TENSILE PROPERTIES OF THE INDUSTRIAL TB1 ALLOY AFTER PROCESSING OF F→SHT(T4)→AA(T6) vs. F→O→SHT(T4)→AA(T6)

| | T4 | 2% 180C 20' | 5% 205C 30' | 215C 30' | 225C 30' | 160C 10h | 180C 10h | T4 | 2% 180C 20' | 5% 205C 30' | 215C 30' | 225C 30' | 160C 10h | 180C 10h |
|---|---|---|---|---|---|---|---|---|---|---|---|---|---|---|
| SL1 | 293 | 349.1 | 374.6 | 361.3 | 352.9 | 363.3 | 382 | 298 | 353.5 | 378.7 | 365.6 | 357.7 | 386.6 | 376.9 |
| SL2 | 317 | 352 | 371 | 356 | 348 | 372 | 366 | 316.6 | 353.9 | 382.4 | 369.8 | 360.7 | 381 | 379.2 |
| SL3 | 339.6 | 362 | 400.9 | 389.7 | 386 | 395.2 | 403.2 | 353.5 | 375.4 | 412.5 | 402.5 | 398.4 | 404 | 414.6 |
| SL4 | 262.8 | 326.6 | 361.5 | | | 362.9 | 364.5 | 271.7 | 336.5 | 370.3 | | | 370.8 | 371.9 |

1000μm

HIGH-STRENGTH 6XXX ALUMINUM ALLOYS AND METHODS OF MAKING THE SAME

CROSS REFERENCE TO RELATED APPLICATION

The present application claims the benefit of U.S. Provisional Patent Application No. 62/269,385 filed Dec. 18, 2015, which is hereby incorporated by reference in its entirety.

FIELD OF THE INVENTION

The invention is directed to high-strength aluminum alloys and methods of making and processing the same. The invention further relates to 6XXX aluminum alloys exhibiting improved mechanical strength, formability, corrosion resistance, and anodized qualities.

BACKGROUND

Recyclable aluminum alloys with high strength are desirable for improved product performance in many applications, including transportation (encompassing without limitation, e.g., trucks, trailers, trains, and marine) applications, electronic applications, and automobile applications. For example, a high-strength aluminum alloy in trucks or trailers would be lighter than conventional steel alloys, providing significant emission reductions that are needed to meet new, stricter government regulations on emissions. Such alloys should exhibit high strength, high formability, and corrosion resistance.

However, identifying processing conditions and alloy compositions that will provide such an alloy has proven to be a challenge. In addition, the hot rolling of compositions with the potential of exhibiting the desired properties often results in edge cracking issues and the propensity for hot tearing.

SUMMARY

Covered embodiments of the invention are defined by the claims, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification, any or all drawings and each claim.

Provided herein are methods of preparing 6XXX series aluminum alloys, the aluminum alloys, and products comprising the alloys.

One aspect relates to methods of processing aluminum. For example, disclosed is a method of producing an aluminum alloy metal product, the method comprising casting an aluminum alloy to form an ingot, wherein the aluminum alloy comprises about 0.9-1.5 wt. % Cu, about 0.7-1.1 wt. % Si, about 0.7-1.2 wt. % Mg, about 0.06-0.15 wt. % Cr, about 0.05-0.3 wt. % Mn, about 0.1-0.3 wt. % Fe, up to about 0.2 wt. % Zr, up to about 0.2 wt. % Sc, up to about 0.25 wt. % Sn, up to about 0.2 wt. % Zn, up to about 0.15 wt. % Ti, up to about 0.07 wt. % Ni, and up to about 0.15 wt. % of impurities, with the remainder as Al; homogenizing the ingot; hot rolling the ingot to produce a plate, shate, or sheet; and solutionizing the plate, shate or sheet at a temperature between about 520° C. and about 590° C. Throughout this application, all elements are described in weight percentage (wt. %) based on the total weight of the alloy. In some examples, the homogenizing step can include heating the ingot to a temperature of about 520° C. to about 580° C. In some cases, the hot rolling step can be conducted at an entry temperature of about 500° C. to about 540° C. and an exit temperature of about 250° C. to about 380° C. Optionally, the methods can include annealing the plate, shate or sheet. In some such cases, the annealing step can be performed at a temperature that is between about 400° C. and about 500° C. for a soaking time of about 30 to about 120 minutes. In yet other aspects, the methods can include cold rolling the plate, shate or sheet. In some cases, the methods can include quenching the plate, shate or sheet after the solutionizing step. In some other aspects, the methods include aging the plate, shate or sheet. In some such cases, the aging step includes heating the plate, shate or sheet between about 180° C. to about 225° C. for a period of time.

Another aspect relates to methods of processing aluminum that include manufacturing by casting an aluminum alloy to form an ingot, wherein the aluminum alloy comprises about 0.6-0.9 wt. % Cu, about 0.8-1.3 wt. % Si, about 1.0-1.3 wt. % Mg, about 0.03-0.25 wt. % Cr, about 0.05-0.2 wt. % Mn, about 0.15-0.3 wt. % Fe, up to about 0.2 wt. % Zr, up to about 0.2 wt. % Sc, up to about 0.25 wt. % Sn, up to about 0.9 wt. % Zn, up to about 0.1 wt. % Ti, up to about 0.07 wt. % Ni, and up to about 0.15 wt. % of impurities, with the remainder as Al; homogenizing the ingot; hot rolling and cold rolling the ingot to produce a rolled product; and solutionizing the rolled product, wherein the solutionizing temperature is between about 520° C. and about 590° C. In some examples, the homogenizing step is a one-step homogenization that can include heating the ingot to a temperature of about 520° C. to about 580° C. for a period of time. In other examples, the homogenizing step is a two-step homogenization that can include heating the ingot to a temperature of about 480° C. to about 520° C. for a period of time and further heating the ingot to a temperature of about 520° C. to about 580° C. for a period of time. In some cases, the hot rolling step can be conducted at an entry temperature of about 500° C. to about 540° C. and an exit temperature of about 250° C. to about 380° C. In some cases, the methods can include quenching the rolled product after the solutionizing step. In some other aspects, the methods include aging the rolled product. In some such cases, the aging step includes heating the plate, shate or sheet between about 180° C. to about 225° C. for a period of time.

Another aspect relates to methods of processing aluminum that include manufacturing by casting an aluminum alloy to form an ingot, wherein the aluminum alloy comprises about 0.5-2.0 wt. % Cu, about 0.5-1.5 wt. % Si, about 0.5-1.5 wt. % Mg, about 0.001-0.25 wt. % Cr, about 0.005-0.4 wt. % Mn, about 0.1-0.3 wt. % Fe, up to about 0.2 wt. % Zr, up to about 0.2 wt. % Sc, up to about 0.25 wt. % Sn, up to about 4.0 wt. % Zn, up to about 0.15 wt. % Ti, up to about 0.1 wt. % Ni, and up to about 0.15 wt. % of impurities, with the remainder as Al; homogenizing the ingot; hot rolling and cold rolling the ingot to produce a rolled product; and solutionizing the rolled product, wherein the solutionizing temperature is between about 520° C. and about 590° C. In some examples, the homogenizing step is a one-step homogenization that can include heating the ingot to a temperature of about 520° C. to about 580° C. for a period of time. In other examples, the homogenizing step is a two-step homogenization that can include heating the ingot to a temperature of about 480° C. to about 520° C. for a period of time and further heating the ingot to a temperature of about 520° C. to about 580° C. for a period of time. In some cases, the hot rolling step can be conducted at an entry temperature of about 500° C. to about 540° C. and an exit temperature of about 250° C. to about 380° C. In some cases, the methods can include quenching the rolled product after the solutionizing step. In some other aspects, the methods include aging the rolled product. In some such cases, the aging step includes heating the sheet between about 180° C. to about 225° C. for a period of time.

Also disclosed is an aluminum alloy comprising about 0.9-1.5 wt. % Cu, about 0.7-1.1 wt. % Si, about 0.7-1.2 wt. % Mg, about 0.06-0.15 wt. % Cr, about 0.05-0.3 wt. % Mn, about 0.1-0.3 wt. % Fe, up to about 0.2 wt. % Zr, up to about 0.2 wt. % Sc, up to about 0.25 wt. % Sn, up to about 0.2 wt. % Zn, up to about 0.15 wt. % Ti, up to about 0.07 wt. % Ni, and up to about 0.15 wt. % of impurities, with the remainder as Al.

Also disclosed is an aluminum alloy comprising about 0.6-0.9 wt. % Cu, about 0.8-1.3 wt. % Si, about 1.0-1.3 wt. % Mg, about 0.03-0.25 wt. % Cr, about 0.05-0.2 wt. % Mn, about 0.15-0.3 wt. % Fe, up to about 0.2 wt. % Zr, up to about 0.2 wt. % Sc, up to about 0.25 wt. % Sn, up to about 0.9 wt. % Zn, up to about 0.1 wt. % Ti, up to about 0.07 wt. % Ni, and up to about 0.15 wt. % of impurities, with the remainder as Al. Optionally, the aluminum alloy has a Si to Mg ratio of from about 0.55:1 to about 1.30:1 by weight. Optionally, the aluminum alloy has an excess Si content of from −0.5 to 0.1, as described in more detail below.

Also disclosed is an aluminum alloy comprising about 0.5-2.0 wt. % Cu, about 0.5-1.5 wt. % Si, about 0.5-1.5 wt. % Mg, about 0.001-0.25 wt. % Cr, about 0.005-0.4 wt. % Mn, about 0.1-0.3 wt. % Fe, up to about 0.2 wt. % Zr, up to about 0.2 wt. % Sc, up to about 0.25 wt. % Sn, up to about 0.3 wt. % Zn, up to about 0.1 wt. % Ti, up to about 0.1 wt. % Ni, and up to about 0.15 wt. % of impurities, with the remainder as Al.

Further disclosed are products (e.g., transportation body parts, automotive body parts, or electronic device housings) comprising an alloy obtained according to the methods provided herein.

Further aspects, objects, and advantages of the invention will become apparent upon consideration of the detailed description and figures that follow.

DETAILED DESCRIPTION OF THE INVENTION

Definitions and Descriptions

Figure 1:
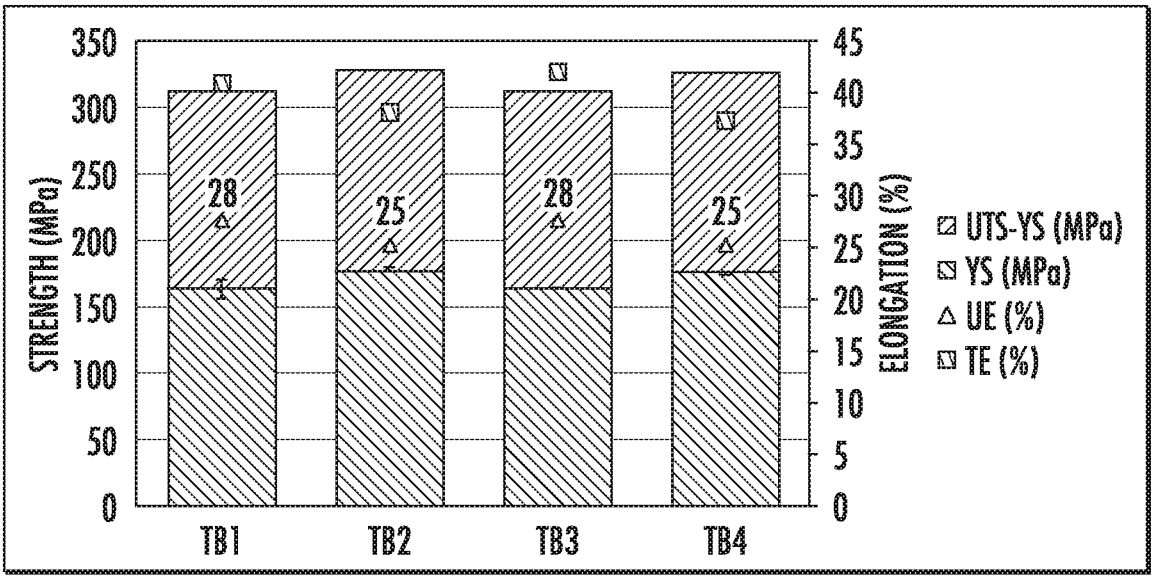
FIG. 1 is a chart that shows a comparison between the tensile properties of alloy compositions TB1, TB2, TB3, and TB4 after processing to T4 temper.

The terms "invention," "the invention," "this invention" and "the present invention" used herein are intended to refer broadly to all of the subject matter of this patent application and the claims below. Statements containing these terms should be understood not to limit the subject matter described herein or to limit the meaning or scope of the patent claims below.

In this description, reference is made to alloys identified by aluminum industry designations, such as "series" or "6XXX." For an understanding of the number designation system most commonly used in naming and identifying aluminum and its alloys, see "International Alloy Designations and Chemical Composition Limits for Wrought Aluminum and Wrought Aluminum Alloys" or "Registration Record of Aluminum Association Alloy Designations and Chemical Compositions Limits for Aluminum Alloys in the Form of Castings and Ingot," both published by The Aluminum Association.

As used herein, the meaning of "a," "an," or "the" includes singular and plural references unless the context clearly dictates otherwise.

As used herein, a plate generally has a thickness of greater than about 15 mm. For example, a plate may refer to an aluminum product having a thickness of greater than 15 mm, greater than 20 mm, greater than 25 mm, greater than 30 mm, greater than 35 mm, greater than 40 mm, greater than 45 mm, greater than 50 mm, or greater than 100 mm.

As used herein, a shate (also referred to as a sheet plate) generally has a thickness of from about 4 mm to about 15 mm. For example, a shate may have a thickness of 4 mm, 5 mm, 6 mm, 7 mm, 8 mm, 9 mm, 10 mm, 11 mm, 12 mm, 13 mm, 14 mm, or 15 mm.

As used herein, a sheet generally refers to an aluminum product having a thickness of less than about 4 mm. For example, a sheet may have a thickness of less than 4 mm, less than 3 mm, less than 2 mm, less than 1 mm, less than 0.5 mm, less than 0.3 mm, or less than 0.1 mm.

Reference is made in this application to alloy temper or condition. For an understanding of the alloy temper descriptions most commonly used, see "American National Standards (ANSI) H35 on Alloy and Temper Designation Systems." An F condition or temper refers to an aluminum alloy as fabricated. An 0 condition or temper refers to an aluminum alloy after annealing. A T4 condition or temper refers to an aluminum alloy after solution heat treatment (SHT) (i.e., solutionization) followed by natural aging. A T6 condition or temper refers to an aluminum alloy after solution heat treatment followed by artificial aging (AA).

The following aluminum alloys are described in terms of their elemental composition in weight percentage (wt. %) based on the total weight of the alloy. In certain examples of each alloy, the remainder is aluminum, with a maximum wt. % of 0.15% for the sum of the impurities.

Alloy Compositions

Described below are novel 6XXX series aluminum alloys. In certain aspects, the alloys exhibit high strength, high formability, and corrosion resistance. The properties of the alloys are achieved due to the methods of processing the alloys to produce the described plates, shates, and sheets. The alloys can have the following elemental composition as provided in Table 1:

TABLE 1

| Element | Weight Percentage (wt. %) |
|---|---|
| Cu | 0.9-1.5 |
| Si | 0.7-1.1 |
| Mg | 0.7-1.2 |
| Cr | 0.06-0.15 |
| Mn | 0.05-0.3 |
| Fe | 0.1-0.3 |
| Zr | 0-0.2 |
| Sc | 0-0.2 |
| Sn | 0-0.25 |
| Zn | 0-0.2 |
| Ti | 0-0.15 |
| Ni | 0-0.07 |
| Others | 0-0.05 (each)<br>0-0.15 (total) |
| Al | Remainder |

In other examples, the alloys can have the following elemental composition as provided in Table 2.

TABLE 2

| Element | Weight Percentage (wt. %) |
|---|---|
| Cu | 0.6-0.9 |
| Si | 0.8-1.3 |
| Mg | 1.0-1.3 |
| Cr | 0.03-0.25 |
| Mn | 0.05-0.2 |
| Fe | 0.15-0.3 |
| Zr | 0-0.2 |
| Sc | 0-0.2 |
| Sn | 0-0.25 |
| Zn | 0-0.9 |
| Ti | 0-0.1 |
| Ni | 0-0.07 |
| Others | 0-0.05 (each)<br>0-0.15 (total) |
| Al | Remainder |

In other examples, the alloys can have the following elemental composition as provided in Table 3.

TABLE 3

| Element | Weight Percentage (wt. %) |
|---|---|
| Cu | 0.5-2.0 |
| Si | 0.5-1.5 |
| Mg | 0.5-1.5 |
| Cr | 0.001-0.25 |
| Mn | 0.005-0.4 |
| Fe | 0.1-0.3 |
| Zr | 0-0.2 |
| Sc | 0-0.2 |
| Sn | 0-0.25 |
| Zn | 0-4.0 |
| Ti | 0-0.15 |
| Ni | 0-0.1 |
| Others | 0-0.05 (each)<br>0-0.15 (total) |
| Al | Remainder |

Aluminum Alloys for Preparing Plates and Shates

In one example, an aluminum alloy can have the following elemental composition as provided in Table 4. In certain aspects, the alloy is used to prepare aluminum plates and shates.

TABLE 4

| Element | Weight Percentage (wt. %) |
|---|---|
| Cu | 0.6-0.9 |
| Si | 0.8-1.3 |
| Mg | 1.0-1.3 |
| Cr | 0.03-0.15 |
| Mn | 0.05-0.2 |
| Fe | 0.15-0.3 |
| Zr | 0-0.2 |
| Sc | 0-0.2 |
| Sn | 0-0.25 |
| Zn | 0-0.9 |
| Ti | 0-0.1 |
| Ni | 0-0.07 |
| Others | 0-0.05 (each)<br>0-0.15 (total) |
| Al | Remainder |

In another example, an aluminum alloy for use in preparing aluminum plates and shates can have the following elemental composition as provided in Table 5.

TABLE 5

| Element | Weight Percentage (wt. %) |
|---|---|
| Cu | 0.65-0.9 |
| Si | 0.9-1.15 |
| Mg | 1.05-1.3 |
| Cr | 0.03-0.15 |
| Mn | 0.05-0.18 |
| Fe | 0.18-0.25 |
| Zr | 0.01-0.2 |
| Sc | 0-0.2 |
| Sn | 0-0.2 |
| Zn | 0.001-0.9 |
| Ti | 0-0.1 |
| Ni | 0-0.05 |
| Others | 0-0.05 (each)<br>0-0.15 (total) |
| Al | Remainder |

In another example, an aluminum alloy for use in preparing aluminum plates and shates can have the following elemental composition as provided in Table 6.

TABLE 6

| Element | Weight Percentage (wt. %) |
|---|---|
| Cu | 0.65-0.9 |
| Si | 1.0-1.1 |
| Mg | 1.1-1.25 |
| Cr | 0.05-0.12 |
| Mn | 0.08-0.15 |
| Fe | 0.15-0.2 |
| Zr | 0.01-0.15 |
| Sc | 0-0.15 |
| Sn | 0-0.2 |
| Zn | 0.004-0.9 |
| Ti | 0-0.03 |
| Ni | 0-0.05 |
| Others | 0-0.05 (each)<br>0-0.15 (total) |
| Al | Remainder |

In certain examples, the disclosed alloy includes copper (Cu) in an amount from about 0.6% to about 0.9% (e.g., from 0.65% to 0.9%, from 0.7% to 0.9%, or from 0.6% to 0.7%) based on the total weight of the alloy. For example, the alloy can include 0.6%, 0.61%, 0.62%, 0.63%, 0.64%, 0.65%, 0.66%, 0.67%, 0.68%, 0.69%, 0.7%, 0.71%, 0.72%, 0.73%, 0.74%, 0.75%, 0.76%, 0.77%, 0.78%, 0.79%, 0.8%, 0.81%, 0.82%, 0.83%, 0.84%, 0.85%, 0.86%, 0.87%, 0.88%, 0.89%, or 0.9% Cu. All expressed in wt. %.

In certain examples, the disclosed alloy includes silicon (Si) in an amount from about 0.8% to about 1.3% (e.g., from 0.8% to 1.2%, from 0.9% to 1.2%, from 0.8% to 1.1%, from 0.9 to 1.15%, from 1.0% to 1.1%, or from 1.05 to 1.2%) based on the total weight of the alloy. For example, the alloy can include 0.8%, 0.81%, 0.82%, 0.83%, 0.84%, 0.85%, 0.86%, 0.87%, 0.88%, 0.89%, 0.9%, 0.91%, 0.92%, 0.93%, 0.94%, 0.95%, 0.96%, 0.97%, 0.98%, 0.99%, 1.0% 1.01% 1.02% 1.03% 1.04% 1.05% 1.06% 1.07% 1.08% 1.09% 1.1% 1.11%, 1.12%, 1.13%, 1.14%, 1.15%, 1.16%, 1.17%, 1.18%, 1.19%, or 1.2%, 1.21%, 1.22%, 1.23%, 1.24%, 1.25%, 1.26%, 1.27%, 1.28%, 1.29%, or 1.3% Si. All expressed in wt. %.

In certain examples, the disclosed alloy includes magnesium (Mg) in an amount from about 1.0% to about 1.3% (e.g., from 1.0% to 1.25%, from 1.1% to 1.25%, from 1.1% to 1.2%, from 1.0% to 1.2%, from 1.05% to 1.3%, or from 1.15% to 1.3%) based on the total weight of the alloy. For example, the alloy can include 1.0%, 1.01%, 1.02%, 1.03%, 1.04%, 1.05%, 1.06%, 1.07%, 1.08%, 1.09%, 1.1%, 1.11%, 1.12%, 1.13%, 1.14%, 1.15%, 1.16%, 1.17%, 1.18%, 1.19%, 1.2%, 1.21%, 1.22%, 1.23%, 1.24%, 1.25%, 1.26%, 1.27%, 1.28%, 1.29%, or 1.3% Mg. All expressed in wt. %.

In certain aspects, Cu, Si and Mg can form precipitates in the alloy to result in an alloy with higher strength. These precipitates can form during the aging processes, after solution heat treatment. During the precipitation process, metastable Guinier Preston (GP) zones can form, which in turn transfer to β" needle shape precipitates that contribute to precipitation strengthening of the disclosed alloys. In certain aspects, addition of Cu leads to the formation of lathe-shaped L phase precipitation, which is a precursor of Q' precipitate phase formation and which further contributes to strength. In certain aspects, the Cu and Si/Mg ratios are controlled to avoid detrimental effects to corrosion resistance.

In certain aspects, for a combined effect of strengthening, formability and corrosion resistance, the alloy has a Cu content of less than about 0.9 wt. % along with a controlled Si to Mg ratio and a controlled excess Si range, as further described below.

The Si to Mg ratio may be from about 0.55:1 to about 1.30:1 by weight. For example, the Si to Mg ratio may be from about 0.6:1 to about 1.25:1 by weight, from about 0.65:1 to about 1.2:1 by weight, from about 0.7:1 to about 1.15:1 by weight, from about 0.75:1 to about 1.1:1 by weight, from about 0.8:1 to about 1.05:1 by weight, from about 0.85:1 to about 1.0:1 by weight, or from about 0.9:1 to about 0.95:1 by weight. In certain aspects, the Si to Mg ratio is from 0.8:1 to 1.15:1. In certain aspects, the Si to Mg ratio is from 0.85:1 to 1:1.

In certain aspects, the alloy may use an almost balanced Si to slightly under-balanced Si approach in alloy design instead of a high excess Si approach. In certain aspects, excess Si is about −0.5 to 0.1. Excess Si as used herein is defined by the equation:

Excess Si=(alloy wt. % Si)−[(alloy wt. % Mg)−⅙×(alloy wt. % Fe+Mn+Cr)]. For example, excess Si can be −0.50, −0.49, −0.48, −0.47, −0.46, −0.45, −0.44, −0.43, −0.42, −0.41, −0.40, −0.39, −0.38, −0.37, −0.36, −0.35, −0.34, −0.33, −0.32, −0.31, −0.30, −0.29, −0.28, −0.27, −0.26, −0.25, −0.24, −0.23, −0.22, −0.21, −0.20, −0.19, −0.18, −0.17, −0.16, −0.15, −0.14, −0.13, −0.12, −0.11, −0.10, −0.09, −0.08, −0.07, −0.06, −0.05, −0.04, −0.03, −0.02, −0.01, 0, 0.01, 0.02, 0.03, 0.04, 0.05, 0.06, 0.07, 0.08, 0.09, or 0.10. In certain aspects, the alloy has Cu<0.9 wt. %, the Si/Mg ratio is 0.85-0.1, and excess Si is −0.5-0.1.

In certain aspects, the alloy includes chromium (Cr) in an amount from about 0.03% to about 0.25% (e.g., from 0.03% to 0.15%, from 0.05% to 0.13%, from 0.075% to 0.12%, from 0.03% to 0.04%, from 0.08% to 0.15%, from 0.03% to 0.045%, from 0.04% to 0.06%, from 0.035% to 0.045%, from 0.04% to 0.08%, from 0.06% to 0.13%, from 0.06% to 0.22%, from 0.1% to 0.13%, or from 0.11% to 0.23%) based on the total weight of the alloy. For example, the alloy can include 0.03%, 0.035%, 0.04%, 0.045%, 0.05%, 0.055%, 0.06%, 0.065%, 0.07%, 0.075%, 0.08%, 0.085%, 0.09%, 0.095%, 0.1%, 0.105%, 0.11%, 0.115%, 0.12%, 0.125%, 0.13%, 0.135%, 0.14%, 0.145%, 0.15%, 0.155%, 0.16%, 0.165%, 0.17%, 0.175%, 0.18% 0.185%, 0.19%, 0.195%, 0.20%, 0.205%, 0.21%, 0.215%, 0.22%, 0.225%, 0.23%, 0.235%, 0.24%, 0.245%, or 0.25% Cr. All expressed in wt. %.

In certain examples, the alloy can include manganese (Mn) in an amount from about 0.05% to about 0.2% (e.g., from 0.05% to 0.18% or from 0.1% to 0.18%) based on the total weight of the alloy. For example, the alloy can include 0.05%, 0.051%, 0.052%, 0.053%, 0.054%, 0.055%, 0.056%, 0.057%, 0.058%, 0.059%, 0.06%, 0.061%, 0.062%, 0.063%, 0.064%, 0.065%, 0.066%, 0.067%, 0.068%, 0.069%, 0.07%, 0.071%, 0.072%, 0.073%, 0.074%, 0.075%, 0.076%, 0.077%, 0.078%, 0.079%, 0.08%, 0.081%, 0.082%, 0.083%, 0.084%, 0.085%, 0.086%, 0.087%, 0.088%, 0.089%, 0.09%, 0.091%, 0.092%, 0.093%, 0.094%, 0.095%, 0.096%, 0.097%, 0.098%, 0.099%, 0.1%, 0.11%, 0.12%, 0.13%, 0.14%, 0.15%, 0.16%, 0.17%, 0.18%, 0.19%, or 0.2% Mn. All expressed in wt. %. In certain aspects, the Mn content was used to minimize coarsening of constituent particles.

In certain aspects, some Cr is used to replace Mn in forming dispersoids. Replacing Mn with Cr can advantageously form dispersoids. In certain aspects, the alloy has a Cr/Mn weight ratio of about 0.15-0.6. For example, the Cr/Mn ratio may be 0.15, 0.16, 0.17, 0.18, 0.19, 0.20, 0.21, 0.22, 0.23, 0.24, 0.25, 0.26, 0.27, 0.28, 0.29, 0.30, 0.31, 0.32, 0.33, 0.34, 0.35, 0.36, 0.37, 0.38, 0.39, 0.40, 0.41, 0.42, 0.43, 0.44, 0.45, 0.46, 0.47, 0.48, 0.49, 0.50, 0.51, 0.52, 0.53, 0.54, 0.55, 0.56, 0.57, 0.58, 0.59, or 0.60. In certain aspects, the Cr/Mn ratio promotes appropriate dispersoids, leading to improved formability, strengthening, and corrosion resistance.

In certain aspects, the alloy also includes iron (Fe) in an amount from about 0.15% to about 0.3% (e.g., from 0.15% to about 0.25%, from 0.18% to 0.25%, from 0.2% to 0.21%, or from 0.15% to 0.22%) based on the total weight of the alloy. For example, the alloy can include 0.15%, 0.16%, 0.17%, 0.18%, 0.19%, 0.2%, 0.21%, 0.22%, 0.23%, 0.24%, 0.25%, 0.26%, 0.27%, 0.28%, 0.29%, or 0.30% Fe. All expressed in wt. %. In certain aspects, the Fe content reduces the forming of coarse constituent particles.

In certain aspects, the alloy includes zirconium (Zr) in an amount up to about 0.2% (e.g., from 0% to 0.2%, from 0.01% to 0.2%, from 0.01% to 0.15%, from 0.01% to 0.1%, or from 0.02% to 0.09%) based on the total weight of the alloy. For example, the alloy can include 0.001%, 0.002%, 0.003%, 0.004%, 0.005%, 0.006%, 0.007%, 0.008%, 0.009%, 0.01%, 0.02% 0.03%, 0.04% 0.05% 0.06% 0.07% 0.08% 0.09% 0.1%, 0.11%, 0.12% 0.13%, 0.14%, 0.15%, 0.16%, 0.17%, 0.18%, 0.19%, or 0.2% Zr. In certain aspects, Zr is not present in the alloy (i.e., 0%). All expressed in wt. %.

In certain aspects, the alloy includes scandium (Sc) in an amount up to about 0.2% (e.g., from 0% to 0.2%, from 0.01% to 0.2%, from 0.05% to 0.15%, or from 0.05% to 0.2%) based on the total weight of the alloy. For example, the alloy can include 0.001%, 0.002%, 0.003%, 0.004%, 0.005%, 0.006%, 0.007%, 0.008%, 0.009%, 0.01%, 0.02%, 0.03%, 0.04%, 0.05%, 0.06%, 0.07%, 0.08%, 0.09%, 0.1%, 0.11%, 0.12%, 0.13%, 0.14%, 0.15%, 0.16%, 0.17%, 0.18%, 0.19%, or 0.2% Sc. In certain examples, Sc is not present in the alloy (i.e., 0%). All expressed in wt. %.

In certain aspects, Sc and/or Zr were added to the above-described compositions to form $Al_3Sc$, $(Al,Si)_3Sc$, $(Al,Si)_3Zr$ and/or $Al_3Zr$ dispersoids.

In certain aspects, the alloy includes tin (Sn) in an amount up to about 0.25% (e.g., from 0% to 0.25%, from 0% to 0.2%, from 0% to 0.05%, from 0.01% to 0.15%, or from 0.01% to 0.1%) based on the total weight of the alloy. For example, the alloy can include 0.001%, 0.002%, 0.003%, 0.004%, 0.005%, 0.006%, 0.007%, 0.008%, 0.009%, 0.01%, 0.02%, 0.03%, 0.04%, 0.05%, 0.06%, 0.07%, 0.08%, 0.09%, 0.1%, 0.11%, 0.12%, 0.13%, 0.14%, 0.15%, 0.16%, 0.17%, 0.18%, 0.19%, 0.2%, 0.21%, 0.22%, 0.23%, 0.24%, or 0.25%. In certain aspects, Sn is not present in the alloy (i.e., 0%). All expressed in wt. %.

In certain aspects, the alloy described herein includes zinc (Zn) in an amount up to about 0.9% (e.g., from 0.001% to 0.09%, from 0.004% to 0.9%, from 0.03% to 0.9%, or from 0.06% to 0.1%) based on the total weight of the alloy. For example, the alloy can include 0.001%, 0.002%, 0.003%, 0.004%, 0.005%, 0.006%, 0.007%, 0.008%, 0.009%, 0.01%, 0.011%, 0.012%, 0.013%, 0.014%, 0.015%, 0.016%, 0.017%, 0.018%, 0.019%, 0.02%, 0.021%, 0.022%, 0.023%, 0.024%, 0.025%, 0.026%, 0.027%, 0.028%, 0.029%, 0.03%, 0.04%, 0.05%, 0.06%, 0.07%, 0.08%, 0.09%, 0.1%, 0.11%, 0.12%, 0.13%, 0.14%, 0.15%, 0.16%, 0.17%, 0.18%, 0.19%, 0.2%, 0.21%, 0.22%, 0.23%, 0.24%, 0.25%, 0.26%, 0.27%, 0.28%, 0.29%, 0.3%, 0.31%, 0.32%, 0.33%, 0.34%, 0.35%, 0.36%, 0.37%, 0.38%, 0.39%, 0.4%, 0.41%, 0.42%, 0.43%, 0.44%, 0.45%, 0.46%, 0.47%, 0.48%, 0.49%, 0.5%, 0.51%, 0.52%, 0.53%, 0.54%, 0.55%, 0.56%, 0.57%, 0.58%, 0.59%, 0.6%, 0.61%, 0.62%, 0.63%, 0.64%, 0.65%, 0.66%, 0.67%, 0.68%, 0.69%, 0.7%, 0.71%, 0.72%, 0.73%, 0.74%, 0.75%, 0.76%, 0.77%, 0.78%, 0.79%, 0.8%, 0.81%, 0.82%, 0.83%, 0.84%, 0.85%, 0.86%, 0.87%, 0.88%, 0.89%, or 0.9% Zn. All expressed in wt. %. In certain aspects, Zn can benefit forming, including bending and the reduction of bending anisotropy in plate products.

In certain aspects, the alloy includes titanium (Ti) in an amount up to about 0.1% (e.g., from 0.01% to 0.1%,) based on the total weight of the alloy. For example, the alloy can include 0.001%, 0.002%, 0.003%, 0.004%, 0.005%, 0.006%, 0.007%, 0.008%, 0.009%, 0.01%, 0.011%, 0.012%, 0.013%, 0.014%, 0.015%, 0.016%, 0.017%, 0.018%, 0.019%, 0.02%, 0.021%, 0.022%, 0.023%, 0.024%, 0.025%, 0.026%, 0.027%, 0.028%, 0.029%, 0.03%, 0.031%, 0.032%, 0.033%, 0.034%, 0.035%, 0.036%, 0.037%, 0.038%, 0.039%, 0.04%, 0.05%, 0.051%, 0.052%, 0.053%, 0.054%, 0.055%, 0.056%, 0.057%, 0.058%, 0.059%, 0.06%, 0.07%, 0.08%, 0.09%, or 0.1% Ti. All expressed in wt. %. In certain aspects, Ti is used as a grain-refiner agent.

In certain aspects, the alloy includes nickel (Ni) in an amount up to about 0.07% (e.g., from 0% to 0.05%, 0.01% to 0.07%, from 0.03% to 0.034%, from 0.02% to 0.03%, from 0.034 to 0.054%, from 0.03 to 0.06%, or from 0.001% to 0.06%) based on the total weight of the alloy. For example, the alloy can include 0.01%, 0.011%, 0.012%, 0.013%, 0.014%, 0.015%, 0.016% 0.017% 0.018%, 0.019% 0.02%, 0.021%, 0.022% 0.023%, 0.024%, 0.025%, 0.026%, 0.027%, 0.028%, 0.029%, 0.03%, 0.031%, 0.032%, 0.033%, 0.034%, 0.035%, 0.036%, 0.037%, 0.038%, 0.039%, 0.04%, 0.041%, 0.042%, 0.043%, 0.044%, 0.045%, 0.046%, 0.047%, 0.048%, 0.049%, 0.05%, 0.0521%, 0.052%, 0.053%, 0.054%, 0.055%, 0.056%, 0.057%, 0.058%, 0.059%, 0.06%, 0.061%, 0.062%, 0.063%, 0.064%, 0.065%, 0.066%, 0.067%, 0.068%, 0.069%, or 0.07% Ni. In certain aspects, Ni is not present in the alloy (i.e., 0%). All expressed in wt. %.

Optionally, the alloy compositions can further include other minor elements, sometimes referred to as impurities, in amounts of about 0.05% or below, 0.04% or below, 0.03% or below, 0.02% or below, or 0.01% or below each. These impurities may include, but are not limited to, V, Ga, Ca, Hf, Sr, or combinations thereof. Accordingly, V, Ga, Ca, Hf, or Sr may be present in an alloy in amounts of 0.05% or below, 0.04% or below, 0.03% or below, 0.02% or below, or 0.01% or below. In certain aspects, the sum of all impurities does not exceed 0.15% (e.g., 0.1%). All expressed in wt. %. In certain aspects, the remaining percentage of the alloy is aluminum.

Aluminum Alloys for Preparing Sheets

Also described is an aluminum alloy for use in preparing aluminum sheets. For example, the aluminum alloy can be used to prepare automotive body sheets. Optionally, a non-limiting example of such an alloy can have the following elemental composition as provided in Table 7.

TABLE 7

| Element | Weight Percentage (wt. %) |
|---|---|
| Cu | 0.5-2.0 |
| Si | 0.5-1.5 |
| Mg | 0.5-1.5 |
| Cr | 0.001-0.25 |
| Mn | 0.005-0.40 |
| Fe | 0.1-0.3 |
| Zr | 0-0.2 |
| Sc | 0-0.2 |
| Sn | 0-0.25 |
| Zn | 0-4.0 |
| Ti | 0-0.15 |
| Ni | 0-0.1 |
| Others | 0-0.05 (each) |
| | 0-0.15 (total) |
| Al | Remainder |

Another non-limiting example of such an alloy has the following elemental composition as provided in Table 8.

TABLE 8

| Element | Weight Percentage (wt. %) |
|---|---|
| Cu | 0.5-2.0 |
| Si | 0.5-1.35 |
| Mg | 0.6-1.5 |
| Cr | 0.001-0.18 |
| Mn | 0.005-0.4 |
| Fe | 0.1-0.3 |
| Zr | 0-0.2 |
| Sc | 0-0.2 |
| Sn | 0-0.25 |
| Zn | 0-0.9 |
| Ti | 0-0.15 |
| Ni | 0-0.07 |
| Others | 0-0.05 (each) |
| | 0-0.15 (total) |
| Al | Remainder |

Another non-limiting example of such an alloy has the following elemental composition as provided in Table 9.

TABLE 9

| Element | Weight Percentage (wt. %) |
|---|---|
| Cu | 0.6-1.0 |
| Si | 0.6-1.35 |
| Mg | 0.9-1.3 |
| Cr | 0.03-0.15 |
| Mn | 0.05-0.4 |
| Fe | 0.1-0.3 |
| Zr | 0-0.2 |
| Sn | 0-0.25 |
| Zn | 0-3.5 |
| Ti | 0-0.15 |
| Ni | 0-0.05 |
| Sc | 0-0.2 |
| Others | 0-0.05 (each) |
| | 0-0.15 (total) |
| Al | Remainder |

Another non-limiting example of such an alloy has the following elemental composition as provided in Table 10.

TABLE 10

| Element | Weight Percentage (wt. %) |
|---|---|
| Cu | 0.6-0.95 |
| Si | 0.7-1.25 |
| Mg | 0.9-1.25 |
| Cr | 0.03-0.1 |
| Mn | 0.05-0.35 |
| Fe | 0.15-0.25 |
| Zr | 0-0.2 |
| Sn | 0-0.25 |
| Zn | 0.5-3.5 |
| Ti | 0-0.15 |
| Ni | 0-0.05 |
| Sc | 0-0.2 |
| Others | 0-0.05 (each) |
| | 0-0.15 (total) |
| Al | Remainder |

Another non-limiting example of such an alloy has the following elemental composition as provided in Table 11.

TABLE 11

| Element | Weight Percentage (wt. %) |
|---|---|
| Cu | 0.6-2.0 |
| Si | 0.55-1.35 |
| Mg | 0.6-1.35 |
| Cr | 0.001-0.18 |
| Mn | 0.005-0.40 |
| Fe | 0.1-0.3 |
| Zr | 0-0.05 |
| Sc | 0-0.05 |
| Sn | 0-0.05 |
| Zn | 0-4.0 |
| Ti | 0.005-0.25 |
| Ni | 0-0.07 |
| Others | 0-0.05 (each) |
| | 0-0.15 (total) |
| Al | Remainder |

Another non-limiting example of such an alloy has the following elemental composition as provided in Table 12.

TABLE 12

| Element | Weight Percentage (wt. %) |
|---|---|
| Cu | 0.65-0.95 |
| Si | 0.6-1.35 |
| Mg | 0.65-1.28 |
| Cr | 0.005-0.12 |
| Mn | 0.07-0.36 |
| Fe | 0.2-0.26 |
| Zr | 0-0.05 |
| Sc | 0-0.05 |
| Sn | 0-0.05 |
| Zn | 0.5-3.1 |
| Ti | 0.08-0.14 |
| Ni | 0.02-0.06 |
| Others | 0-0.05 (each) |
| | 0-0.15 (total) |
| Al | Remainder |

Another non-limiting example of such an alloy has the following elemental composition as provided in Table 13.

TABLE 13

| Element | Weight Percentage (wt. %) |
|---|---|
| Cu | 0.6-0.9 |
| Si | 0.7-1.1 |
| Mg | 0.9-1.5 |
| Cr | 0.06-0.15 |
| Mn | 0.05-0.3 |
| Fe | 0.1-0.3 |
| Zr | 0-0.2 |
| Sc | 0-0.2 |
| Sn | 0-0.25 |
| Zn | 0-0.2 |
| Ti | 0-0.15 |
| Ni | 0-0.07 |
| Others | 0-0.05 (each)<br>0-0.15 (total) |
| Al | Remainder |

Another non-limiting example of such an alloy has the following elemental composition as provided in Table 14.

TABLE 14

| Element | Weight Percentage (wt. %) |
|---|---|
| Cu | 0.8-1.95 |
| Si | 0.6-0.9 |
| Mg | 0.8-1.2 |
| Cr | 0.06-0.18 |
| Mn | 0.005-0.35 |
| Fe | 0.13-0.25 |
| Zr | 0-0.05 |
| Sc | 0-0.05 |
| Sn | 0-0.05 |
| Zn | 0.5-3.1 |
| Ti | 0.01-0.14 |
| Ni | 0-0.05 |
| Others | 0-0.05 (each)<br>0-0.15 (total) |
| Al | Remainder |

Another non-limiting example of such an alloy has the following elemental composition as provided in Table 15.

TABLE 15

| Element | Weight Percentage (wt. %) |
|---|---|
| Cu | 0.8-1.8 |
| Si | 0.6-0.8 |
| Mg | 0.9-1.1 |
| Cr | 0.08-0.15 |
| Mn | 0.01-0.34 |
| Fe | 0.15-0.25 |
| Zr | 0-0.05 |
| Sc | 0-0.05 |
| Sn | 0-0.05 |
| Zn | 0.5-3.1 |
| Ti | 0.01-0.14 |
| Ni | 0-0.05 |
| Others | 0-0.05 (each)<br>0-0.15 (total) |
| Al | Remainder |

In certain aspects, the alloy includes copper (Cu) in an amount from about 0.5% to about 2.0% (e.g., from 0.6 to 2.0%, from 0.7 to 0.9%, from 1.35% to 1.95%, from 0.84% to 0.94%, from 1.6% to 1.8%, from 0.78% to 0.92% from 0.75% to 0.85%, or from 0.65% to 0.75%) based on the total weight of the alloy. For example, the alloy can include 0.5%, 0.51%, 0.52%, 0.53%, 0.54%, 0.55% 0.56%, 0.57%, 0.58%, 0.59%, 0.6%, 0.61%, 0.62%, 0.63%, 0.64%, 0.65%, 0.66%, 0.67%, 0.68%, 0.69%, 0.7%, 0.71%, 0.72%, 0.73%, 0.74%, 0.75%, 0.76%, 0.77%, 0.78%, 0.79%, 0.8%, 0.81%, 0.82%, 0.83%, 0.84%, 0.85%, 0.86%, 0.87%, 0.88%, 0.89%, 0.9%, 0.91%, 0.92%, 0.93%, 0.94%, 0.95%, 0.96%, 0.97%, 0.98%, 0.99%, 1.0%, 1.01%, 1.02%, 1.03%, 1.04%, 1.05%, 1.06%, 1.07%, 1.08%, 1.09%, 1.1%, 1.11%, 1.12%, 1.13%, 1.14%, 1.15%, 1.16%, 1.17%, 1.18%, 1.19%, 1.2%, 1.21%, 1.22%, 1.23%, 1.24%, 1.25%, 1.26%, 1.27%, 1.28%, 1.29%, 1.3%, 1.31%, 1.32%, 1.33%, 1.34%, or 1.35%, 1.36%, 1.37%, 1.38%, 1.39%, 1.4%, 1.41%, 1.42%, 1.43%, 1.44%, 1.45%, 1.46%, 1.47%, 1.48%, 1.49%, 1.5%, 1.51%, 1.52%, 1.53%, 1.54%, 1.55%, 1.56%, 1.57% 1.58% 1.59% 1.6% 1.61% 1.62% 1.63% 1.64% 1.65% 1.66% 1.67%, 1.68%, 1.69%, 1.7%, 1.71%, 1.72%, 1.73%, 1.74%, 1.75%, 1.76%, 1.77%, 1.78%, 1.79%, 1.8%, 1.81% 1.82% 1.83% 1.84% 1.85% 1.86% 1.87% 1.88% 1.89% 1.9% 1.91% 1.92%, 1.93%, 1.94%, 1.95%, 1.96%, 1.97%, 1.98%, 1.99%, or 2.0% Cu. All expressed in wt. %.

In certain aspects, the alloy includes silicon (Si) in an amount from about 0.5% to about 1.5% (e.g., from 0.5% to 1.4%, from 0.55% to 1.35%, from 0.6% to 1.24%, from 1.0% to 1.3%, or from 1.03 to 1.24%) based on the total weight of the alloy. For example, the alloy can include 0.5%, 0.51%, 0.52%, 0.53%, 0.54%, 0.55%, 0.56%, 0.57%, 0.58%, 0.59%, 0.6%, 0.61%, 0.62%, 0.63%, 0.64%, 0.65%, 0.66%, 0.67%, 0.68%, 0.69%, 0.7%, 0.71%, 0.72%, 0.73%, 0.74%, 0.75%, 0.76%, 0.77%, 0.78%, 0.79%, 0.8%, 0.81%, 0.82%, 0.83%, 0.84%, 0.85%, 0.86%, 0.87%, 0.88%, 0.89%, 0.9%, 0.91%, 0.92%, 0.93%, 0.94%, 0.95%, 0.96%, 0.97%, 0.98%, 0.99%, 1.0%, 1.01%, 1.02%, 1.03%, 1.04%, 1.05%, 1.06%, 1.07%, 1.08%, 1.09%, 1.1%, 1.11%, 1.12%, 1.13%, 1.14%, 1.15%, 1.16%, 1.17%, 1.18%, 1.19%, 1.2%, 1.21%, 1.22%, 1.23%, 1.24%, 1.25%, 1.26%, 1.27%, 1.28%, 1.29%, 1.3%, 1.31%, 1.32%, 1.33%, 1.34%, 1.35%, 1.36%, 1.37%, 1.38%, 1.39%, 1.4%, 1.41%, 1.42%, 1.43%, 1.44%, 1.45%, 1.46%, 1.47%, 1.48%, 1.49%, or 1.5% Si. All expressed in wt. %.

In certain aspects, the alloy includes magnesium (Mg) in an amount from about 0.5% to about 1.5% (e.g., about 0.6% to about 1.35%, about 0.65% to 1.2%, from 0.8% to 1.2%, or from 0.9% to 1.1%) based on the total weight of the alloy. For example, the alloy can include 0.5%, 0.51%, 0.52%, 0.53%, 0.54%, 0.55%, 0.56%, 0.57%, 0.58%, 0.59%, 0.6%, 0.61%, 0.62%, 0.63%, 0.64%, 0.65%, 0.66%, 0.67%, 0.68%, 0.69%, 0.7%, 0.71%, 0.72%, 0.73%, 0.74%, 0.75%, 0.76%, 0.77%, 0.78%, 0.79%, 0.8%, 0.81%, 0.82%, 0.83%, 0.84%, 0.85%, 0.86%, 0.87%, 0.88%, 0.89%, 0.9%, 0.91%, 0.92%, 0.93%, 0.94%, 0.95%, 0.96%, 0.97%, 0.98%, 0.99%, 1.0%, 1.01%, 1.02%, 1.03%, 1.04%, 1.05%, 1.06%, 1.07%, 1.08%, 1.09%, 1.1%, 1.11%, 1.12%, 1.13%, 1.14%, 1.15%, 1.16%, 1.17%, 1.18%, 1.19%, 1.2%, 1.21%, 1.22%, 1.23%, 1.24%, 1.25%, 1.26%, 1.27%, 1.28%, 1.29%, 1.3%, 1.31%, 1.32%, 1.33%, 1.34%, 1.35%, 1.36%, 1.37%, 1.38%, 1.39%, 1.4%, 1.41%, 1.42%, 1.43%, 1.44%, 1.45%, 1.46%, 1.47%, 1.48%, 1.49%, or 1.5% Mg. All expressed in wt. %.

In certain aspects, the alloy includes chromium (Cr) in an amount from about 0.001% to about 0.25% (e.g., from 0.001% to 0.15%, from 0.001% to 0.13%, from 0.005% to 0.12%, from 0.02% to 0.04%, from 0.08% to 0.15%, from 0.03% to 0.045%, from 0.01% to 0.06%, from 0.035% to 0.045%, from 0.004% to 0.08%, from 0.06% to 0.13%, from 0.06% to 0.18%, from 0.1% to 0.13%, or from 0.11% to 0.12%) based on the total weight of the alloy. For example, the alloy can include 0.001%, 0.002%, 0.003%, 0.004%, 0.005%, 0.006%, 0.007%, 0.008%, 0.009%, 0.01%, 0.011%, 0.012%, 0.013%, 0.014%, 0.015%, 0.02%, 0.025%, 0.03%, 0.035%, 0.04%, 0.045%, 0.05%, 0.055%, 0.06%, 0.065%, 0.07%, 0.075%, 0.08%, 0.085%, 0.09%, 0.095%, 0.1%, 0.105%, 0.11%, 0.115%, 0.12%, 0.125%, 0.13%, 0.135%, 0.14%, 0.145%, 0.15%, 0.155%, 0.16%, 0.165%, 0.17%, 0.175%, 0.18% 0.185%, 0.19%, 0.195%, 0.20%, 0.205%, 0.21%, 0.215%, 0.22%, 0.225%, 0.23%, 0.235%, 0.24%, 0.245%, or 0.25% Cr. All expressed in wt. %.

In certain aspects, the alloy can include manganese (Mn) in an amount from about 0.005% to about 0.4% (e.g., from 0.005% to 0.34%, from 0.25% to 0.35%, about 0.03%, from 0.11% to 0.19%, from 0.08% to 0.12%, from 0.12% to 0.18%, from 0.09% to 0.31%, from 0.005% to 0.05%, and from 0.01 to 0.03%) based on the total weight of the alloy. For example, the alloy can include 0.005%, 0.006%, 0.007%, 0.008%, 0.009%, 0.01%, 0.011%, 0.012%, 0.013%, 0.014%, 0.015%, 0.016%, 0.017%, 0.018%, 0.019%, 0.02%, 0.021%, 0.022%, 0.023%, 0.024%, 0.025%, 0.026%, 0.027%, 0.028%, 0.029%, 0.03%, 0.031%, 0.032%, 0.033%, 0.034%, 0.035%, 0.036%, 0.037%, 0.038%, 0.039%, 0.04%, 0.041%, 0.042%, 0.043%, 0.044%, 0.045%, 0.046%, 0.047%, 0.048%, 0.049%, 0.05%, 0.051%, 0.052%, 0.053%, 0.054%, 0.055%, 0.056%, 0.057%, 0.058%, 0.059%, 0.06%, 0.061%, 0.062%, 0.063%, 0.064%, 0.065%, 0.066%, 0.067%, 0.068%, 0.069%, 0.07%, 0.071%, 0.072%, 0.073%, 0.074%, 0.075%, 0.076%, 0.077%, 0.078%, 0.079%, 0.08%, 0.081%, 0.082%, 0.083%, 0.084%, 0.085%, 0.086%, 0.087%, 0.088%, 0.089%, 0.09%, 0.091%, 0.092%, 0.093%, 0.094%, 0.095%, 0.096%, 0.097%, 0.098%, 0.099%, 0.1%, 0.11%, 0.12%, 0.13%, 0.14%, 0.15%, 0.16%, 0.17%, 0.18%, 0.19%, 0.2% 0.21%, 0.22%, 0.23%, 0.24%, 0.25%, 0.26%, 0.27%, 0.28%, 0.29%, 0.3%, 0.31%, 0.32%, 0.33%, 0.34%, 0.35%, 0.36%, 0.37%, 0.38%, 0.39%, or 0.4% Mn. All expressed in wt. %.

In certain aspects, the alloy includes iron (Fe) in an amount from about 0.1% to about 0.3% (e.g., from 0.15% to 0.25%, from 0.14% to 0.26%, from 0.13% to 0.27%, from 0.12% to 0.28%, or from) based on the total weight of the alloy. For example, the alloy can include 0.1%, 0.11% 0.12% 0.13% 0.14% 0.15% 0.16% 0.17% 0.18% 0.19% 0.2% 0.21% 0.22%, 0.23%, 0.24%, 0.25%, 0.26%, 0.27%, 0.28%, 0.29%, or 0.3% Fe. All expressed in wt. %.

In certain aspects, the alloy includes zirconium (Zr) in an amount up to about 0.2% (e.g., from 0% to 0.2%, from 0.01% to 0.2%, from 0.01% to 0.15%, from 0.01% to 0.1%, or from 0.02% to 0.09%) based on the total weight of the alloy. For example, the alloy can include 0.001%, 0.002%, 0.003%, 0.004%, 0.005%, 0.006%, 0.007%, 0.008%, 0.009%, 0.01%, 0.02%, 0.03%, 0.04%, 0.05%, 0.06%, 0.07%, 0.08%, 0.09%, 0.1%, 0.11%, 0.12%, 0.13%, 0.14%, 0.15%, 0.16%, 0.17%, 0.18%, 0.19%, or 0.2% Zr. In certain cases, Zr is not present in the alloy (i.e., 0%). All expressed in wt. %

In certain aspects, the alloy includes scandium (Sc) in an amount up to about 0.2% (e.g., from 0% to 0.2%, from 0.01% to 0.2%, from 0.05% to 0.15%, or from 0.05% to 0.2%) based on the total weight of the alloy. For example, the alloy can include 0.001%, 0.002%, 0.003%, 0.004%, 0.005%, 0.006%, 0.007%, 0.008%, 0.009%, 0.01%, 0.02%, 0.03%, 0.04%, 0.05% 0.06% 0.07% 0.08% 0.09% 0.1% 0.11% 0.12% 0.13% 0.14% 0.15% 0.16%, 0.17%, 0.18%, 0.19%, or 0.2% Sc. In certain cases, Sc is not present in the alloy (i.e., 0%). All expressed in wt. %.

In certain aspects, the alloy includes zinc (Zn) in an amount up to about 4.0% (e.g., from 0.001% to 0.09%, from 0.4% to 3.0%, from 0.03% to 0.3%, from 0% to 1.0%, from 1.0% to 2.5%, or from 0.06% to 0.1%) based on the total weight of the alloy. For example, the alloy can include 0.001%, 0.002%, 0.003%, 0.004%, 0.005%, 0.006%, 0.007%, 0.008%, 0.009%, 0.01%, 0.011%, 0.012%, 0.013%, 0.014%, 0.015%, 0.016%, 0.017%, 0.018%, 0.019%, 0.02%, 0.021%, 0.022%, 0.023%, 0.024%, 0.025%, 0.026%, 0.027%, 0.028%, 0.029%, 0.03%, 0.04%, 0.05%, 0.06%, 0.07%, 0.08%, 0.09%, 0.1%, 0.11%, 0.12%, 0.13%, 0.14%, 0.15%, 0.16%, 0.17%, 0.18%, 0.19%, 0.2%, 0.21%, 0.22%, 0.23%, 0.24%, 0.25%, 0.26%, 0.27%, 0.28%, 0.29%, 0.3%, 0.31%, 0.32%, 0.33%, 0.34%, 0.35%, 0.36%, 0.37%, 0.38%, 0.39%, 0.4%, 0.41%, 0.42%, 0.43%, 0.44%, 0.45%, 0.46%, 0.47%, 0.48%, 0.49%, 0.5%, 0.51%, 0.52%, 0.53%, 0.54%, 0.55%, 0.56%, 0.57%, 0.58%, 0.59%, 0.6%, 0.61%, 0.62%, 0.63%, 0.64%, 0.65%, 0.66%, 0.67%, 0.68%, 0.69%, 0.7%, 0.71%, 0.72%, 0.73%, 0.74%, 0.75%, 0.76%, 0.77%, 0.78%, 0.79%, 0.8%, 0.81%, 0.82%, 0.83%, 0.84%, 0.85%, 0.86%, 0.87%, 0.88%, 0.89%, 0.9%, 0.91%, 0.92%, 0.93%, 0.94%, 0.95%, 0.96%, 0.97%, 0.98%, 0.99%, 1.0%, 1.01%, 1.02%, 1.03%, 1.04%, 1.05%, 1.06%, 1.07%, 1.08%, 1.09%, 1.1%, 1.11%, 1.12%, 1.13%, 1.14%, 1.15%, 1.16%, 1.17%, 1.18%, 1.19%, 1.2%, 1.21%, 1.22%, 1.23%, 1.24%, 1.25%, 1.26%, 1.27%, 1.28%, 1.29%, 1.3%, 1.31%, 1.32%, 1.33%, 1.34%, or 1.35%, 1.36%, 1.37%, 1.38%, 1.39%, 1.4%, 1.41%, 1.42%, 1.43%, 1.44%, 1.45%, 1.46%, 1.47%, 1.48%, 1.49%, 1.5%, 1.51%, 1.52%, 1.53%, 1.54%, 1.55%, 1.56%, 1.57%, 1.58%, 1.59%, 1.6%, 1.61%, 1.62%, 1.63%, 1.64%, 1.65%, 1.66%, 1.67%, 1.68%, 1.69%, 1.7%, 1.71%, 1.72%, 1.73%, 1.74%, 1.75%, 1.76%, 1.77%, 1.78%, 1.79%, 1.8%, 1.81%, 1.82%, 1.83%, 1.84%, 1.85%, 1.86%, 1.87%, 1.88%, 1.89%, 1.9%, 1.91%, 1.92%, 1.93%, 1.94%, 1.95%, 1.96%, 1.97%, 1.98%, 1.99%, 2.0%, 2.01%, 2.02%, 2.03%, 2.04%, 2.05%, 2.06%, 2.07%, 2.08%, 2.09%, 2.1%, 2.11%, 2.12%, 2.13%, 2.14%, 2.15%, 2.16%, 2.17%, 2.18%, 2.19%, 2.2%, 2.21%, 2.22%, 2.23%, 2.24%, 2.25%, 2.26%, 2.27%, 2.28%, 2.29%, 2.3%, 2.31%, 2.32%, 2.33%, 2.34%, 2.35%, 2.36%, 2.37%, 2.38%, 2.39%, 2.4%, 2.41%, 2.42%, 2.43%, 2.44%, 2.45%, 2.46%, 2.47%, 2.48%, 2.49%, 2.5%, 2.51%, 2.52%, 2.53%, 2.54%, 2.55%, 2.56%, 2.57%, 2.58%, 2.59%, 2.6%, 2.61%, 2.62%, 2.63%, 2.64%, 2.65%, 2.66%, 2.67%, 2.68%, 2.69%, 2.7%, 2.71%, 2.72%, 2.73%, 2.74%, 2.75%, 2.76%, 2.77%, 2.78%, 2.79%, 2.8%, 2.81%, 2.82%, 2.83%, 2.84%, 2.85%, 2.86%, 2.87%, 2.88%, 2.89%, 2.9%, 2.91%, 2.92%, 2.93%, 2.94%, 2.95%, 2.96%, 2.97%, 2.98%, 2.99%, 3.0%, 3.01%, 3.02%, 3.03%, 3.04%, 3.05%, 3.06%, 3.07%, 3.08%, 3.09%, 3.1%, 3.11%, 3.12%, 3.13%, 3.14%, 3.15%, 3.16%, 3.17%, 3.18%, 3.19%, 3.2%, 3.21%, 3.22%, 3.23%, 3.24%, 3.25%, 3.26%, 3.27%, 3.28%, 3.29%, 3.3%, 3.31%, 3.32%, 3.33%, 3.34%, 3.35%, 3.36%, 3.37%, 3.38%, 3.39%, 3.4%, 3.41%, 3.42%, 3.43%, 3.44%, 3.45%, 3.46%, 3.47%, 3.48%, 3.49%, 3.5%, 3.51%, 3.52%, 3.53%, 3.54%, 3.55%, 3.56%, 3.57%, 3.58%, 3.59%, 3.6%, 3.61%, 3.62%, 3.63%, 3.64%, 3.65%, 3.66%, 3.67%, 3.68%, 3.69%, 3.7%, 3.71%, 3.72%, 3.73 3.74% 3.75% 3.76% 3.77% 3.78% 3.79% 3.8% 3.81%, 3.82% 3.83% 3.84% 3.85%, 3.86%, 3.87%, 3.88%, 3.89%, 3.9%, 3.91%, 3.92%, 3.93%, 3.94%, 3.95%, 3.96%, 3.97%, 3.98%, 3.99%, or 4.0% Zn. In certain cases, Zn is not present in the alloy (i.e., 0%). All expressed in wt. %.

In certain aspects, the alloy includes tin (Sn) in an amount up to about 0.25% (e.g., from 0% to 0.25%, from 0% to 0.2%, from 0% to 0.05%, from 0.01% to 0.15%, or from 0.01% to 0.1%) based on the total weight of the alloy. For example, the alloy can include 0.001%, 0.002%, 0.003%, 0.004%, 0.005%, 0.006%, 0.007%, 0.008%, 0.009%, 0.01%, 0.02%, 0.03%, 0.04%, 0.05%, 0.06%, 0.07%, 0.08%, 0.09%, 0.1%, 0.11%, 0.12%, 0.13%, 0.14%, 0.15% 0.16% 0.17% 0.18% 0.19% 0.2% 0.21% 0.22% 0.23% 0.24% or 0.25%.

In certain cases, Sn is not present in the alloy (i.e., 0%). All expressed in wt. %.

In certain aspects, the alloy includes titanium (Ti) in an amount up to about 0.15% (e.g., from 0.01% to 0.1%,) based on the total weight of the alloy. For example, the alloy can include 0.001%, 0.002%, 0.003%, 0.004%, 0.005%, 0.006%, 0.007%, 0.008%, 0.009%, 0.01%, 0.011%, 0.012%, 0.013%, 0.014%, 0.015%, 0.016%, 0.017%, 0.018%, 0.019%, 0.02%, 0.021%, 0.022%, 0.023%, 0.024%, 0.025%, 0.026%, 0.027%, 0.028%, 0.029%, 0.03%, 0.031%, 0.032%, 0.033%, 0.034%, 0.035%, 0.036%, 0.037%, 0.038%, 0.039%, 0.04%, 0.05%, 0.051%, 0.052%, 0.053%, 0.054%, 0.055%, 0.056%, 0.057%, 0.058%, 0.059%, 0.06%, 0.07%, 0.08%, 0.09%, 0.1%, 0.11%, 0.12%, 0.13%, 0.14%, or 0.15% Ti. All expressed in wt. %.

In certain aspects, the alloy includes nickel (Ni) in an amount up to about 0.1% (e.g., from 0.01% to 0.1%,) based on the total weight of the alloy. For example, the alloy can include 0.001%, 0.002%, 0.003%, 0.004%, 0.005%, 0.006%, 0.007%, 0.008%, 0.009%, 0.01%, 0.011%, 0.012%, 0.013%, 0.014%, 0.015%, 0.016%, 0.017%, 0.018%, 0.019%, 0.02%, 0.021%, 0.022%, 0.023%, 0.024%, 0.025%, 0.026%, 0.027%, 0.028%, 0.029%, 0.03%, 0.031%, 0.032%, 0.033%, 0.034%, 0.035%, 0.036%, 0.037%, 0.038%, 0.039%, 0.04%, 0.05%, 0.051%, 0.052%, 0.053%, 0.054%, 0.055%, 0.056%, 0.057%, 0.058%, 0.059%, 0.06%, 0.07%, 0.08%, 0.09%, or 0.1% Ni. In certain aspects, Ni is not present in the alloy (i.e., 0%). All expressed in wt. %.

Optionally, the alloy compositions described herein can further include other minor elements, sometimes referred to as impurities, in amounts of about 0.05% or below, 0.04% or below, 0.03% or below, 0.02% or below, or 0.01% or below each. These impurities may include, but are not limited to, V, Ga, Ca, Hf, Sr, or combinations thereof. Accordingly, V, Ga, Ca, Hf, or Sr may be present in an alloy in amounts of 0.05% or below, 0.04% or below, 0.03% or below, 0.02% or below, or 0.01% or below. In certain examples, the sum of all impurities does not exceed about 0.15% (e.g., 0.1%). All expressed in wt. %. In certain examples, the remaining percentage of the alloy is aluminum.

An exemplary alloy includes 1.03% Si, 0.22% Fe, 0.66% Cu, 0.14% Mn, 1.07% Mg, 0.025% Ti, 0.06% Cr, and up to 0.15% total impurities, with the remainder Al.

Another exemplary alloy includes 1.24% Si, 0.22% Fe, 0.81% Cu, 0.11% Mn, 1.08% Mg, 0.024% Ti, 0.073% Cr, and up to 0.15% total impurities, with the remainder Al.

Another exemplary alloy includes 1.19% Si, 0.16% Fe, 0.66% Cu, 0.17% Mn, 1.16% Mg, 0.02% Ti, 0.03% Cr, and up to 0.15% total impurities, with the remainder Al.

Another exemplary alloy includes 0.97% Si, 0.18% Fe, 0.80% Cu, 0.19% Mn, 1.11% Mg, 0.02% Ti, 0.03% Cr, and up to 0.15% total impurities, with the remainder Al.

Another exemplary alloy includes 1.09% Si, 0.18% Fe, 0.61% Cu, 0.18% Mn, 1.20% Mg, 0.02% Ti, 0.03% Cr, and up to 0.15% total impurities, with the remainder Al.

Another exemplary alloy includes 0.76% Si, 0.22% Fe, 0.91% Cu, 0.32% Mn, 0.94% Mg, 0.12% Ti, 3.09% Zn, and up to 0.15% total impurities, with the remainder Al.

Alloy Properties

In some non-limiting examples, the disclosed alloys have very high formability and bendability in the T4 temper and very high strength and good corrosion resistance in the T6 temper compared to conventional 6XXX series alloys. In certain cases, the alloys also demonstrate very good anodized qualities.

In certain aspects, the aluminum alloy may have an in-service strength (strength on a vehicle) of at least about 340 MPa. In non-limiting examples, the in-service strength is at least about 350 MPa, at least about 360 MPa, at least about 370 MPa, at least about 380 MPa, at least about 390 MPa, at least about 395 MPa, at least about 400 MPa, at least about 410 MPa, at least about 420 MPa, at least about 430 MPa, or at least about 440 MPa, at least about 450 MPa, at least about 460 MPa, at least about 470 MPa, at least about 480 MPa, at least about 490 MPa, at least about 495 MPa, or at least about 500 MPa. In some cases, the in-service strength is from about 340 MPa to about 500 MPa. For example, the in-service strength can be from about 350 MPa to about 495 MPa, from about 375 MPa to about 475 MPa, from about 400 MPa to about 450 MPa, from about 380 MPa to about 390 MPa, or from about 385 MPa to about 395 MPa.

In certain aspects, the alloy encompasses any in-service strength that has sufficient ductility or toughness to meet a R/t bendability of about 1.3 or less in the T4 temper (e.g., 1.0 or less). In certain examples, the R/t bendability is about 1.2 or less, 1.1 or less, 1.0 or less, 0.8 or less, 0.7 or less, 0.6 or less, 0.5 or less, or 0.4 or less, where R is the radius of the tool (die) used and t is the thickness of the material.

In certain aspects, the alloy provides a bendability in thinner gauge alloy sheets showing a bend angle of less than 95° in T4 temper and less than 140° in T6 temper. In some non-limiting examples the bend angle of alloy sheets in T4 temper can be at least 90°, 85°, 80°, 75°, 70°, 65°, 60°, 55°, 50°, 45°, 40°, 35°, 30°, 25°, 20°, 15°, 10°, 5°, or 1°. In some non-limiting examples, the bend angle of alloy sheets in T6 temper can be at least 135°, 130°, 125°, 120°, 115°, 110°, 105°, 100°, 95°, 90°, 85°, 80°, 75°, 70°, 65°, 60°, 55°, 50°, 45°, 40°, 35°, 30°, 25°, 20°, 15°, 10°, 5°, or 1°.

In certain aspects, the alloy provides a uniform elongation of greater than or equal to 20% and a total elongation of greater than or equal to 25%. In certain aspects, the alloy provides a uniform elongation of greater than or equal to 22% and a total elongation of greater than or equal to 27%.

In certain aspects, the alloy may have a corrosion resistance that provides an intergranular corrosion (IGC) attack depth of 200 μm or less under the ASTM G110 standard. In certain cases, the IGC corrosion attack depth is 190 μm or less, 180 μm or less, 170 μm or less, 160 μm or less, or even 150 μm or less. In some further examples, the alloy may have a corrosion resistance that provides an IGC attack depth of 300 μm or less for thicker gauge shates and 350 μm or less for thinner gauge sheets under the ISO 11846 standard. In certain cases, the IGC corrosion attack depth is 290 μm or less, 280 μm or less, 270 μm or less, 260 μm or less, 250 μm or less, 240 μm or less, 230 μm or less, 220 μm or less, 210 μm or less, 200 μm or less, 190 μm or less, 180 μm or less, 170 μm or less, 160 μm or less, or even 150 μm or less for alloy shates. In certain cases, the IGC corrosion attack depth is 340 μm or less, 330 μm or less, 320 μm or less, 310 μm or less, 300 μm or less, 290 μm or less, 280 μm or less, 270 μm or less, 260 μm or less, 250 μm or less, 240 μm or less, 230 μm or less, 220 μm or less, 210 μm or less, 200 μm or less, 190 μm or less, 180 μm or less, 170 μm or less, 160 μm or less, or even 150 μm or less for alloy sheets.

The mechanical properties of the aluminum alloy may be controlled by various aging conditions depending on the desired use. As one example, the alloy can be produced (or provided) in the T4 temper or the T6 temper or the T8 temper. T4 plates, shates (i.e., sheet plates), or sheets, which refer to plates, shates, or sheets that are solution heat-treated and naturally aged, can be provided. These T4 plates, shates, and sheets can optionally be subjected to additional aging treatment(s) to meet strength requirements upon receipt. For example, plates, shates, and sheets can be delivered in other tempers, such as the T6 temper or the T8 temper, by subjecting the T4 alloy material to the appropriate aging treatment as described herein or otherwise known to those of skill in the art.

Methods of Preparing the Plates and Shates

In certain aspects, the disclosed alloy composition is a product of a disclosed method. Without intending to limit the invention, aluminum alloy properties are partially determined by the formation of microstructures during the alloy's preparation. In certain aspects, the method of preparation for an alloy composition may influence or even determine whether the alloy will have properties adequate for a desired application.

The alloy described herein can be cast using a casting method as known to those of skill in the art. For example, the casting process can include a Direct Chill (DC) casting process. The DC casting process is performed according to standards commonly used in the aluminum industry as known to one of skill in the art. Optionally, the casting process can include a continuous casting (CC) process. The cast product can then be subjected to further processing steps. In one non-limiting example, the processing method includes homogenization, hot rolling, solutionization, and quenching. In some cases, the processing steps further include annealing and/or cold rolling if desired.

Homogenization

The homogenization step can include heating an ingot prepared from an alloy composition described herein to attain a peak metal temperature (PMT) of about, or at least about, 520° C. (e.g., at least 520° C., at least 530° C., at least 540° C., at least 550° C., at least 560° C., at least 570° C., or at least 580° C.). For example, the ingot can be heated to a temperature of from about 520° C. to about 580° C., from about 530° C. to about 575° C., from about 535° C. to about 570° C., from about 540° C. to about 565° C., from about 545° C. to about 560° C., from about 530° C. to about 560° C., or from about 550° C. to about 580° C. In some cases, the heating rate to the PMT can be about 100° C./hour or less, 75° C./hour or less, 50° C./hour or less, 40° C./hour or less, 30° C./hour or less, 25° C./hour or less, 20° C./hour or less, or 15° C./hour or less. In other cases, the heating rate to the PMT can be from about 10° C./min to about 100° C./min (e.g., about 10° C./min to about 90° C./min, about 10° C./min to about 70° C./min, about 10° C./min to about 60° C./min, from about 20° C./min to about 90° C./min, from about 30° C./min to about 80° C./min, from about 40° C./min to about 70° C./min, or from about 50° C./min to about 60° C./min).

The ingot is then allowed to soak (i.e., held at the indicated temperature) for a period of time. According to one non-limiting example, the ingot is allowed to soak for up to about 6 hours (e.g., from about 30 minutes to about 6 hours, inclusively). For example, the ingot can be soaked at a temperature of at least 500° C. for 30 minutes, 1 hour, 2 hours, 3 hours, 4 hours, 5 hours, or 6 hours, or anywhere in between.

Hot Rolling

Following the homogenization step, a hot rolling step can be performed. In certain cases, the ingots are laid down and hot-rolled with an entry temperature range of about 500° C.-540° C. The entry temperature can be, for example, about 505° C., 510° C., 515° C., 520° C., 525° C., 530° C., 535° C., or 540° C. In certain cases, the hot roll exit temperature can range from about 250° C.-380° C. (e.g., from about 330° C.-370° C.). For example, the hot roll exit temperature can be about 255° C., 260° C., 265° C., 270° C., 275° C., 280° C., 285° C., 290° C., 295° C., 300° C., 305° C., 310° C., 315° C., 320° C., 325° C., 330° C., 335° C., 340° C., 345° C., 350° C., 355° C., 360° C., 365° C., 370° C., 375° C., or 380° C.

In certain cases, the ingot can be hot rolled to an about 4 mm to about 15 mm thick gauge (e.g., from about 5 mm to about 12 mm thick gauge), which is referred to as a shate. For example, the ingot can be hot rolled to an about 4 mm thick gauge, about 5 mm thick gauge, about 6 mm thick gauge, about 7 mm thick gauge, about 8 mm thick gauge, about 9 mm thick gauge, about 10 mm thick gauge, about 11 mm thick gauge, about 12 mm thick gauge, about 13 mm thick gauge, about 14 mm thick gauge, or about 15 mm thick gauge. In certain cases, the ingot can be hot rolled to a gauge greater than 15 mm thick (i.e., a plate). In other cases, the ingot can be hot rolled to a gauge less than 4 mm (i.e., a sheet). The temper of the as-rolled plates, shates and sheets is referred to as F-temper.

Optional Processing Steps: Annealing Step and Cold Rolling Step

In certain aspects, the alloy undergoes further processing steps after the hot rolling step and before any subsequent steps (e.g., before a solutionizing step). Further process steps may include an annealing procedure and a cold rolling step.

The annealing step can result in an alloy with improved texture (e.g., an improved T4 alloy) with reduced anisotropy during forming operations, such as stamping, drawing, or bending. By applying the annealing step, the texture in the modified temper is controlled/engineered to be more random and to reduce those texture components (TCs) that can yield strong formability anisotropy (e.g., Goss, Goss-ND, or Cube-RD). This improved texture can potentially reduce the bending anisotropy and can improve the formability in the forming where a drawing or circumferential stamping process is involved, as it acts to reduce the variability in properties at different directions.

The annealing step can include heating the alloy from room temperature to a temperature from about 400° C. to about 500° C. (e.g., from about 405° C. to about 495° C., from about 410° C. to about 490° C., from about 415° C. to about 485° C., from about 420° C. to about 480° C., from about 425° C. to about 475° C., from about 430° C. to about 470° C., from about 435° C. to about 465° C., from about 440° C. to about 460° C., from about 445° C. to about 455° C., from about 450° C. to about 460° C., from about 400° C. to about 450° C., from about 425° C. to about 475° C., or from about 450° C. to about 500° C.).

The plate or shate can soak at the temperature for a period of time. In one non-limiting example, the plate or shate is allowed to soak for up to approximately 2 hours (e.g., from about 15 to about 120 minutes, inclusively). For example, the plate or shate can be soaked at the temperature of from about 400° C. to about 500° C. for 15 minutes, 20 minutes, 25 minutes, 30 minutes, 35 minutes, 40 minutes, 45 minutes, 50 minutes, 55 minutes, 60 minutes, 65 minutes, 70 minutes, 75 minutes, 80 minutes, 85 minutes, 90 minutes, 95 minutes, 100 minutes, 105 minutes, 110 minutes, 115 minutes, or 120 minutes, or anywhere in between.

In certain aspects, the alloy does not undergo an annealing step.

A cold rolling step can optionally be applied to the alloy before the solutionizing step. In certain aspects, the rolled product from the hot rolling step (e.g., the plate or shate) can be cold rolled to a thin gauge shate (e.g., about 4.0 to 4.5 mm). In certain aspects, the rolled product is cold rolled to about 4.0, about 4.1 mm, about 4.2 mm, about 4.3 mm, about 4.4 mm, or about 4.5 mm.

Solutionizing

The solutionizing step can include heating the plate or shate from room temperature to a temperature of from about 520° C. to about 590° C. (e.g., from about 520° C. to about 580° C., from about 530° C. to about 570° C., from about 545° C. to about 575° C., from about 550° C. to about 570° C., from about 555° C. to about 565° C., from about 540° C. to about 560° C., from about 560° C. to about 580° C., or from about 550° C. to about 575° C.). The plate or shate can soak at the temperature for a period of time. In certain aspects, the plate or shate is allowed to soak for up to approximately 2 hours (e.g., from about 10 seconds to about 120 minutes inclusively). For example, the plate or shate can be soaked at the temperature of from about 525° C. to about 590° C. for 20 seconds, 25 seconds, 30 seconds, 35 seconds, 40 seconds, 45 seconds, 50 seconds, 55 seconds, 60 seconds, 65 seconds, 70 seconds, 75 seconds, 80 seconds, 85 seconds, 90 seconds, 95 seconds, 100 seconds, 105 seconds, 110 seconds, 115 seconds, 120 seconds, 125 seconds, 130 seconds, 135 seconds, 140 seconds, 145 seconds, or 150 seconds, 5 minutes, 10 minutes, 15 minutes, 20 minutes, 25 minutes, 30 minutes, 35 minutes, 40 minutes, 45 minutes, 50 minutes, 55 minutes, 60 minutes, 65 minutes, 70 minutes, 75 minutes, 80 minutes, 85 minutes, 90 minutes, 95 minutes, 100 minutes, 105 minutes, 110 minutes, 115 minutes, or 120 minutes, or anywhere in between.

In certain aspects, the heat treatment is performed immediately after the hot or cold rolling step. In certain aspects, the heat treatment is performed after an annealing step.

Quenching

In certain aspects, the plate or shate can then be cooled to a temperature of about 25° C. at a quench speed that can vary between about 50° C./s to 400° C./s in a quenching step that is based on the selected gauge. For example, the quench rate can be from about 50° C./s to about 375° C./s, from about 60° C./s to about 375° C./s, from about 70° C./s to about 350° C./s, from about 80° C./s to about 325° C./s, from about 90° C./s to about 300° C./s, from about 100° C./s to about 275° C./s, from about 125° C./s to about 250° C./s, from about 150° C./s to about 225° C./s, or from about 175° C./s to about 200° C./s.

In the quenching step, the plate or shate is rapidly quenched with a liquid (e.g., water) and/or gas or another selected quench medium. In certain aspects, the plate or shate can be rapidly quenched with water. In certain aspects, the plate or shate is quenched with air.

Aging

The plate or shate can be naturally aged for a period of time to result in the T4 temper. In certain aspects, the plate or shate in the T4 temper can be artificially aged (AA) at about 180° C. to 225° C. (e.g., 185° C., 190° C., 195° C., 200° C., 205° C., 210° C., 215° C., 220° C., or 225° C.) for a period of time. Optionally, the plate or shate can be artificially aged for a period from about 15 minutes to about 8 hours (e.g., 15 minutes, 30 minutes, 1 hour, 2 hours, 3 hours, 4 hours, 5 hours, 6 hours, 7 hours, or 8 hours or anywhere in between) to result in the T6 temper.

Coil Production

In certain aspects, the annealing step during production can also be applied to produce the plate or shate material in a coil form for improved productivity or formability. For example, an alloy in coil form can be supplied in the 0 temper, using a hot or cold rolling step and an annealing step following the hot or cold rolling step. Forming may occur in 0 temper, which is followed by solution heat treatment, quenching and artificial aging/paint baking.

In certain aspects, to produce a plate or shate in coil form and with high formability compared to F temper, an annealing step as described herein can be applied to the coil. Without intending to limit the invention, the purpose for the annealing and the annealing parameters may include (1) releasing the work-hardening in the material to gain formability; (2) recrystallizing or recovering the material without causing significant grain growth; (3) engineering or converting texture to be appropriate for forming and for reducing anisotropy during formability; and (4) avoiding the coarsening of pre-existing precipitation particles.

Methods of Preparing the Sheets

In certain aspects, the disclosed alloy composition is a product of a disclosed method. Without intending to limit the invention, aluminum alloy properties are partially determined by the formation of microstructures during the alloy's preparation. In certain aspects, the method of preparation for an alloy composition may influence or even determine whether the alloy will have properties adequate for a desired application.

The alloy described herein can be cast using a casting method as known to those of skill in the art. For example, the casting process can include a Direct Chill (DC) casting process. The DC casting process is performed according to standards commonly used in the aluminum industry as known to one of skill in the art. Optionally, the casting process can include a continuous casting (CC) process. The cast product can then be subjected to further processing steps. In one non-limiting example, the processing method includes homogenization, hot rolling, cold rolling, solution heat treatment, and quenching.

Homogenization

The homogenization step can involve a one-step homogenization or a two-step homogenization. In one example of the homogenization step, a one-step homogenization is performed where an ingot prepared from an alloy composition described herein is heated to attain a PMT of about, or at least about, 520° C. (e.g., at least 520° C., at least 530° C., at least 540° C., at least 550° C., at least 560° C., at least 570° C., or at least 580° C.). For example, the ingot can be heated to a temperature of from about 520° C. to about 580° C., from about 530° C. to about 575° C., from about 535° C. to about 570° C., from about 540° C. to about 565° C., from about 545° C. to about 560° C., from about 530° C. to about 560° C., or from about 550° C. to about 580° C. In some cases, the heating rate to the PMT can be about 100° C./hour or less, 75° C./hour or less, 50° C./hour or less, 40° C./hour or less, 30° C./hour or less, 25° C./hour or less, 20° C./hour or less, 15° C./hour or less, or 10° C./hour or less. In other cases, the heating rate to the PMT can be from about 10° C./min to about 100° C./min (e.g., about 10° C./min to about 90° C./min, about 10° C./min to about 70° C./min, about 10° C./min to about 60° C./min, from about 20° C./min to about 90° C./min, from about 30° C./min to about 80° C./min, from about 40° C./min to about 70° C./min, or from about 50° C./min to about 60° C./min).

The ingot is then allowed to soak (i.e., held at the indicated temperature) for a period of time. According to one non-limiting example, the ingot is allowed to soak for up to about 8 hours (e.g., from about 30 minutes to about 8 hours, inclusively). For example, the ingot can be soaked at a temperature of at least 500° C. for 30 minutes, 1 hour, 2 hours, 3 hours, 4 hours, 5 hours, 6 hours, 7 hours, 8 hours, or anywhere in between.

In another example of the homogenization step, a two-step homogenization is performed where an ingot prepared from an alloy composition described herein is heated to attain a first temperature of about, or at least about, 480° C. to about 520° C. For example, the ingot can be heated to a first temperature of about 480° C., 490° C., 500° C., 510° C., or 520° C. In certain aspects, the heating rate to the first temperature can be from about 10° C./min to about 100° C./min (e.g., about 10° C./min to about 90° C./min, about 10° C./min to about 70° C./min, about 10° C./min to about 60° C./min, from about 20° C./min to about 90° C./min, from about 30° C./min to about 80° C./min, from about 40° C./min to about 70° C./min, or from about 50° C./min to about 60° C./min). In other aspects, the heating rate to the first temperature can be from about 10° C./hour to about 100° C./hour (e.g., about 10° C./hour to about 90° C./hour, about 10° C./hour to about 70° C./hour, about 10° C./hour to about 60° C./hour, from about 20° C./hour to about 90° C./hour, from about 30° C./hour to about 80° C./hour, from about 40° C./hour to about 70° C./hour, or from about 50° C./hour to about 60° C./hour).

The ingot is then allowed to soak for a period of time. In certain cases, the ingot is allowed to soak for up to about 6 hours (e.g., from 30 minutes to 6 hours, inclusively). For example, the ingot can be soaked at a temperature of from about 480° C. to about 520° C. for 30 minutes, 1 hour, 2 hours, 3 hours, 4 hours, 5 hours, or 6 hours, or anywhere in between.

In the second step of the two-step homogenization process, the ingot can be further heated from the first temperature to a second temperature of greater than about 520° C. (e.g., greater than 520° C., greater than 530° C., greater than 540° C., greater than 550° C., greater than 560° C., greater than 570° C., or greater than 580° C.). For example, the ingot can be heated to a second temperature of from about 520° C. to about 580° C., from about 530° C. to about 575° C., from about 535° C. to about 570° C., from about 540° C. to about 565° C., from about 545° C. to about 560° C., from about 530° C. to about 560° C., or from about 550° C. to about 580° C. The heating rate to the second temperature can be from about 10° C./min to about 100° C./min (e.g., from about 20° C./min to about 90° C./min, from about 30° C./min to about 80° C./min, from about 10° C./min to about 90° C./min, about 10° C./min to about 70° C./min, about 10° C./min to about 60° C./min, 40° C./min to about 70° C./min, or from about 50° C./min to about 60° C./min).

In other aspects, the heating rate to the second temperature can be from about 10° C./hour to about 100° C./hour (e.g., about 10° C./hour to about 90° C./hour, about 10° C./hour to about 70° C./hour, about 10° C./hour to about 60° C./hour, from about 20° C./hour to about 90° C./hour, from about 30° C./hour to about 80° C./hour, from about 40° C./hour to about 70° C./hour, or from about 50° C./hour to about 60° C./hour).

The ingot is then allowed to soak for a period of time. In certain cases, the ingot is allowed to soak for up to about 6 hours (e.g., from 30 minutes to 6 hours, inclusively). For example, the ingot can be soaked at a temperature of from about 520° C. to about 580° C. for 30 minutes, 1 hour, 2 hours, 3 hours, 4 hours, 5 hours, or 6 hours, or anywhere in between.

Hot Rolling

Following the homogenization step, a hot rolling step can be performed. In certain cases, the ingots are laid down and hot-rolled with an entry temperature range of about 500° C.-540° C. For example, the entry temperature can be, for example, about 505° C., 510° C., 515° C., 520° C., 525° C., 530° C., 535° C., or 540° C. In certain cases, the hot roll exit temperature can range from about 250° C. to about 380° C. (e.g., from about 330° C. to about 370° C.). For example, the hot roll exit temperature can be about 255° C., 260° C., 265° C., 270° C., 275° C., 280° C., 285° C., 290° C., 295° C., 300° C., 305° C., 310° C., 315° C., 320° C., 325° C., 330° C., 335° C., 340° C., 345° C., 350° C., 355° C., 360° C., 365° C., 370° C., 375° C., or 380° C.

In certain cases, the ingot can be hot rolled to an about 4 mm to about 15 mm thick gauge (e.g., from about 5 mm to about 12 mm thick gauge), which is referred to as a shate. For example, the ingot can be hot rolled to an about 4 mm thick gauge, about 5 mm thick gauge, about 6 mm thick gauge, about 7 mm thick gauge, about 8 mm thick gauge, about 9 mm thick gauge, about 10 mm thick gauge, about 11 mm thick gauge, about 12 mm thick gauge, about 13 mm thick gauge, about 14 mm thick gauge, or about 15 mm thick gauge. In certain cases, the ingot can be hot rolled to a gauge greater than 15 mm thick (i.e., a plate). In other cases, the ingot can be hot rolled to a gauge less than 4 mm (i.e., a sheet).

Cold Rolling Step

A cold rolling step can be performed following the hot rolling step. In certain aspects, the rolled product from the hot rolling step can be cold rolled to a sheet (e.g., below approximately 4.0 mm). In certain aspects, the rolled product is cold rolled to a thickness of about 0.4 mm to 1.0 mm, 1.0 mm to 3.0 mm, or 3.0 mm to less than 4.0 mm. In certain aspects, the alloy is cold rolled to about 3.5 mm or less, 3 mm or less, 2.5 mm or less, 2 mm or less, 1.5 mm or less, 1 mm or less, or 0.5 mm or less. For example, the rolled product can be cold rolled to about 0.1 mm, 0.2 mm, 0.3 mm, 0.4 mm, 0.5 mm, 0.6 mm, 0.7 mm, 0.8 mm, 0.9 mm, 1.0 mm, 1.1 mm, 1.2 mm, 1.3 mm, 1.4 mm, 1.5 mm, 1.6 mm, 1.7 mm, 1.8 mm, 1.9 mm, 2.0 mm, 2.1 mm, 2.2 mm, 2.3 mm, 2.4 mm, 2.5 mm, 2.6 mm, 2.7 mm, 2.8 mm, 2.9 mm, or 3.0 mm.

Solution Heat Treatment

The solution heat treatment (SHT) step can include heating the sheet from room temperature to a temperature of from about 520° C. to about 590° C. (e.g., from about 520° C. to about 580° C., from about 530° C. to about 570° C., from about 545° C. to about 575° C., from about 550° C. to about 570° C., from about 555° C. to about 565° C., from about 540° C. to about 560° C., from about 560° C. to about 580° C., or from about 550° C. to about 575° C.). The sheet can soak at the temperature for a period of time. In certain aspects, the sheet is allowed to soak for up to approximately 2 hours (e.g., from about 10 seconds to about 120 minutes inclusively). For example, the sheet can be soaked at the temperature of from about 525° C. to about 590° C. for 20 seconds, 25 seconds, 30 seconds, 35 seconds, 40 seconds, 45 seconds, 50 seconds, 55 seconds, 60 seconds, 65 seconds, 70 seconds, 75 seconds, 80 seconds, 85 seconds, 90 seconds, 95 seconds, 100 seconds, 105 seconds, 110 seconds, 115 seconds, 120 seconds, 125 seconds, 130 seconds, 135 seconds, 140 seconds, 145 seconds, or 150 seconds, 5 minutes, 10 minutes, 15 minutes, 20 minutes, 25 minutes, 30 minutes, 35 minutes, 40 minutes, 45 minutes, 50 minutes, 55 minutes, 60 minutes, 65 minutes, 70 minutes, 75 minutes, 80 minutes, 85 minutes, 90 minutes, 95 minutes, 100 minutes, 105 minutes, 110 minutes, 115 minutes, or 120 minutes, or anywhere in between.

Quenching

In certain aspects, the sheet can then be cooled to a temperature of about 25° C. at a quench speed that can vary between about 200° C./s to 400° C./s in a quenching step that is based on the selected gauge. For example, the quench rate can be from about 225° C./s to about 375° C./s, from about 250° C./s to about 350° C./s, or from about 275° C./s to about 325° C./s.

In the quenching step, the sheet is rapidly quenched with a liquid (e.g., water) and/or gas or another selected quench medium. In certain aspects, the sheet can be rapidly quenched with water. In certain aspects, the sheet is quenched with air.

Aging

In certain aspects, the sheet can optionally be pre-aged at about 80° C. to about 120° C. (e.g., about 80° C., about 85° C., about 90° C., about 95° C., about 100° C., about 105° C., about 110° C., about 115° C., or about 120° C.) for a period of time. Optionally, the sheet can be pre-aged for a period from 30 minutes to about 12 hours (e.g., 30 minutes, 1 hour, 2 hours, 3 hours, 4 hours, 5 hours, 6 hours, 7 hours, 8 hours, 9 hours, 10 hours, 11 hours, or 12 hours), or anywhere in between.

The sheet can be naturally aged for a period of time to result in the T4 temper. In certain aspects, the sheet in the T4 temper can be artificially aged at about 180° C. to about 225° C. (e.g., 185° C., 190° C., 195° C., 200° C., 205° C., 210° C., 215° C., 220° C., or 225° C.) for a period of time. Optionally, the sheet can be artificially aged for a period from about 15 minutes to about 8 hours (e.g., 15 minutes, 30 minutes, 1 hour, 2 hours, 3 hours, 4 hours, 5 hours, 6 hours, 7 hours, or 8 hours or anywhere in between) to result in the T6 temper. Optionally, the sheet can be artificially aged for a period from about 10 minutes to about 2 hours (e.g., 15 minutes, 20 minutes, 30 minutes, 45 minutes, 1 hour, 1.5 hours, 2 hours or anywhere in between) to result in the T8 temper.

Methods of Using

The alloys and methods described herein can be used in automotive, electronics, and transportation applications, such as commercial vehicle, aircraft, or railway applications. For example, the alloys could be used for chassis, cross-member, and intra-chassis components (encompassing, but not limited to, all components between the two C channels in a commercial vehicle chassis) to gain strength, serving as a full or partial replacement of high-strength steels. In certain examples, the alloys can be used in F, T4, T6x, or T8x tempers. In certain aspects, the alloys are used with a stiffener to provide additional strength. In certain aspects, the alloys are useful in applications where the processing and operating temperature is approximately 150° C. or lower.

In certain aspects, the alloys and methods can be used to prepare motor vehicle body part products. For example, the disclosed alloys and methods can be used to prepare automobile body parts, such as bumpers, side beams, roof beams, cross beams, pillar reinforcements (e.g., A-pillars, B-pillars, and C-pillars), inner panels, side panels, floor panels, tunnels, structure panels, reinforcement panels, inner hoods, or trunk lid panels. The disclosed aluminum alloys and methods can also be used in aircraft or railway vehicle applications, to prepare, for example, external and internal panels. In certain aspects, the disclosed alloys can be used for other specialties applications, such as automotive battery plates/shates.

In certain aspects, the products created from the alloys and methods can be coated. For example, the disclosed products can be Zn-phosphated and electrocoated (E-coated). As part of the coating procedure, the coated samples can be baked to dry the E-coat at about 180° C. for about 20 minutes. In certain aspects, a paint bake response is observed wherein the alloys exhibit an increase in yield strength. In certain examples, the paint bake response is affected by the quenching methods during plate, shate or sheet forming.

The described alloys and methods can also be used to prepare housings for electronic devices, including mobile phones and tablet computers. For example, the alloys can be used to prepare housings for the outer casing of mobile phones (e.g., smart phones) and tablet bottom chassis, with or without anodizing. Exemplary consumer electronic products include mobile phones, audio devices, video devices, cameras, laptop computers, desktop computers, tablet computers, televisions, displays, household appliances, video playback and recording devices, and the like. Exemplary consumer electronic product parts include outer housings (e.g., facades) and inner pieces for the consumer electronic products.

The following examples will serve to further illustrate the present invention without, however, constituting any limitation thereof. On the contrary, it is to be clearly understood that resort may be had to various embodiments, modifications and equivalents thereof which, after reading the description herein, may suggest themselves to those skilled in the art without departing from the spirit of the invention. During the studies described in the following examples, conventional procedures were followed, unless otherwise stated. Some of the procedures are described below for illustrative purposes.

EXAMPLES

Example 1: Properties of Aluminum Alloys TB1, TB2, TB3, and TB4

A set of four exemplary aluminum alloys were prepared: TB1, TB2, TB3, and TB4 (Table 16).

TABLE 16

Compositions of TB1-TB4 Alloys (wt. %)

| Alloy | Cr | Cu | Fe | Mg | Mn | Si | Zn | Sc | Zr |
|---|---|---|---|---|---|---|---|---|---|
| TB1 | 0.03-0.06 | 0.7-0.9 | 0.15-0.18 | 1.0-1.25 | 0.05-0.2 | 1.00-1.2 | 0.005 | | |
| TB2 | 0.06-0.1 | 0.6-0.7 | 0.18-0.25 | 1.15-1.3 | 0.15-0.2 | 0.8-1.1 | 0.004 | 0.05-0.15 | 0.02-0.09 |
| TB3 | 0.03-0.06 | 0.6-0.9 | 0.15-0.20 | 1.0-1.3 | 0.05-0.18 | 0.9-1.3 | 0.2-0.9 | | |
| TB4 | 0.03-0.09 | 0.65-0.9 | 0.15-0.25 | 1.05-1.3 | 0.1-0.2 | 0.8-1.2 | 0.1-0.9 | 0.05-0.2 | 0.01-0.08 |

The alloys were prepared by DC casting the components into ingots and homogenizing the ingots at 520° C. to 580° C. for 1-5 hours. The homogenized ingots were then laid down and hot rolled with an entry temperature range of 500° C. to 540° C. and a hot roll exit temperature range of from 250° C. to 380° C. A solution heat treatment step was then performed at 540° C. to 580° C. for 15 minutes to 2 hours, followed by a room temperature quench using water and natural aging to achieve the T4 temper. The T6 temper was achieved by aging the T4 alloys at 180° C. to 225° C. for 15 minutes to 8 hours.

The properties of the TB1-TB4 alloys were determined using testing procedures conventional in the art and compared to the control alloys AA6061, AA6013, and AA6111 (Table 17).

TABLE 17

Properties of TB1-TB4 Alloys

| Alloy | Thickness (mm) | YS in T6 (MPa) | UE in T4 (%) | Min r/t in T4 | IGC depth in T6 (G110) in μm | AQ grade WI/YI (acidic) |
|---|---|---|---|---|---|---|
| AA6061 | 3-6 | 250-260 | 14-18 TE | <2.5 | — | 48.9/6.35 |
| AA6013 | 10 | 323-360 | 23 | 1.4 | — | — |
| AA6111 | 10 | 323 | 25 | 1.3 | — | — |
| TB1 | 10 | 380-390 | 28 | <0.5 | 140-150 μm | 50/5 (est.) |
| TB2 | 10 | 385-395 | 25 | <0.5 | 120-130 μm | 50/5 (est.) |
| TB3 | 10 | 380-390 | 28 | <0.8 | 120-130 μm | 50/5 (est.) |
| TB4 | 10 | 380-390 | 25 | <0.5 | 140-150 μm | 50/5 (est.) |

Figure 2:
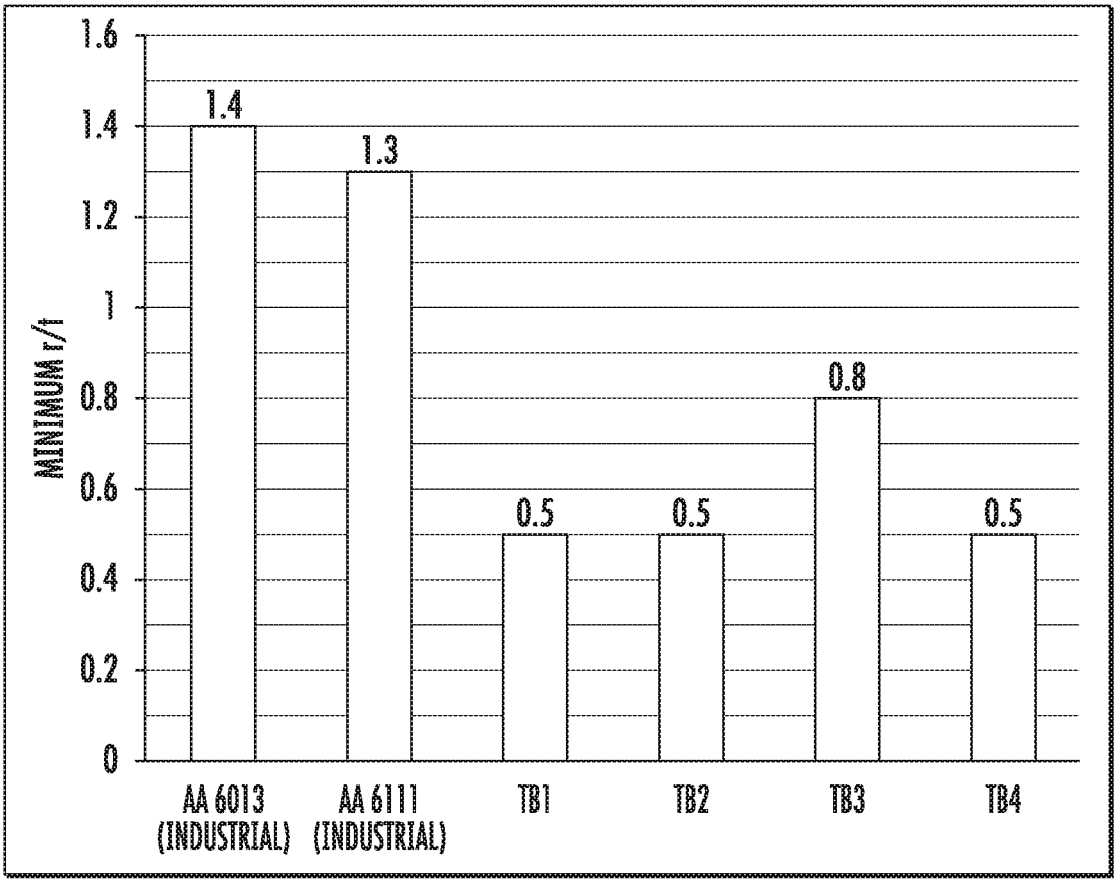
FIG. 2 is a chart that shows a comparison between the bendability of alloy compositions TB1, TB2, TB3, and TB4 after processing to T4 temper.
Figure 3:
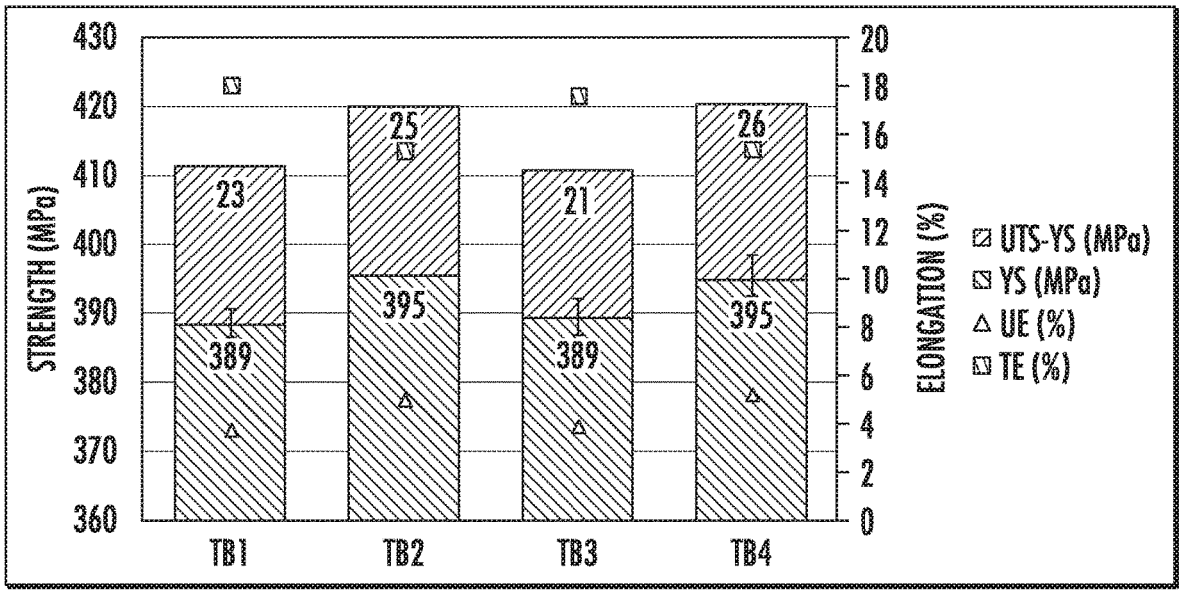
FIG. 3 is a chart that shows a comparison between the tensile properties of alloy compositions TB1, TB2, TB3, and TB4 after processing to T6 temper.

In comparison with current commercial high strength 6XXX alloys, for example AA6061, AA6111 and AA6013, these examples of the inventive alloy demonstrate significant improvements in uniform elongation (UE) and bendability in T4 (FIGS. 1 and 2) and yield strength (YS) and corrosion resistance in T6 (FIG. 3) (Table 17). The TB1-TB4 alloys reached about 25-28% UE.

Example 2: Effects of Annealing

This example compares the properties of an annealed TB1 alloy in T4 condition over a control TB1 alloy produced by a similar process without an annealing step.

The composition of the TB1 alloy is as discussed above in Table 16. Similar to Example 1, initial processing for both samples included regular DC casting; homogenization with a heat-up rate of 10-100°/C and soaking at a peak metal temperature of 520-580° C. for 1-5 hours; and hot rolling with an entry temperature range of 500-540° C. and a hot roll exit temperature range of 250-380° C. The as-rolled plate/shates were marked as being in F temper.

For the control alloy, the F temper plate/shates were then converted to T4 temper by solutionization at 540-580° C. for 15 min to 2 hours soaking time, followed by a water quench and natural aging. The control was converted directly from F temper to T4 temper without an intervening annealing step.

For the annealed alloy, the F temper plates/shates were annealed at a temperature range of 400-500° C. and a soaking time of 30-120 min. The resulting as-annealed, 0 temper plates/shates were then converted to T4 temper by solutionization at 540-580° C. for 15 min to 2 hours soaking time, followed by a water quench and natural aging.

Figure 4:
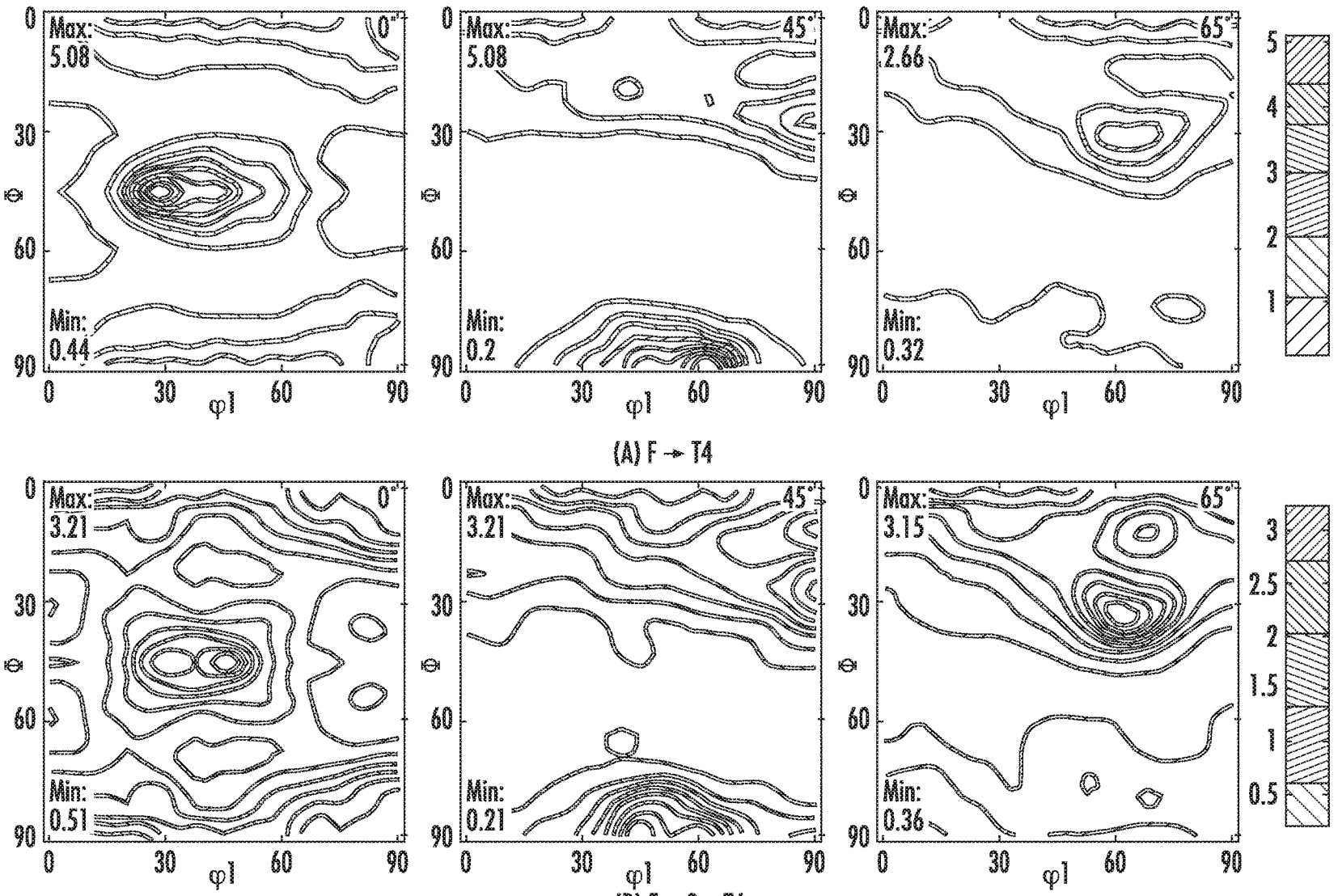
FIG. 4 shows orientation distribution function (ODF) graphs of the TB1 alloy plotted in sections at $\varphi 2=0°$, 45°, and 65°, respectively. Sample (a) is a regular T4 condition control obtained by solutionizing F temper directly, while sample (b) is a modified T4 condition alloy prepared by annealing the F temper alloy and then solutionizing the as-annealed 0 temper.

FIG. 4 illustrates the orientation distribution function (ODF) graphs for the resulting control and annealed alloys. The ODF graphs are in sections at φ2=0°, 45°, and 65°, respectively. Examination indicates that the intensities of high r-45° TCs (such as Brass, Cu) and high r-0/180° TCs (such as Goss, Goss-ND, Cube-RD) are reduced in the annealed alloy compared to the control, indicating an improved texture. This improved texture can potentially reduce the bendability anisotropy and can improve the formability in the forming where a drawing or circumferential stamping process is involved, as it acts to reduce the variability in properties at different directions (i.e., anisotropy).

Figure 5:
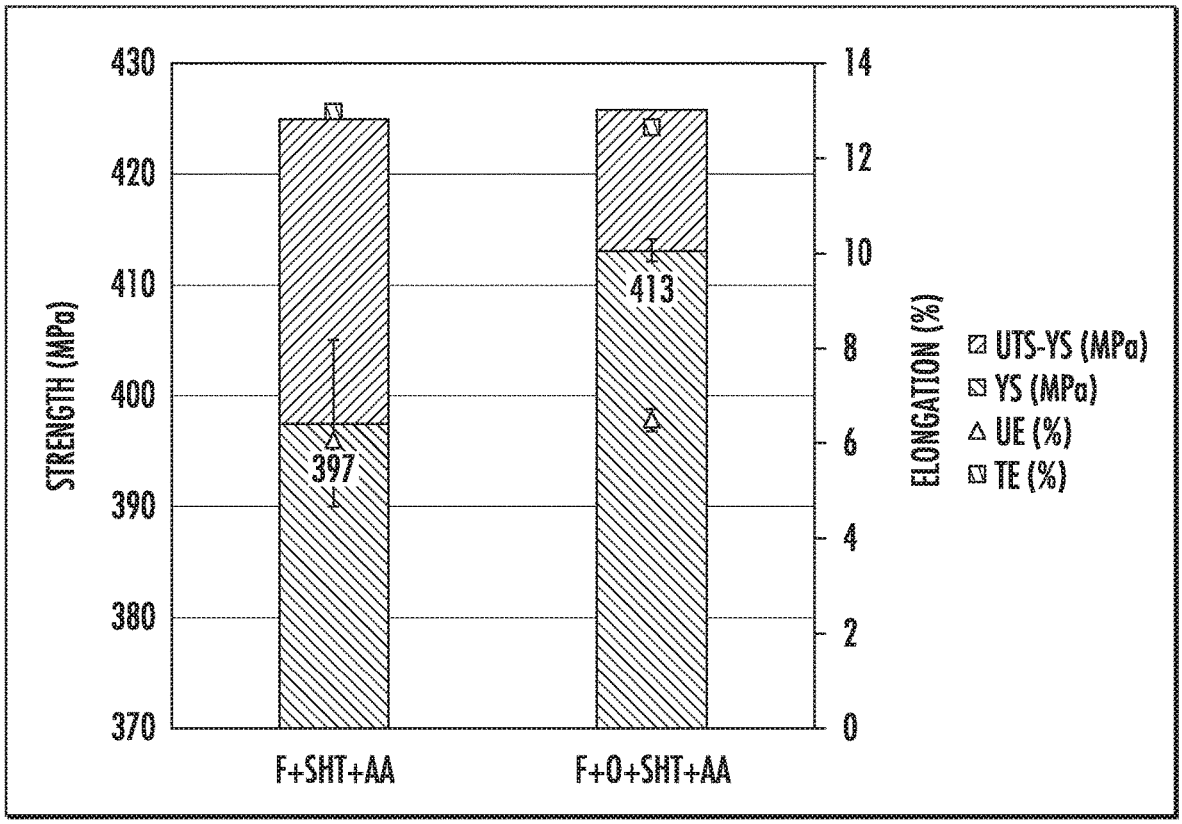
FIG. 5 is a chart that shows a comparison between the tensile properties of the industrial alloy TB1 after processing to T6 temper with annealing (right bar chart) and without annealing (left bar chart).

The alloy samples were further aged at 180° C.-225° C. for 15 min to 8 hours. Investigation of the tensile properties of the alloys indicated that annealing had not adversely affected the final T6 strength (FIG. 5).

Example 3: Properties of Aluminum Alloys P7, P8, and P14 with Different SHTs

A set of three exemplary aluminum alloys were prepared: P7, P8, and P14 (Table 18).

TABLE 18

Compositions of P7, P8, and P14 Alloys (wt. %)

| Alloy | Cr | Cu | Fe | Mg | Mn | Si | Zn | Ti |
|---|---|---|---|---|---|---|---|---|
| P7 | 0.03 | 0.66 | 0.16 | 1.16 | 0.17 | 1.19 | 0.005 | 0.02 |
| P8 | 0.03 | 0.80 | 0.18 | 1.11 | 0.19 | 0.97 | 0.005 | 0.02 |
| P14 | 0.03 | 0.61 | 0.18 | 1.20 | 0.18 | 1.09 | 0.004 | 0.02 |

The alloys were prepared according to the procedure of Example 1, with the exception that the solution heat treatment soaking step was performed for a shorter period (either 45 or 120 seconds).

Figure 6:
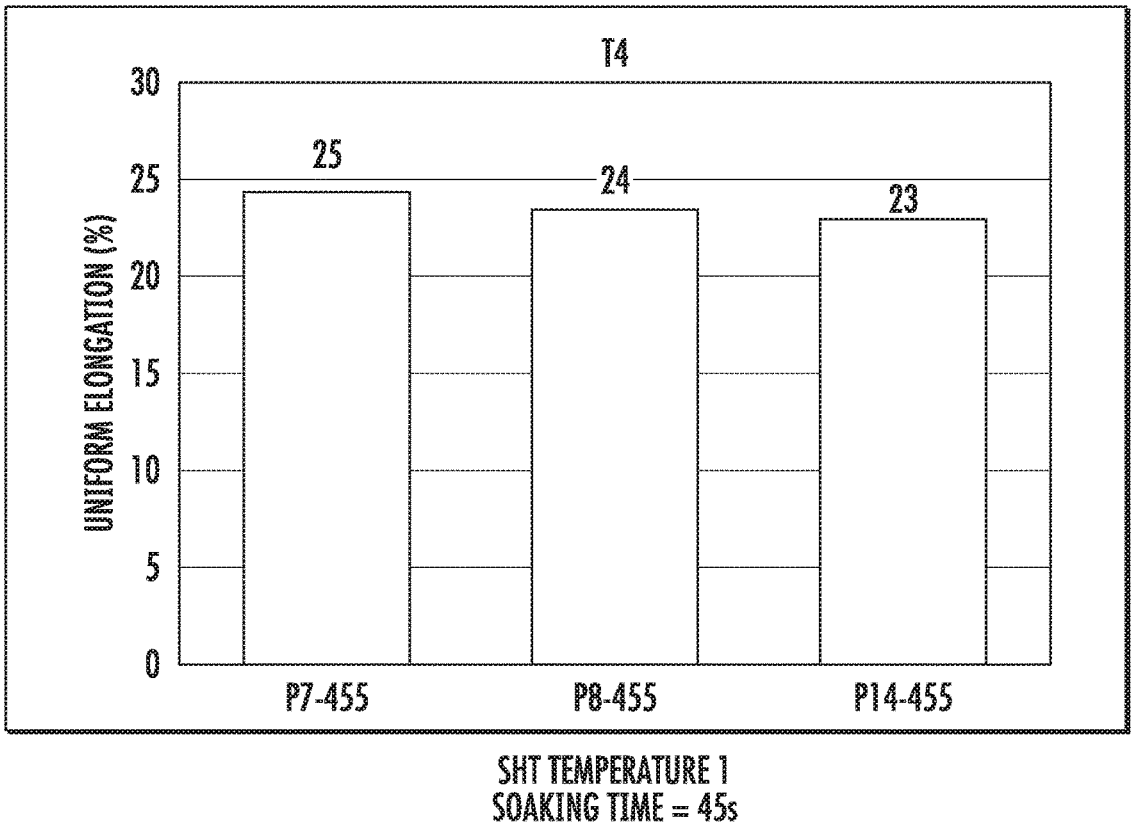
FIG. 6 is a chart that shows the uniform elongation (at T4 condition) and yield strength (at T6 condition) of the alloy compositions P7, P8, and P14 at a temperature ranging from 550° C.-560° C. (indicated as SHT temperature 1).
Figure 6:
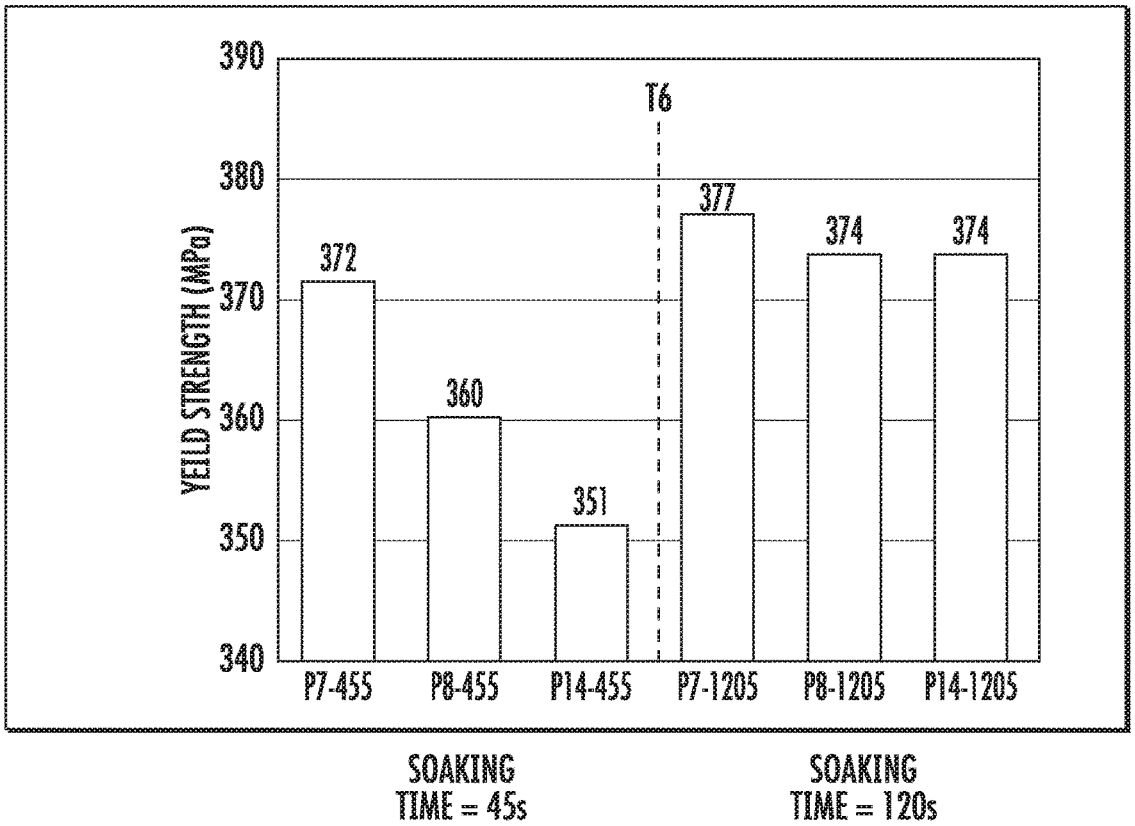
Figure 7:
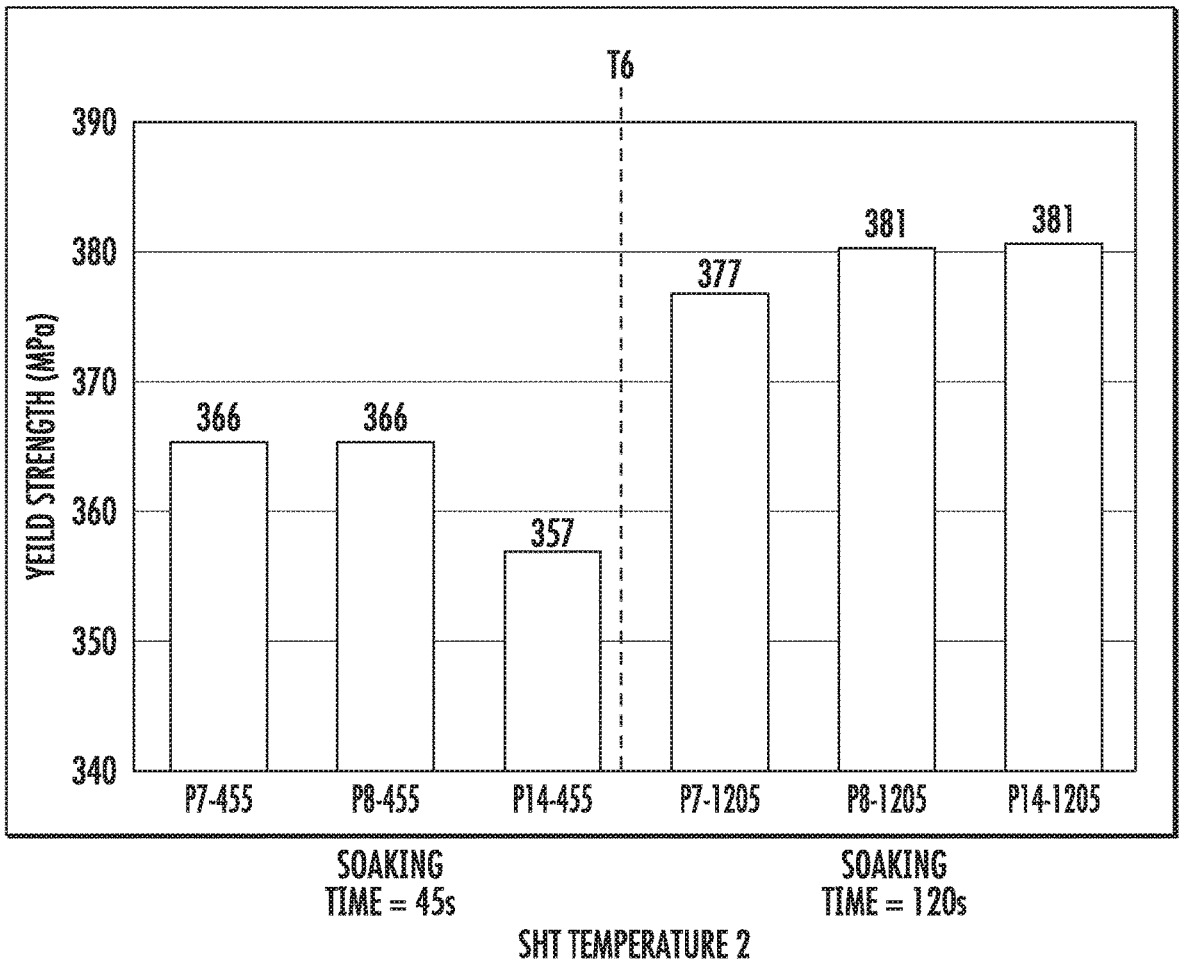
FIG. 7 is a chart that shows the yield strength (at T6 condition) of the alloy compositions P7, P8, and P14 at a temperature ranging from 560° C.-570° C. (indicated as SHT temperature 2).
Figure 8:
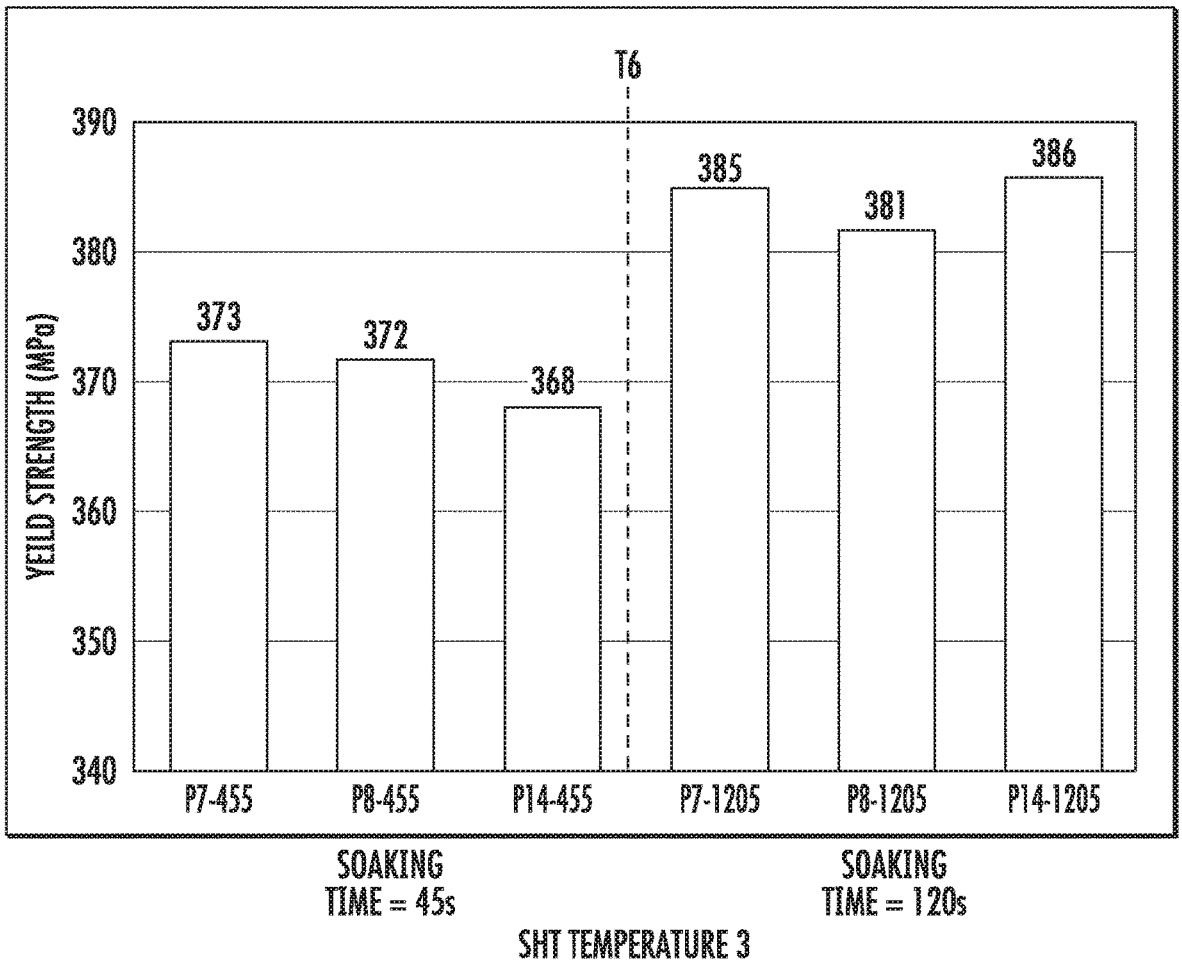
FIG. 8 is a chart that shows the yield strength (at T6 condition) of the alloy compositions P7, P8, and P14 at a temperature ranging from 570° C.-580° C. (indicated as SHT temperature 3).

The maximum elongation (in T4 condition) and yield strengths (in T6 condition) of the P7, P8, and P14 alloys were determined using testing procedures conventional in the art (FIG. 6). Follow-up experiments were performed using different SHT conditions, including temperatures ranging from 550° C. to 580° C. (FIGS. 7 and 8).

In comparison with current commercial high strength 6xxx alloys, such as AA6061, AA6111 and AA6013 (see Example 1), the P7, P8, and P14 alloys demonstrate significant improvements in yield strength and corrosion resistance in T6 and uniform elongation. Such improvement is resulted by a combination of well-designed chemical composition and thermomechanical processing.

Example 4: Properties of SL Series Aluminum Alloys

An additional set of aluminum alloys were prepared (Table 19).

TABLE 19

Compositions of SL Series Alloys (wt. %)

| Alloy | Cr | Cu | Fe | Mg | Mn | Si | Zn | Ti | Ni |
|---|---|---|---|---|---|---|---|---|---|
| SL1 | 0.033 | 0.79 | 0.22 | 0.82 | 0.28 | 0.83 | 0.0096 | 0.0234 | 0.0052 |
| SL2 | 0.072 | 0.81 | 0.22 | 1.09 | 0.11 | 1.24 | 0.01 | 0.024 | 0.0055 |
| SL3 | 0.11 | 1.70 | 0.19 | 0.98 | 0.02 | 0.69 | 0.0214 | 0.021 | 0.0042 |

TABLE 19-continued

| Compositions of SL Series Alloys (wt. %) | | | | | | | | | |
|---|---|---|---|---|---|---|---|---|---|
| Alloy | Cr | Cu | Fe | Mg | Mn | Si | Zn | Ti | Ni |
| SL4 | 0.01 | 0.74 | 0.28 | 0.71 | 0.11 | 0.65 | 0.010 | 0.029 | 0.006 |
| SL5 | 0.027 | 0.84 | 0.22 | 0.91 | 0.293 | 0.65 | 0.07 | 0.022 | 0.0036 |
| SL6 | 0.028 | 0.79 | 0.21 | 0.74 | 0.14 | 1.20 | 0.01 | 0.026 | 0.0048 |
| SL7 | 0.026 | 0.68 | 0.20 | 1.17 | 0.14 | 0.82 | 0.007 | 0.024 | 0.0047 |
| SL8 | 0.012 | 0.97 | 0.23 | 1.04 | 0.31 | 1.00 | 0.005 | 0.029 | 0.008 |

Figure 9:
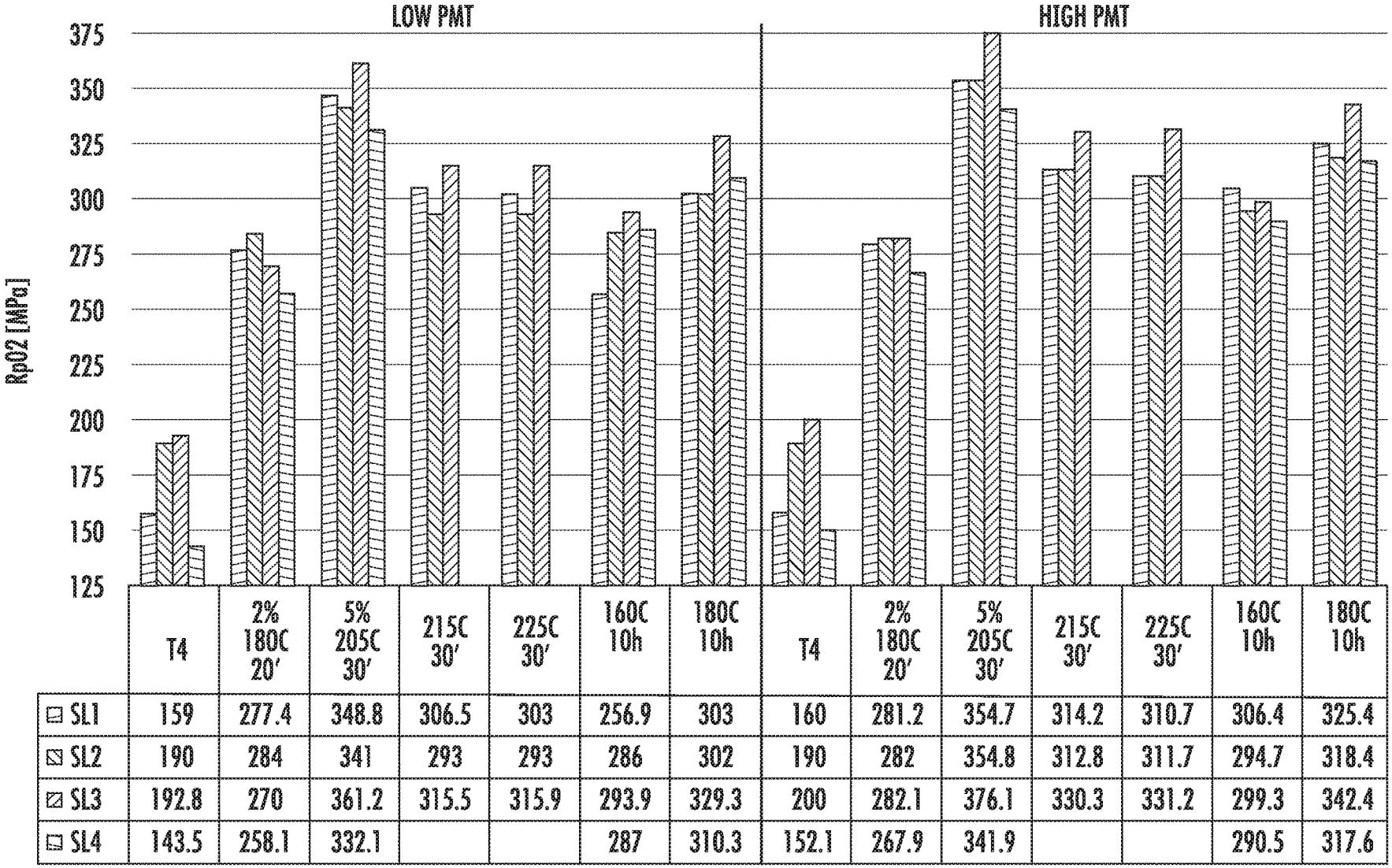
FIG. 9 is a chart that shows the yield strength (Rp02) of the alloy compositions SL1 (left histogram bar in each set), SL2 (second from left histogram bar in each set), SL3 (third from left histogram bar in each set), and SL4 (right histogram bar in each set). The figure shows comparative results from samples that were prepared with low and high peak metal temperatures (PMTs) for the solution heat treatment step (SHT).
Figure 10:
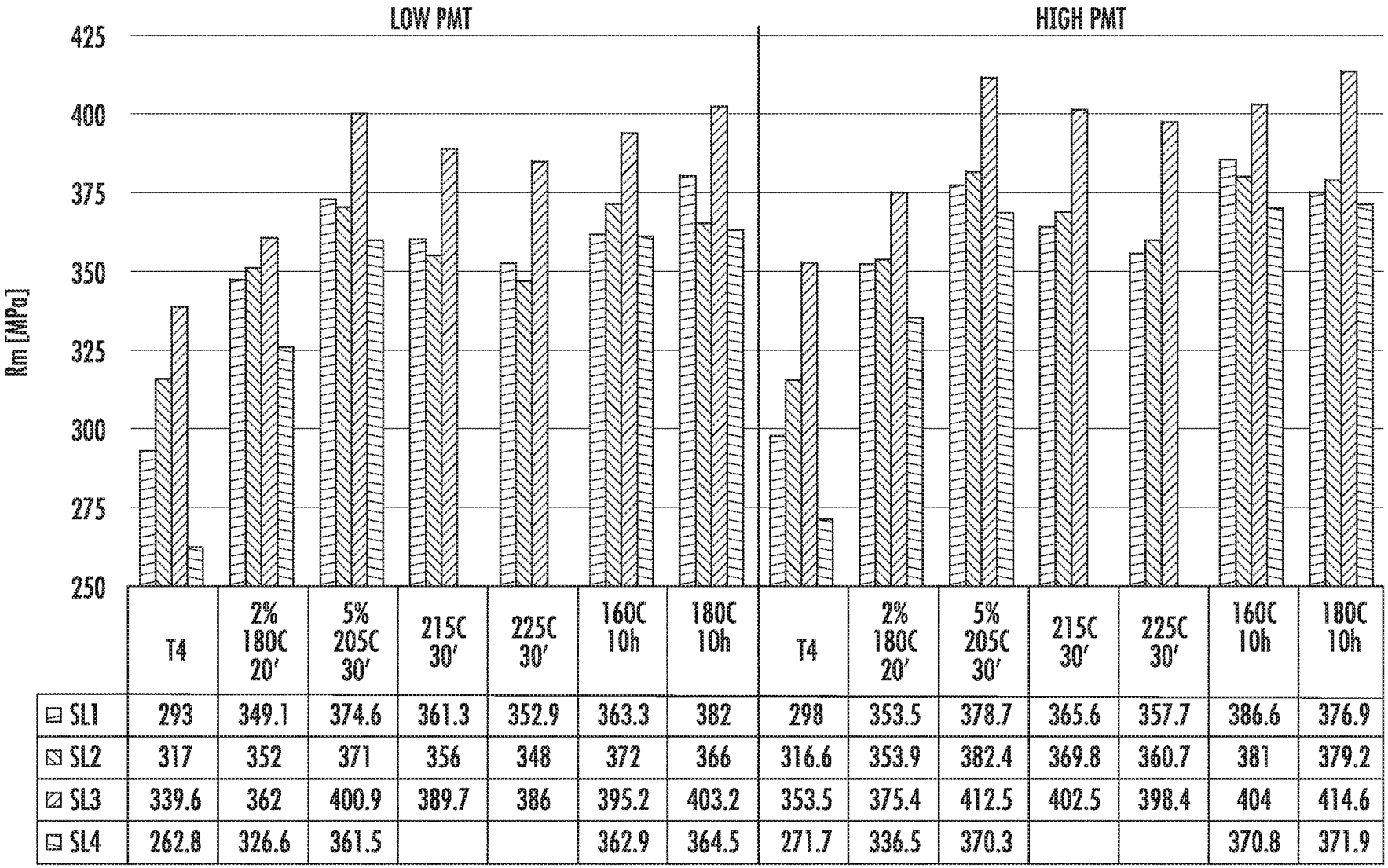
FIG. 10 is a chart that shows the ultimate tensile strength (Rm) of the alloy compositions SL1 (left histogram bar in each set), SL2 (second from left histogram bar in each set), SL3 (third from left histogram bar in each set), and SL4 (right histogram bar in each set). The figure shows comparative results from samples that were prepared with low and high PMTs for the solution heat treatment step.
Figure 11:
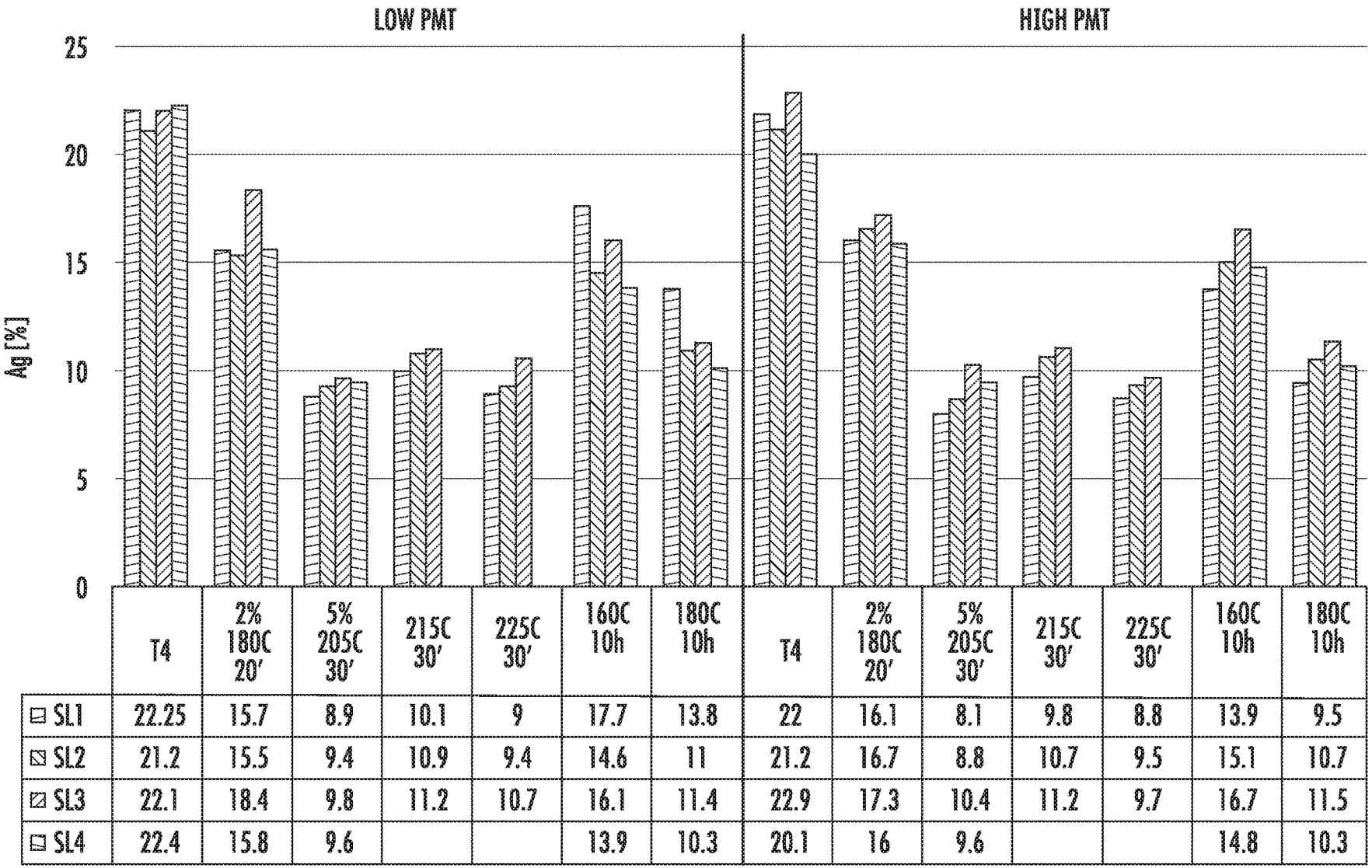
FIG. 11 is a chart that shows the amount of uniform elongation (Ag) of the alloy compositions SL1 (left histogram bar in each set), SL2 (second from left histogram bar in each set), SL3 (third from left histogram bar in each set), and SL4 (right histogram bar in each set). The figure shows comparative results from samples that were prepared with low and high PMTs for the solution heat treatment step.
Figure 12:
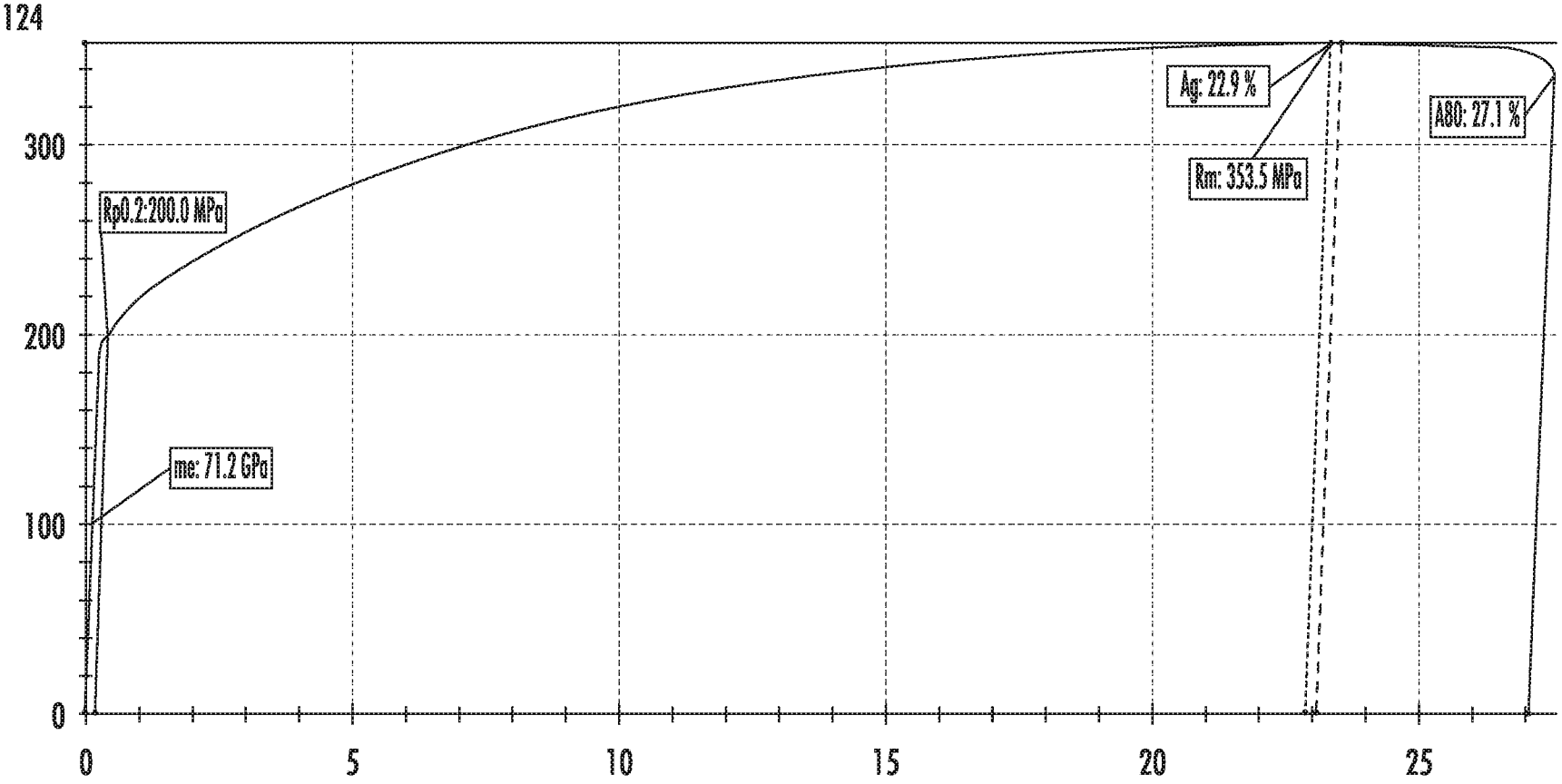
FIG. 12 is a chart that shows a tensile curve for alloy SL3, showing the amount of total elongation (A80) of the alloy composition.
Figure 13:
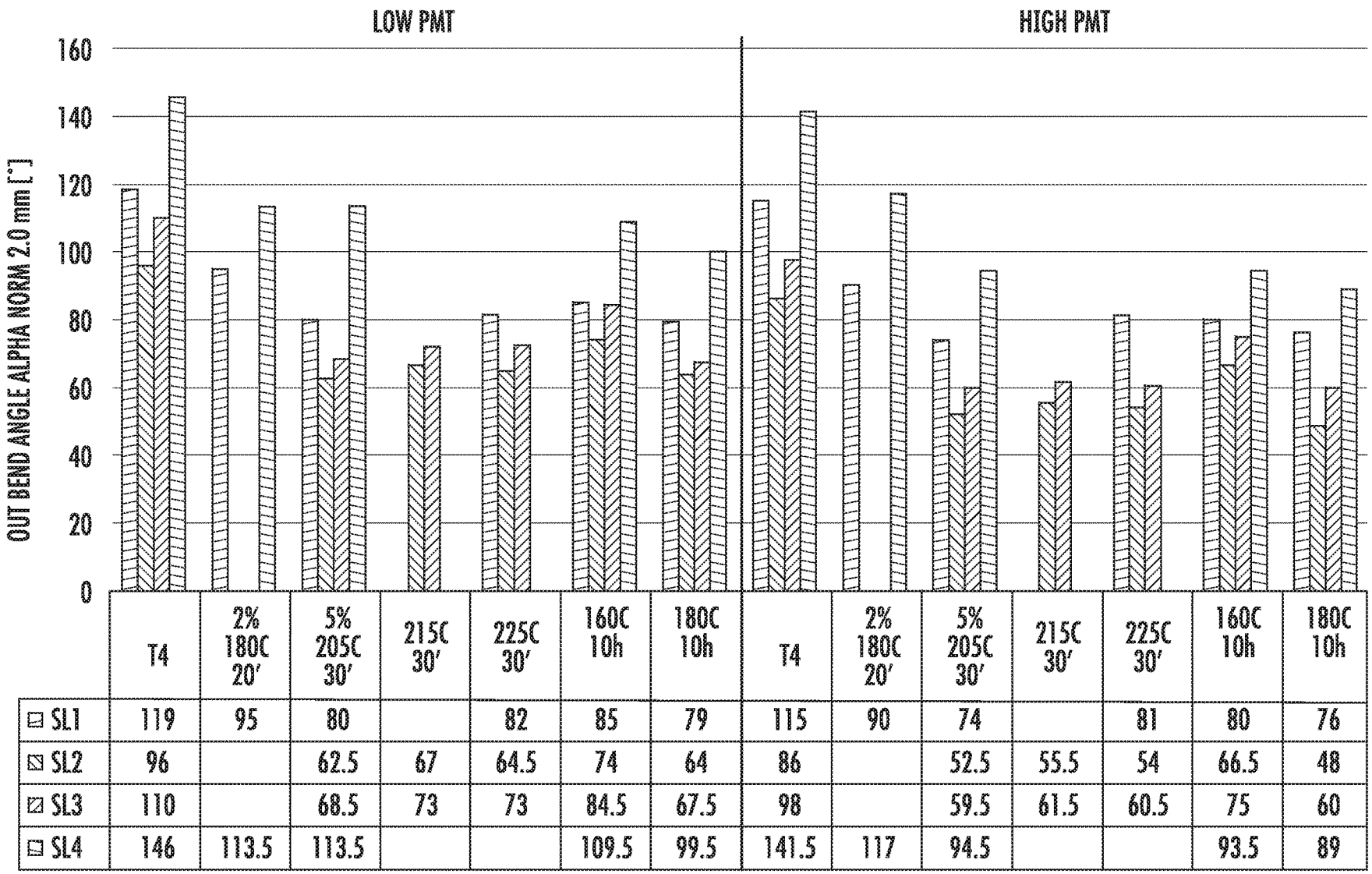
FIG. 13 is a chart that shows bending results for the amount of uniform elongation (Ag) of the alloy compositions SL1 (left histogram bar in each set), SL2 (second from left histogram bar in each set), SL3 (third from left histogram bar in each set), and SL4 (right histogram bar in each set). The figure shows comparative results from samples that were prepared with low and high PMT homogenization. The figure shows comparative results from samples that were prepared with low and high PMT homogenization.
Figure 15:
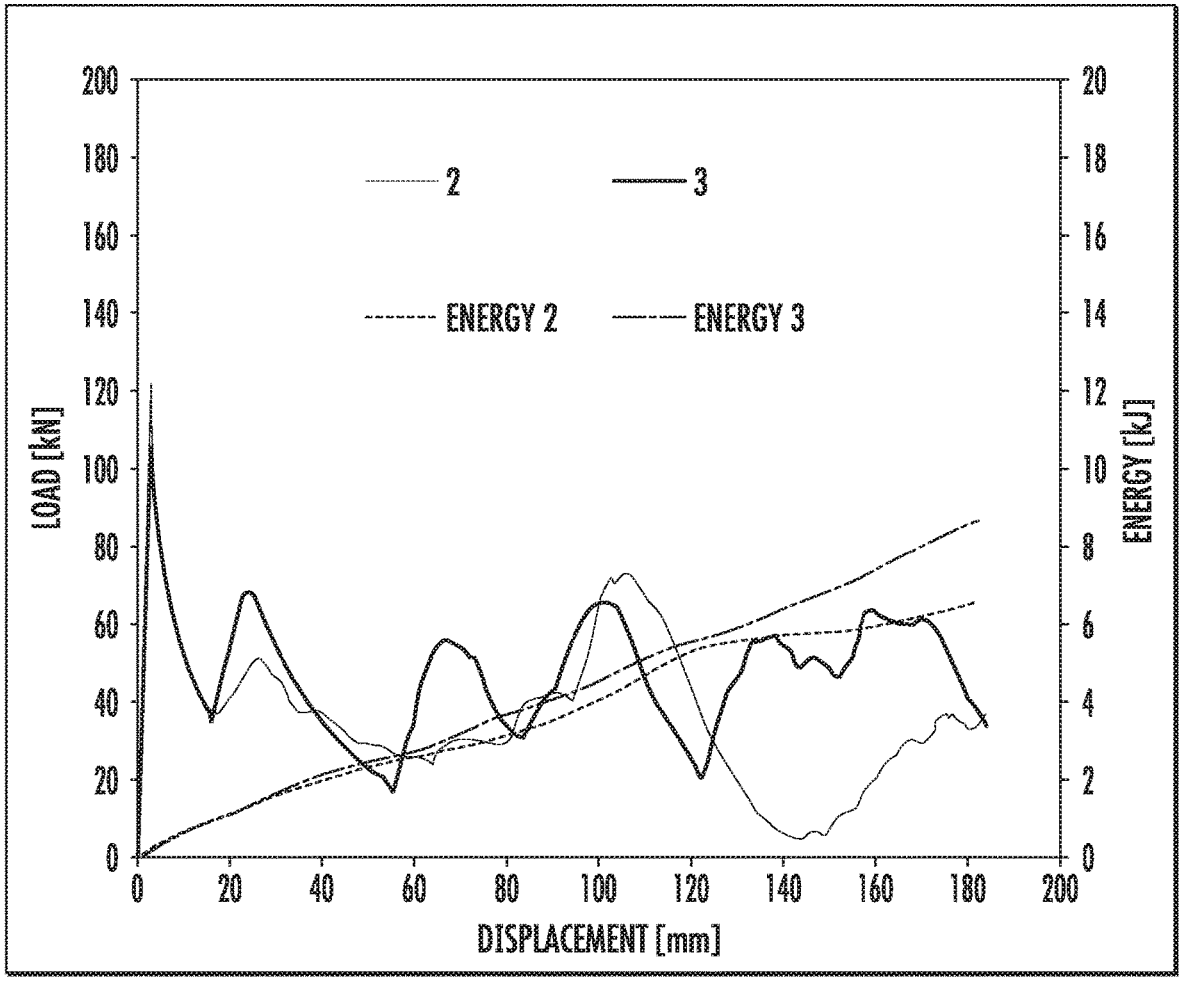
FIG. 15 is a chart that shows crush test results of Alloy SL3 in T6 temper, showing the applied energy and applied load as a function of displacement.
Figure 16A:
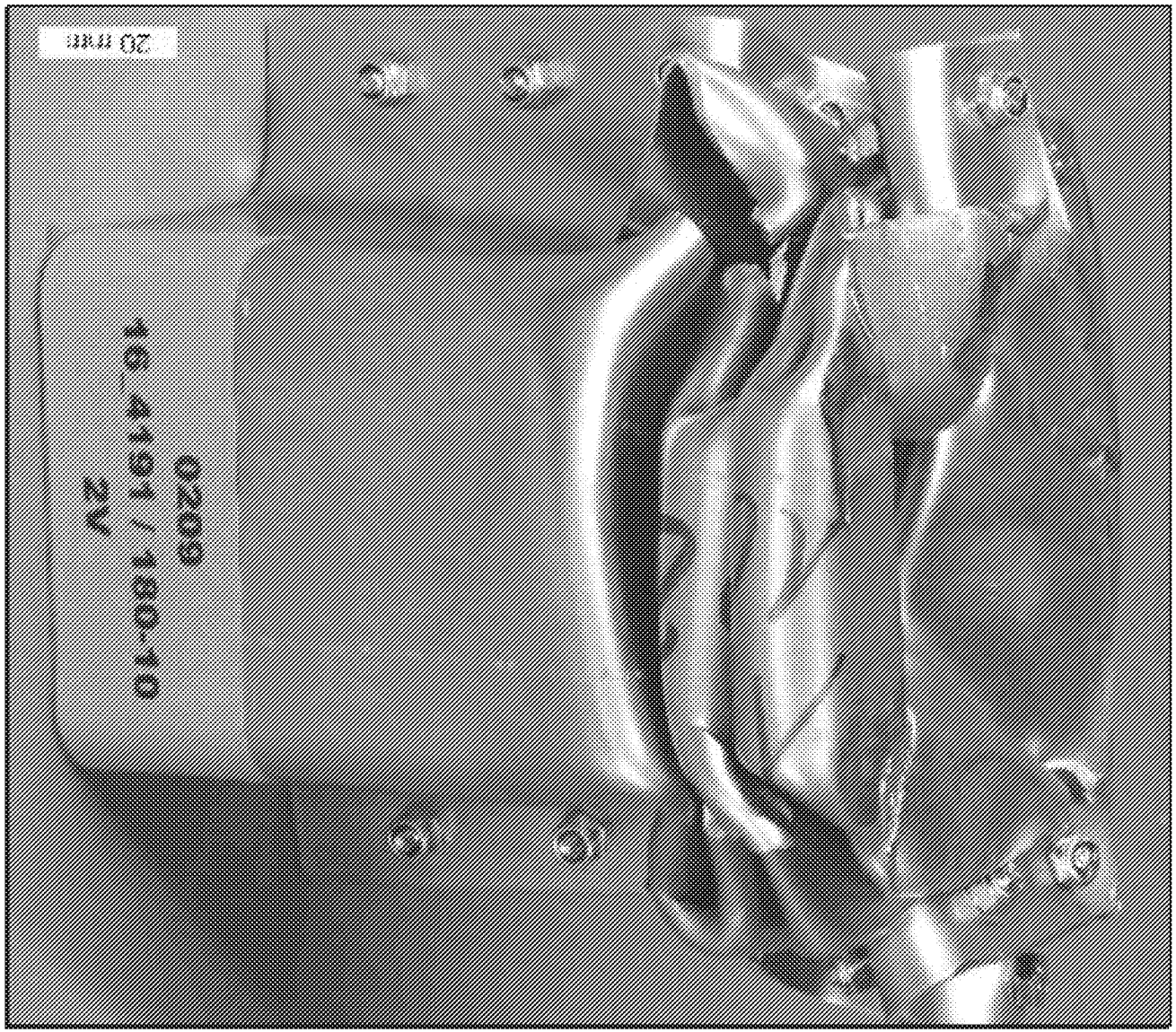
FIG. 16A is a digital image of Alloy SL3 sample 2 after the crush test.
Figure 16B:
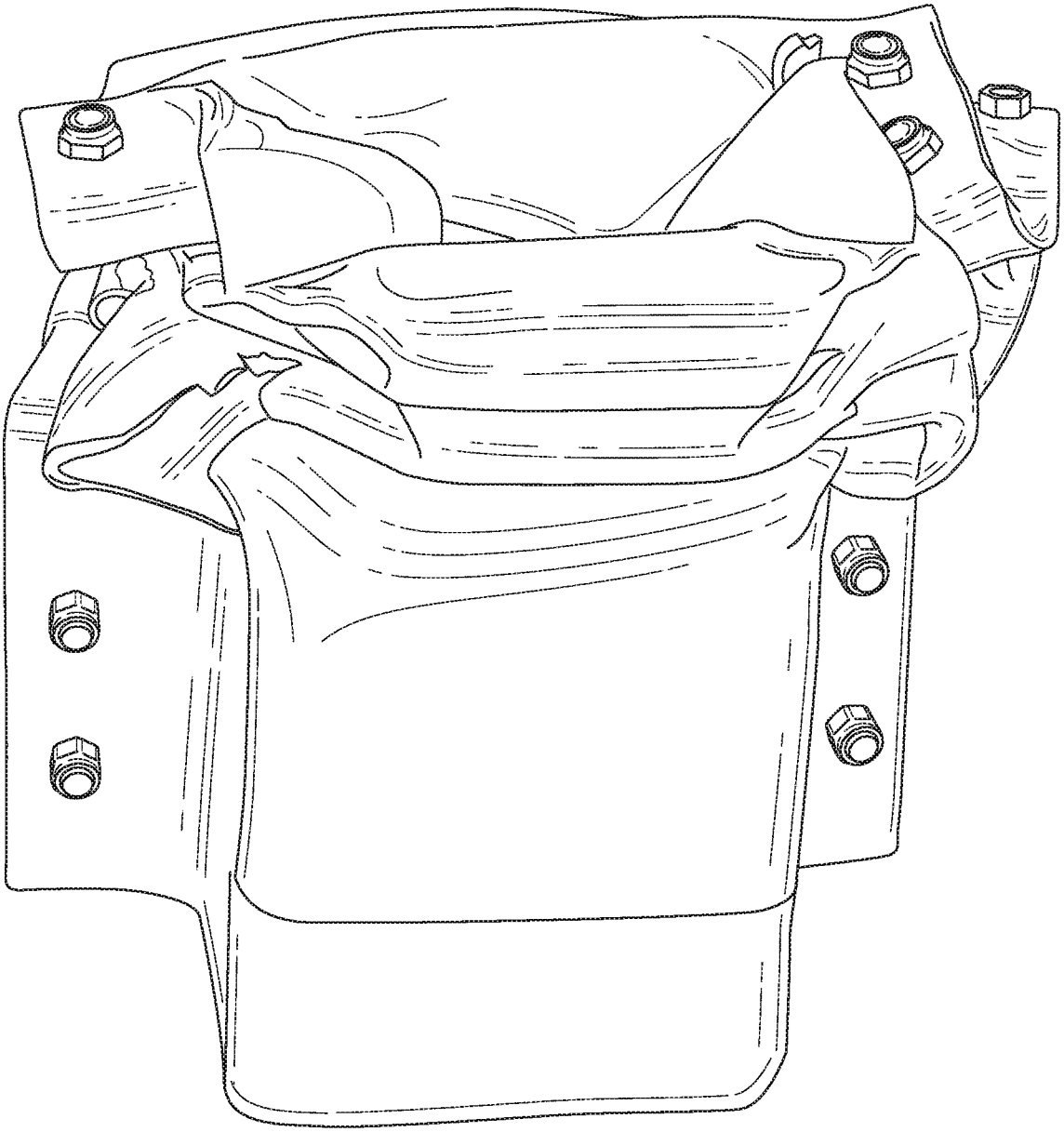
FIG. 16B is a line drawing derived from the digital image of FIG. 16A of Alloy SL3 sample 2 after the crush test.
Figure 16C:
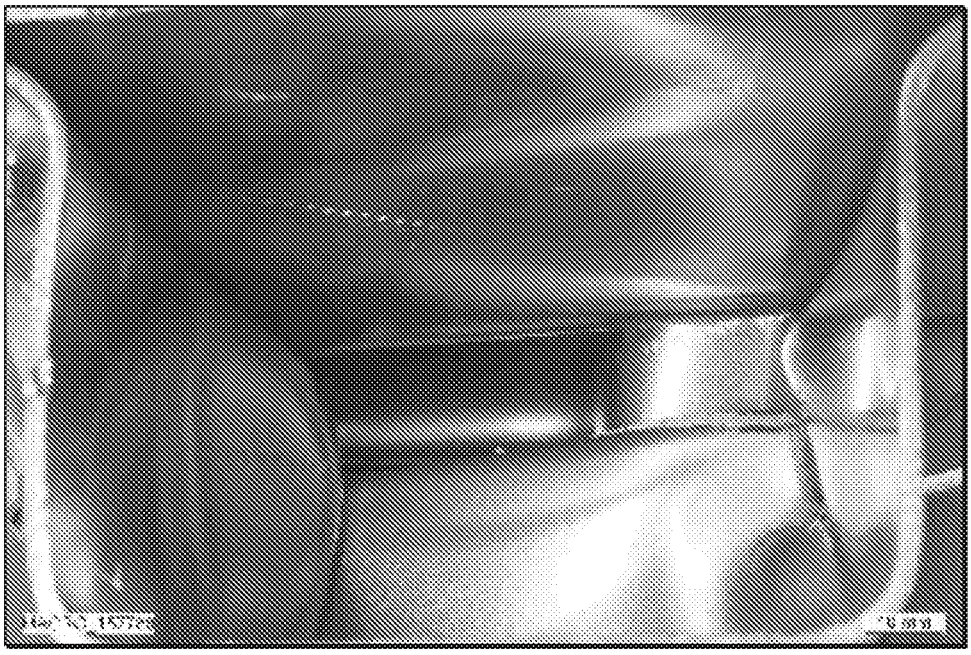
FIG. 16C is a digital image of Alloy SL3 sample 2 after the crush test.
Figure 16D:
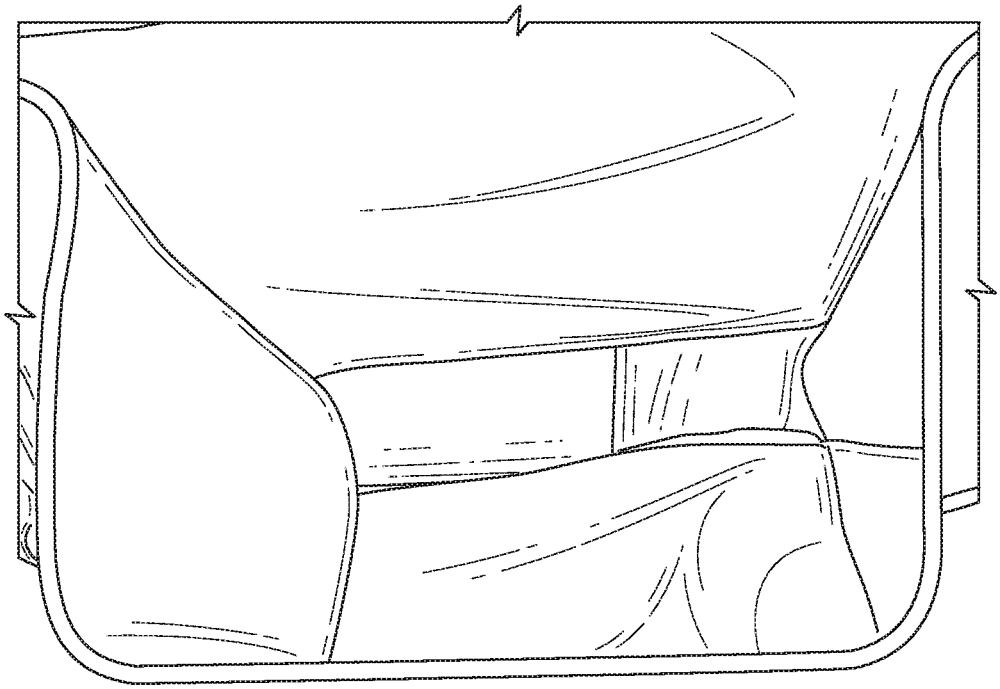
FIG. 16D is a line drawing derived from the digital image of FIG. 16C of Alloy SL3 sample 2 after the crush test.
Figure 16E:
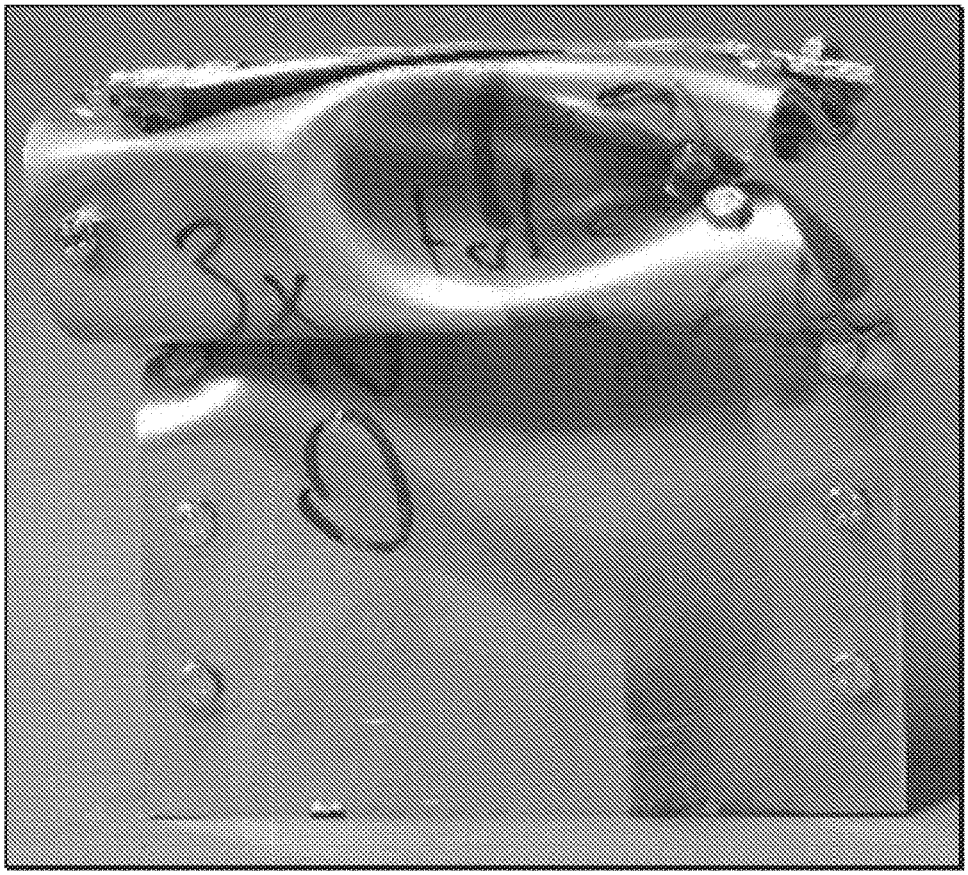
FIG. 16E is a digital image of Alloy SL3 sample 2 after the crush test.
Figure 16F:
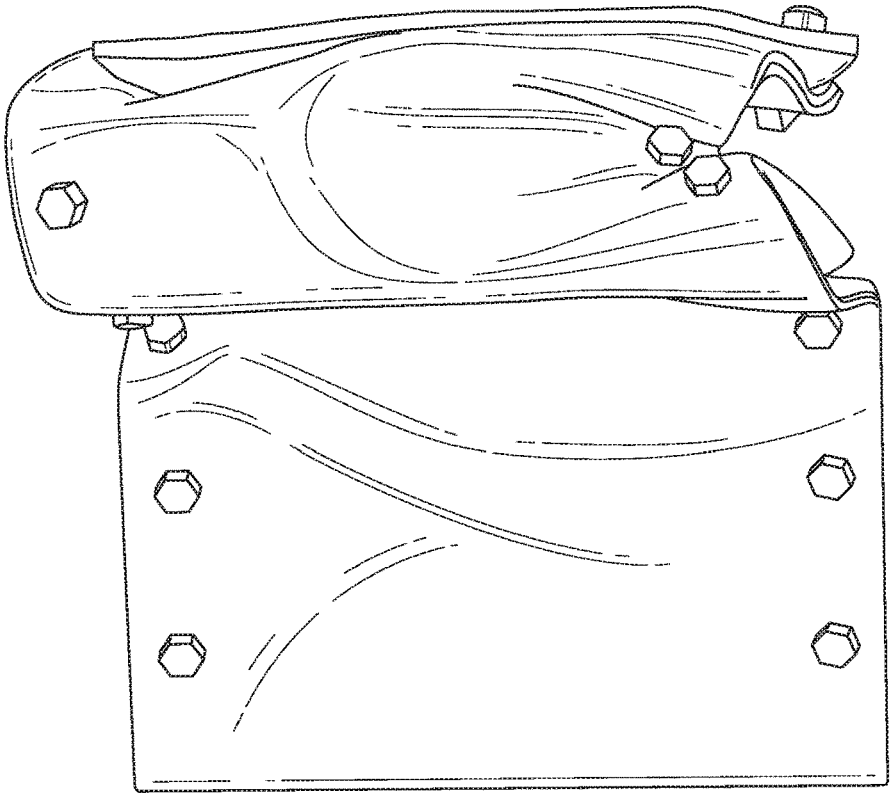
FIG. 16F is a line drawing derived from the digital image of FIG. 16E of Alloy SL3 sample 2 after the crush test.
Figure 17A:
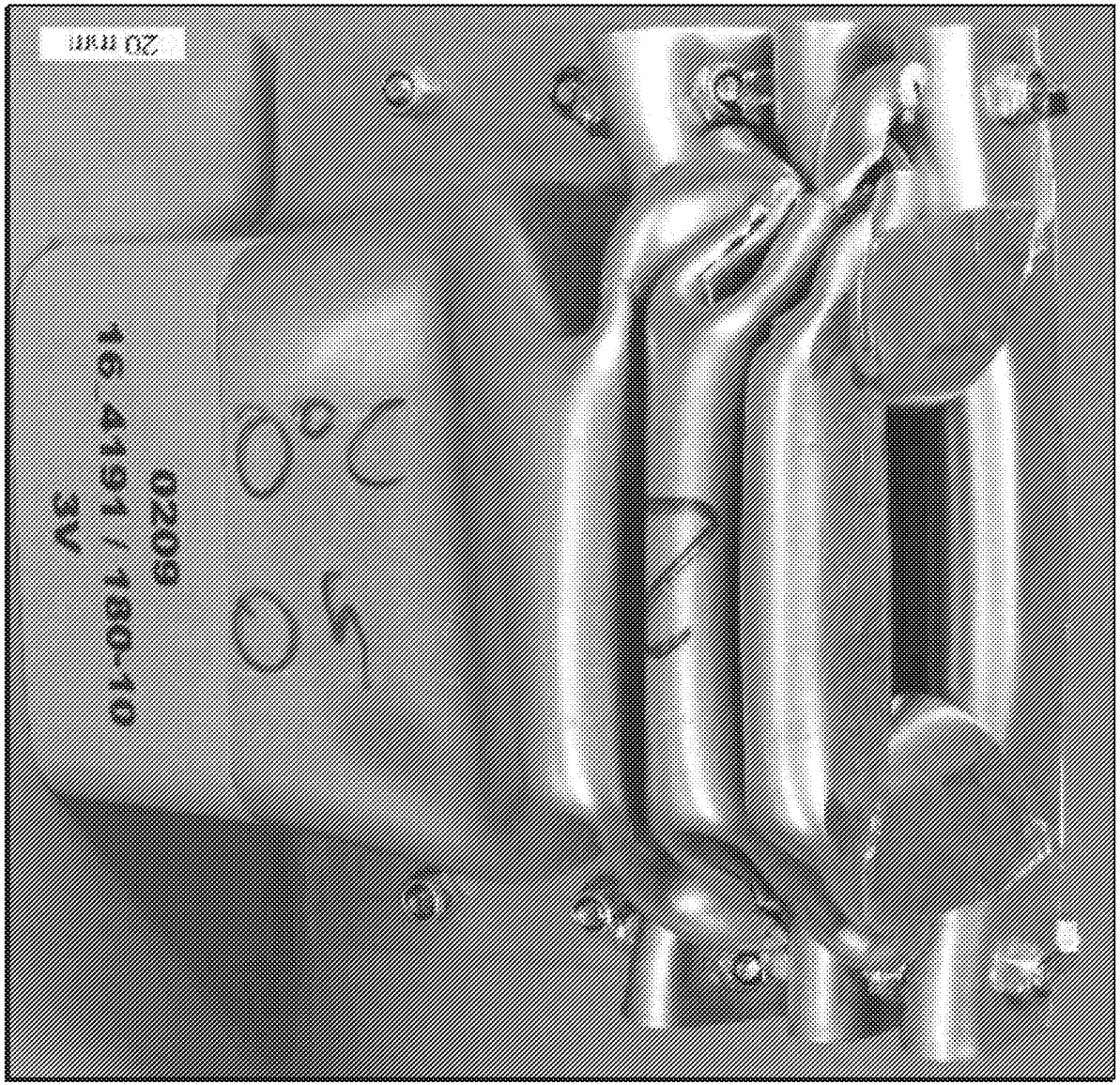
FIG. 17A is a digital image of Alloy SL3 sample 3 after the crush test.
Figure 17B:
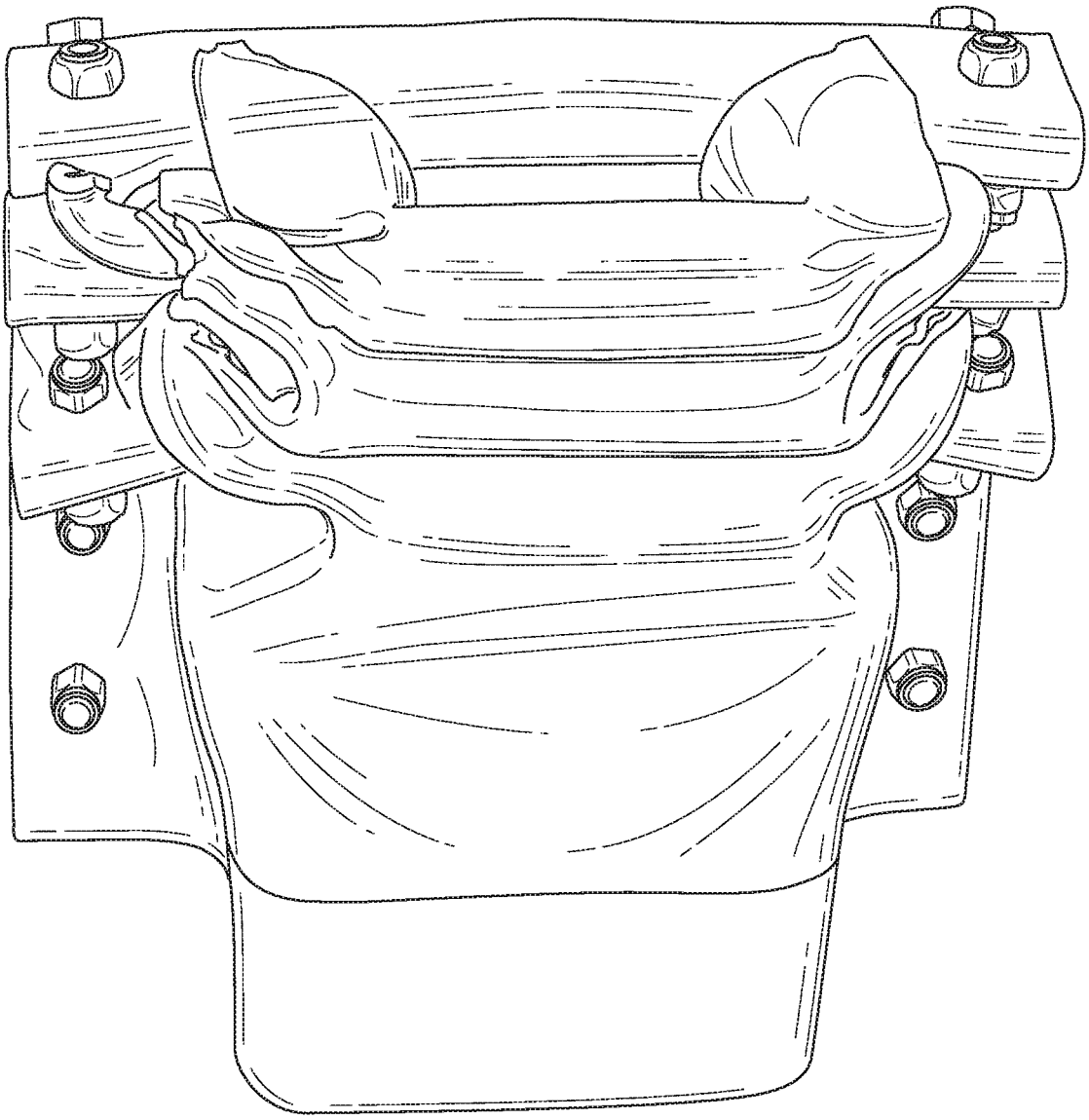
FIG. 17B is a line drawing derived from the digital image of FIG. 17A of Alloy SL3 sample 3 after the crush test.
Figure 17C:
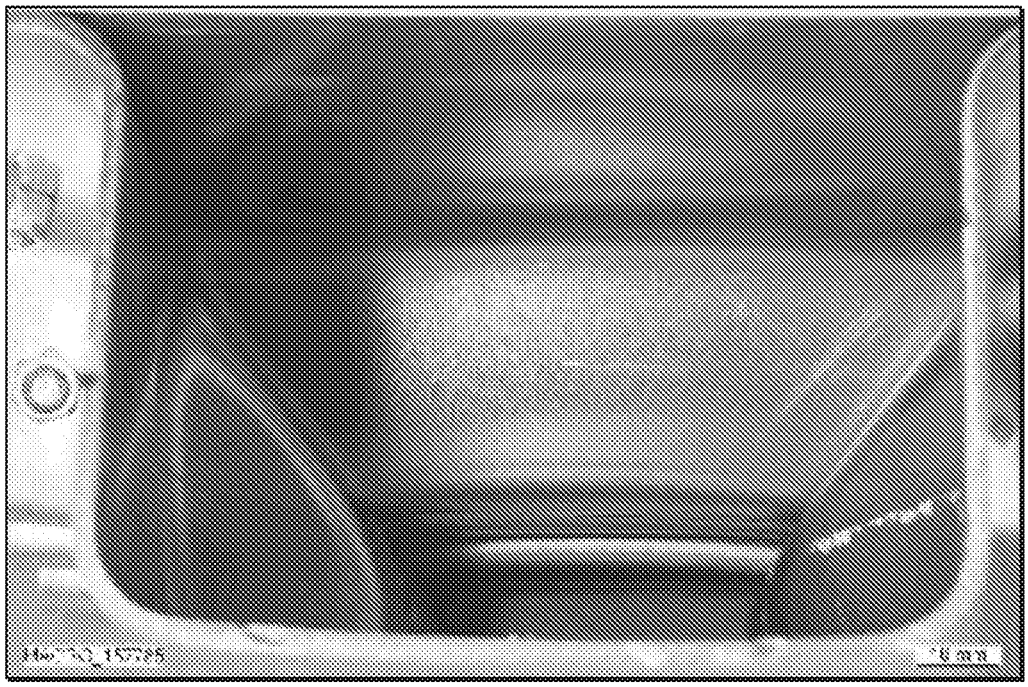
FIG. 17C is a digital image of Alloy SL3 sample 3 after the crush test.
Figure 17D:
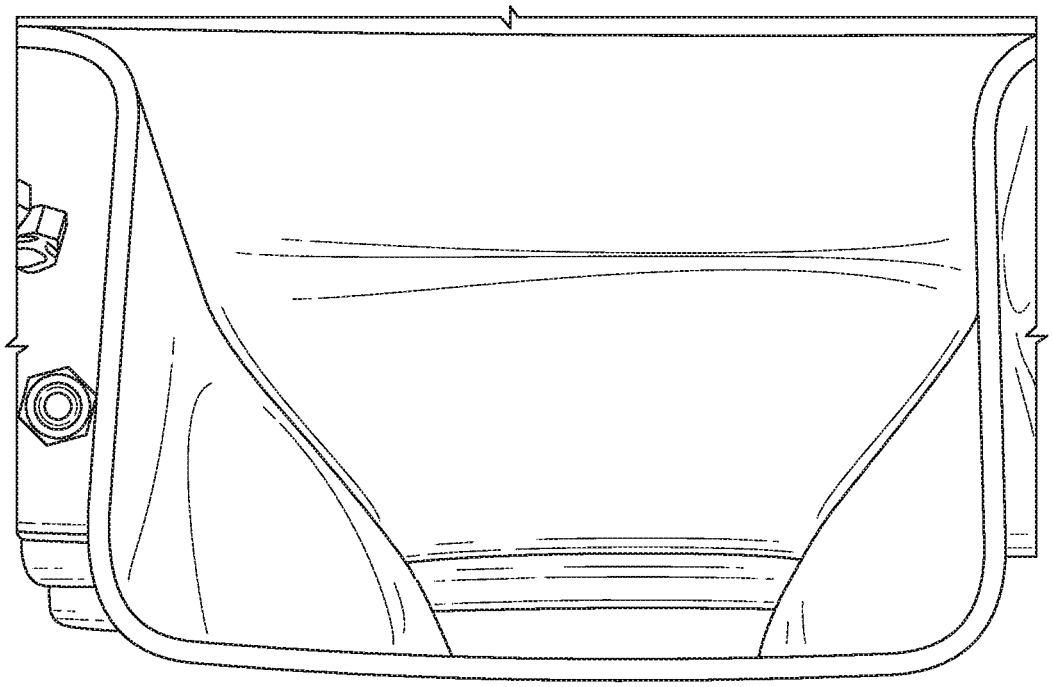
FIG. 17D is a line drawing derived from the digital image of FIG. 17C of Alloy SL3 sample 3 after the crush test.
Figure 17E:
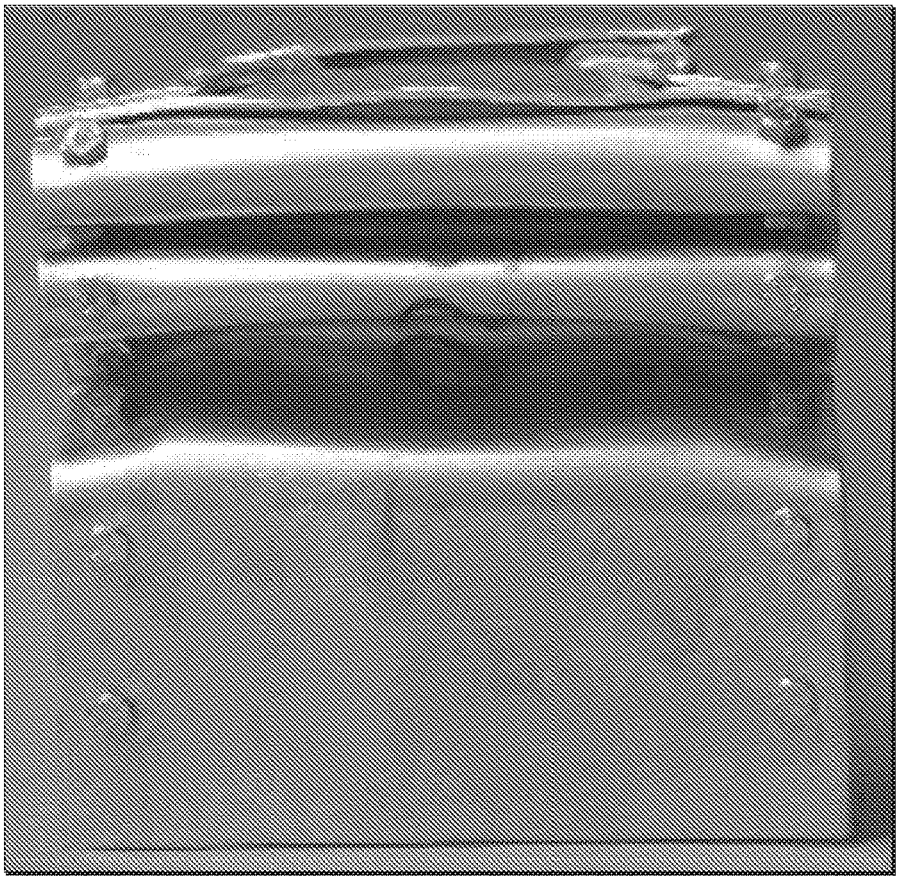
FIG. 17E is a digital image of Alloy SL3 sample 3 after the crush test.
Figure 17F:
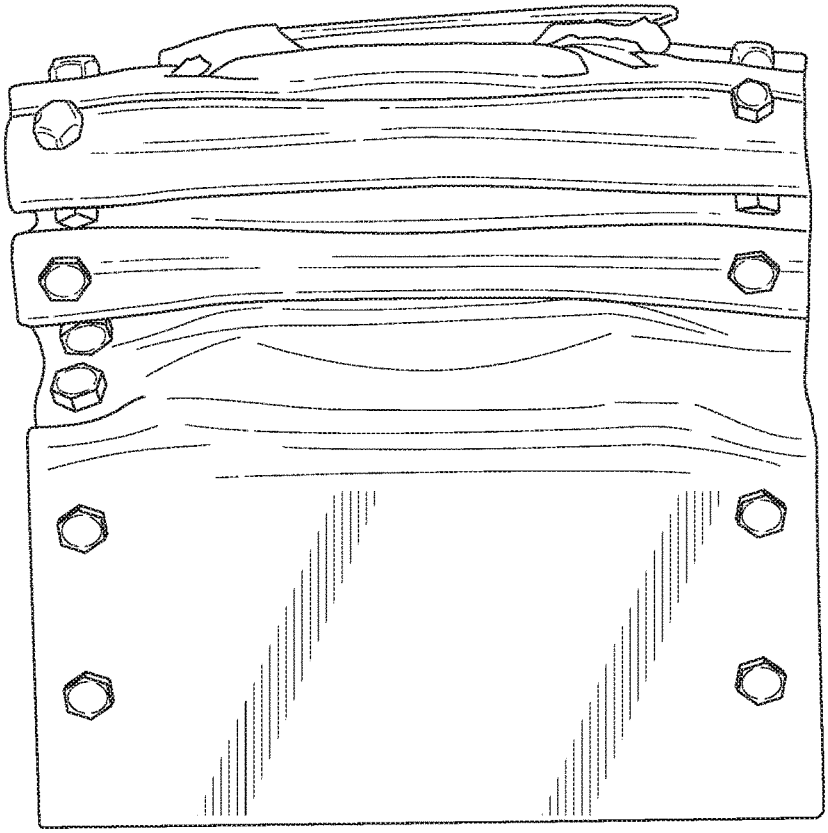
FIG. 17F is a line drawing derived from the digital image of FIG. 17E of Alloy SL3 sample 3 after the crush test.
Figure 18:
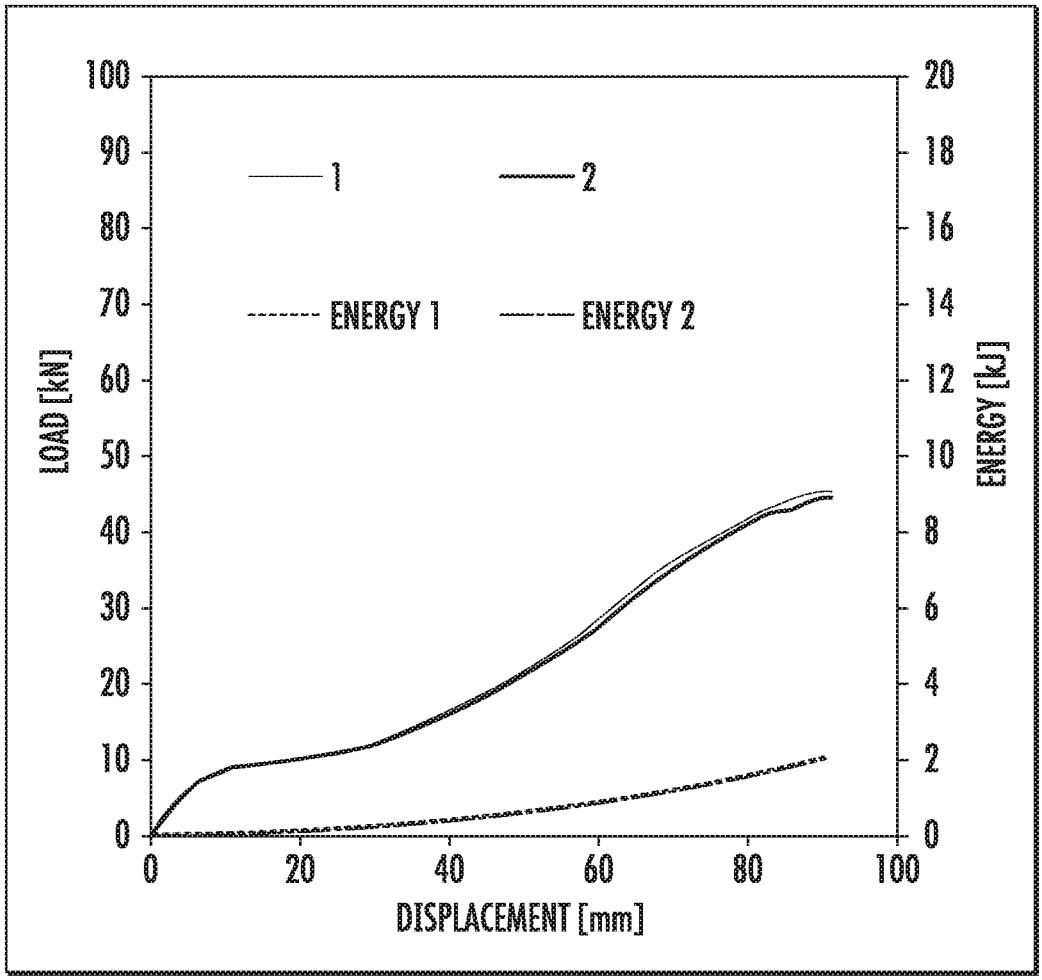
FIG. 18 is a chart that shows the crash test results of Alloy SL3 in T6 temper, showing applied energy and applied load as a function of displacement.
Figure 19A:
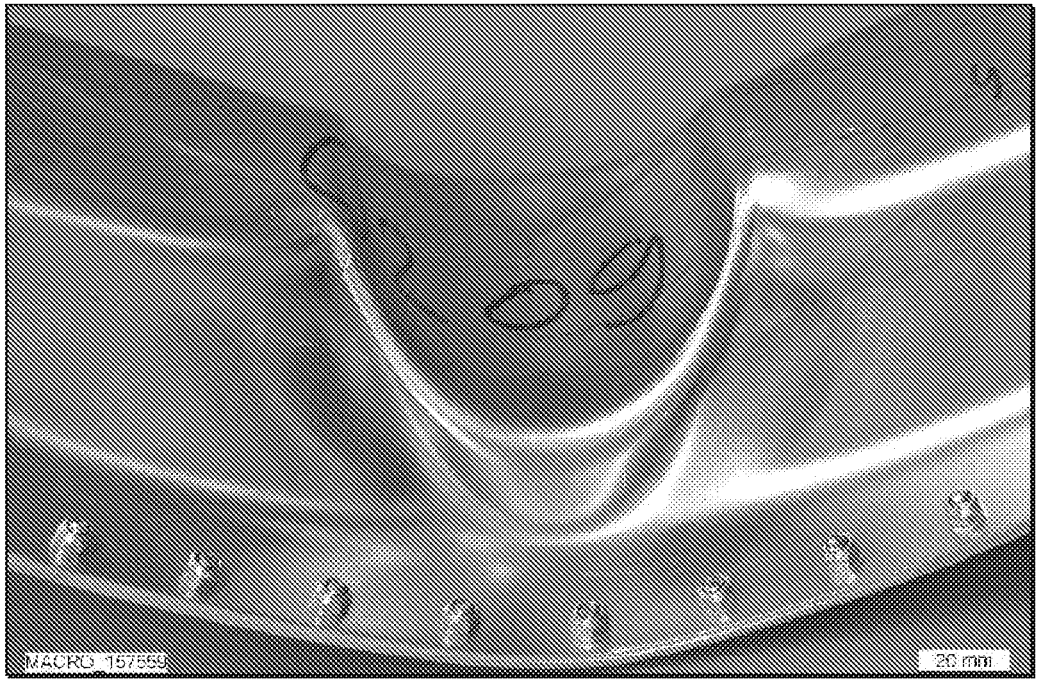
FIG. 19A is a digital image of Alloy SL3 sample 2 after the crash test.
Figure 19B:
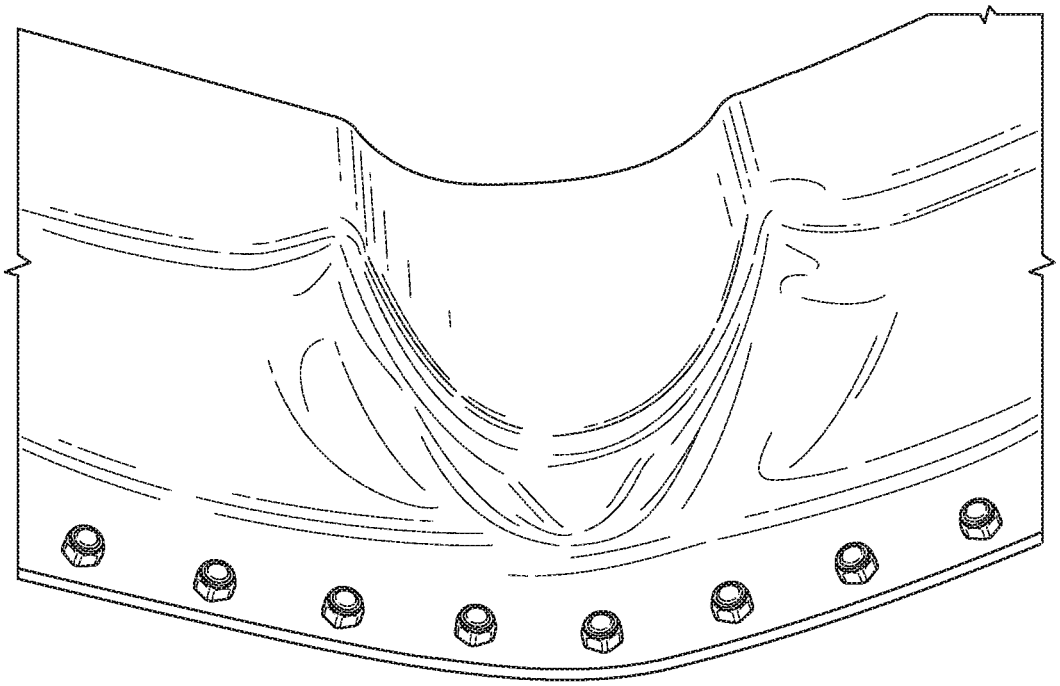
FIG. 19B is a line drawing derived from the digital image of FIG. 19A of Alloy SL3 sample 2 after the crash test.
Figure 19C:
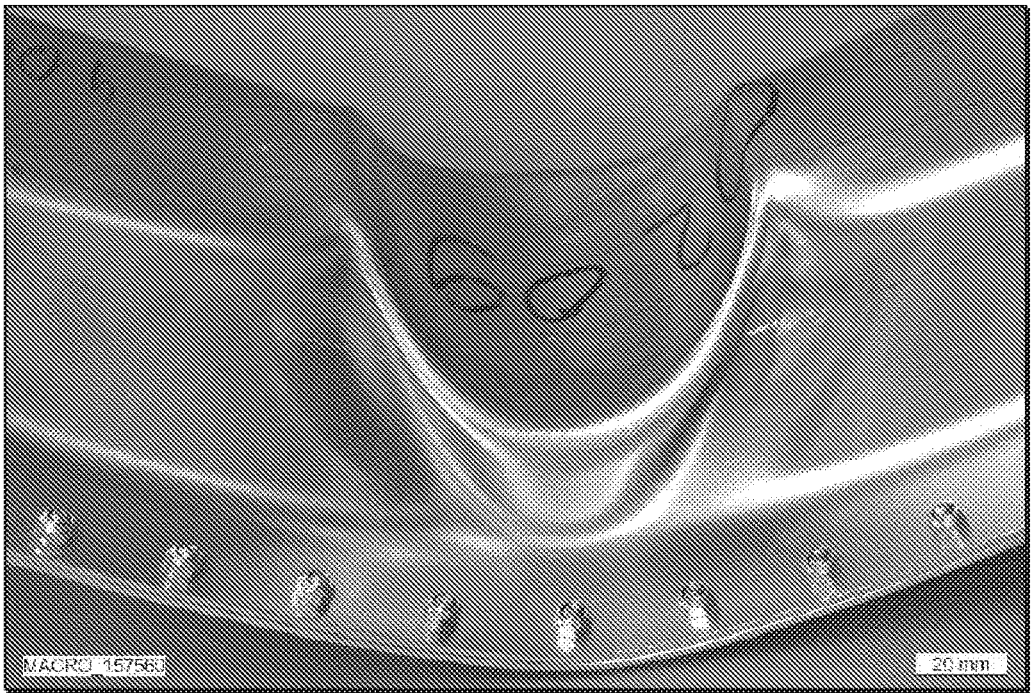
FIG. 19C is a digital image of Alloy SL3 sample 2 after the crash test.
Figure 19D:
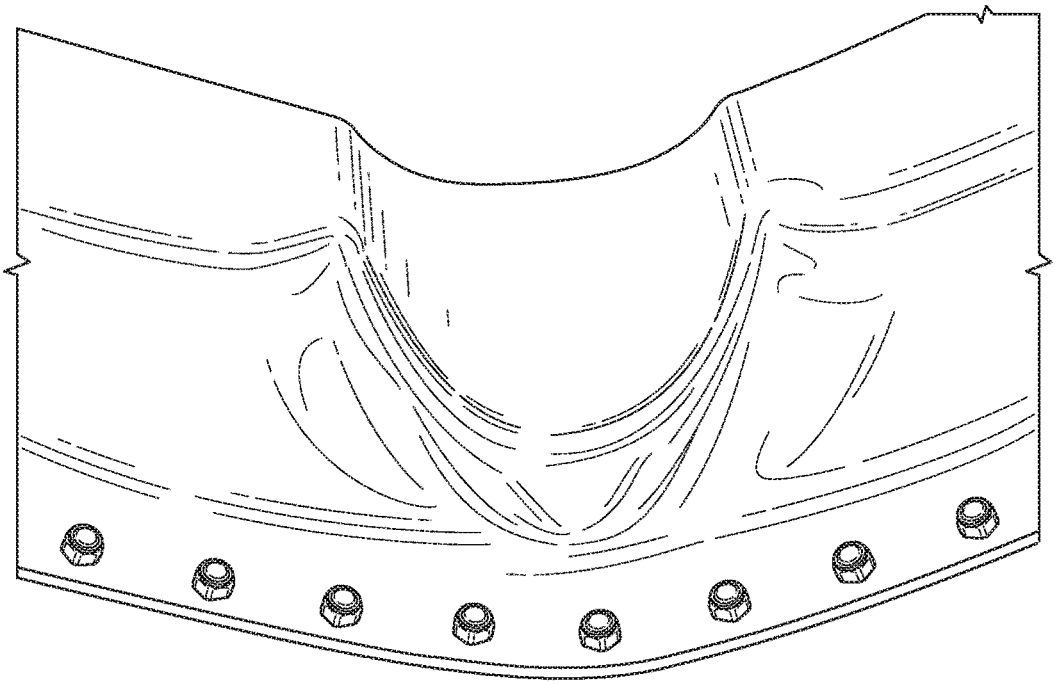
FIG. 19D is a line drawing derived from the digital image of FIG. 19C of Alloy SL3 sample 2 after the crash test.
Figure 20A:
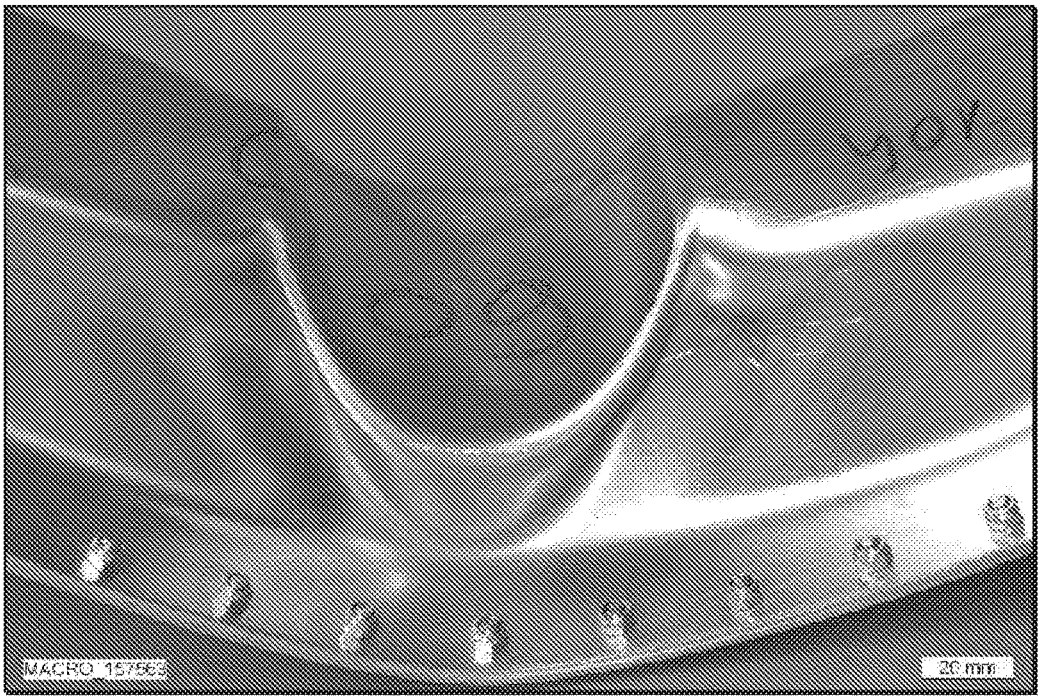
FIG. 20A is a digital image of Alloy SL3 sample 3 after the crash test.
Figure 20B:
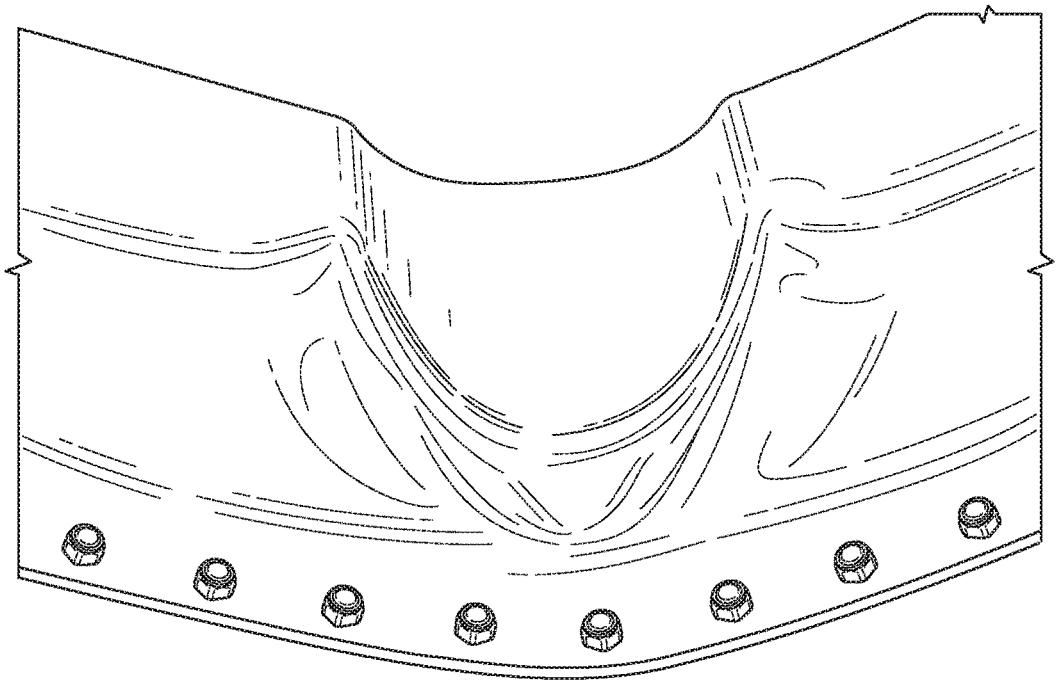
FIG. 20B is a line drawing derived from the digital image of FIG. 20A of Alloy SL3 sample 3 after the crash test.
Figure 20C:
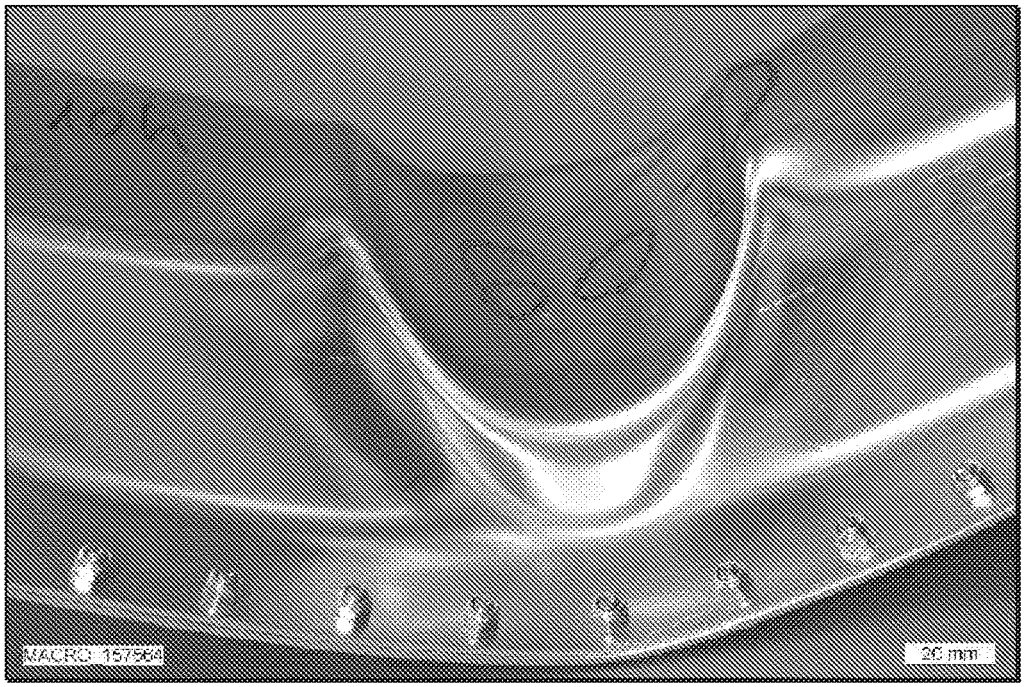
FIG. 20C is a digital image of Alloy SL3 sample 3 after the crash test.
Figure 20D:
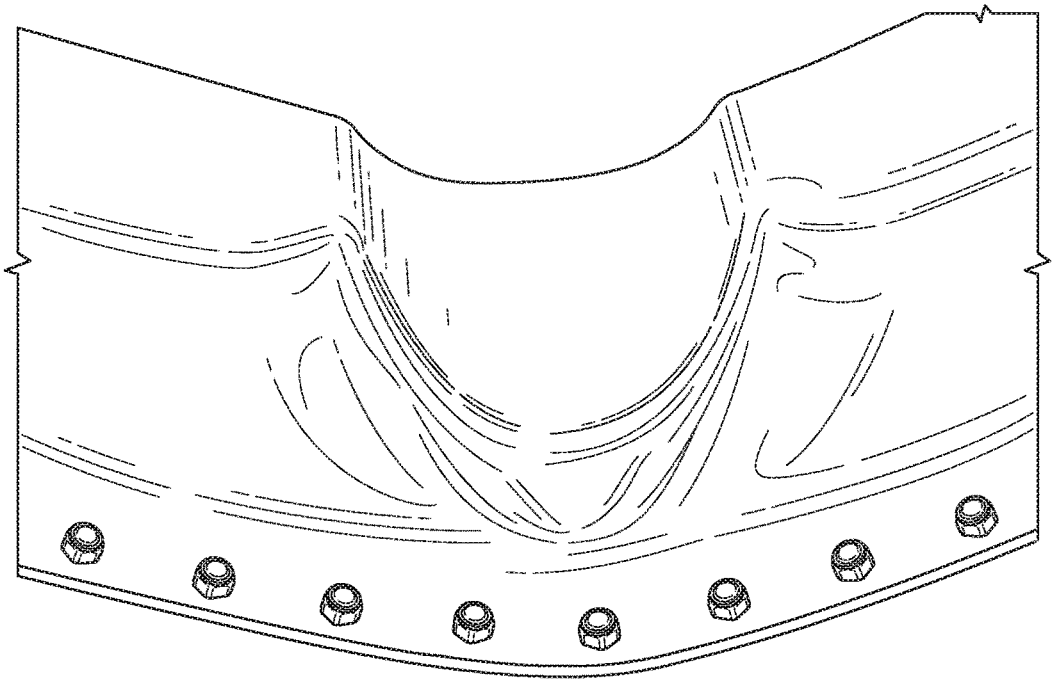
FIG. 20D is a line drawing derived from the digital image of FIG. 20C of Alloy SL3 sample 3 after the crash test.

The alloys were prepared according to the procedure of Example 1. The properties of four of the alloys—SL1, SL2, SL3, and SL4—were tested extensively by standard procedures according to EN 10002-1 to establish their yield strength (FIG. 9), tensile strength (FIG. 10), and elongation properties (FIGS. 11 and 12). The bendability was tested according to VDA 238-100 (FIG. 13). The quasi-static crush test was performed with a 300 mm long crush tube (U-shape) and a crush velocity of 10 mm/s and a total displacement of 185 mm (FIG. 15). The lateral crash test was performed with an 80 mm punch diameter, a velocity of 10 mm/s and displacement of 100 mm. The bending tube was built with an outer angle of 70° between back plate and lateral plate (FIG. 18). Comparative results were collected for samples that were prepared at low PMTs (e.g., from 520-535° C.) and high PMTs (e.g., from about 536° C.-560° C.). Samples tested were 2 mm thick or 2.5 mm for SL1. For the bending results, the outer bend angle was used. The alloy demonstrated a bend angle of less than 90° in T4 temper and less than 135° in T6 temper.

Figure 14:
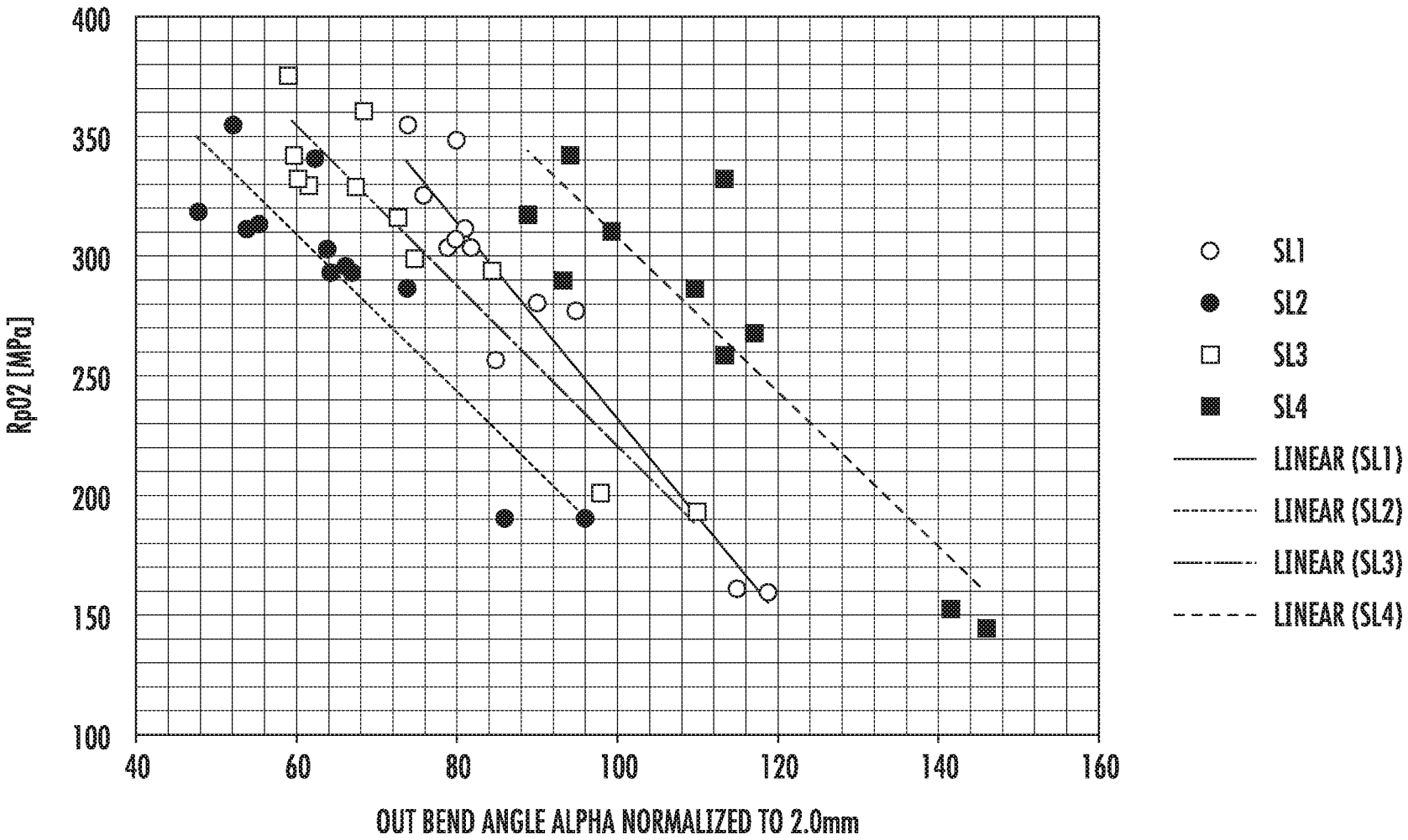
FIG. 14 is a chart that shows the yield strength results (Rp02) to bending results for the alloy compositions SL1, SL2, SL3, and SL4.
Figure 39:
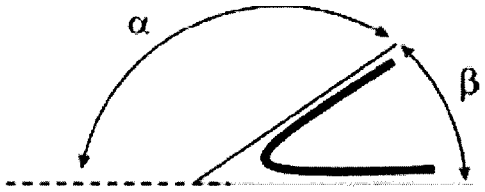
FIG. 39 is an illustration depicting the outer bend angle (a).

To normalize the angle at 2.0 mm, the following formula was used:

$$\alpha_{norm}=\alpha_{measure}\times\sqrt{t_{\text{measure}}}/\sqrt{t_{\text{norm}}}$$

where $\alpha_{measure}$ is the outer bend angle, alpha, $t_{measure}$ is the thickness of the sample, $t_{norm}$ is the normalized thickness, and $\alpha_{norm}$ is the resulting normalized angle (FIG. 39). A comparison of yield strength with bendability showed that SL4 performed the best amongst the tested alloys (FIG. 14).

Quasi-static crush tests demonstrated good crushability for alloy SL3 in a T6 temper condition (aged at 180° C. for 10 h) with a Rp02 of 330 MPa and very high Rm of 403 MPa. T6 temper was chosen to test the worst case scenario for parts in a body in white stage or a motor carrier operating in an elevated temperature environment. Providing an adequate outer bending angle (alpha about 68°) and a high UTS of more than 400 MPa, Alloy SL3 is suitable for automotive structural applications including a B-pillar, an A-pillar, a C-pillar or a floor panel. The high UTS (Rm>400 MPa) is due to the Cu level of 1.7 wt. %. Typically, at least 1.5 wt. % is necessary for good crushability. FIG. 15 is a graph showing the crush test results of Alloy SL3 in T6 temper presenting energy and load as a function of displacement. FIGS. 16A-16F are digital images and accompanying line drawings of crush samples of Alloy SL3 sample 2 after the crush test. Line drawings are presented for clarity. FIGS. 17A-17F are digital images and accompanying line drawings of crush samples of Alloy SL3 sample 3 after the crush test.

Lateral crash tests demonstrated very good bendability for alloy SL3 in a T6 temper condition (aged at 180° C. for 10 hours) with a Rp02 of 330 MPa and very high Rm of 403 MPa. As demonstrated by the quasi-static crush test and substantiated by the lateral crash test, Alloy SL3 is suitable for automotive structural applications. FIG. 18 is a graph showing the crash test results of Alloy SL3 in T6 temper presenting energy and load as a function of displacement. FIGS. 19A-19D are digital images and accompanying line drawings of crash samples of Alloy SL3 sample 1 after the crash test. FIGS. 20A-20D are digital images and accompanying line drawings of crash samples of Alloy SL3 sample 2 after the crash test.

Example 5: Effects of Different Quenches on Properties of SL2

Figure 21:
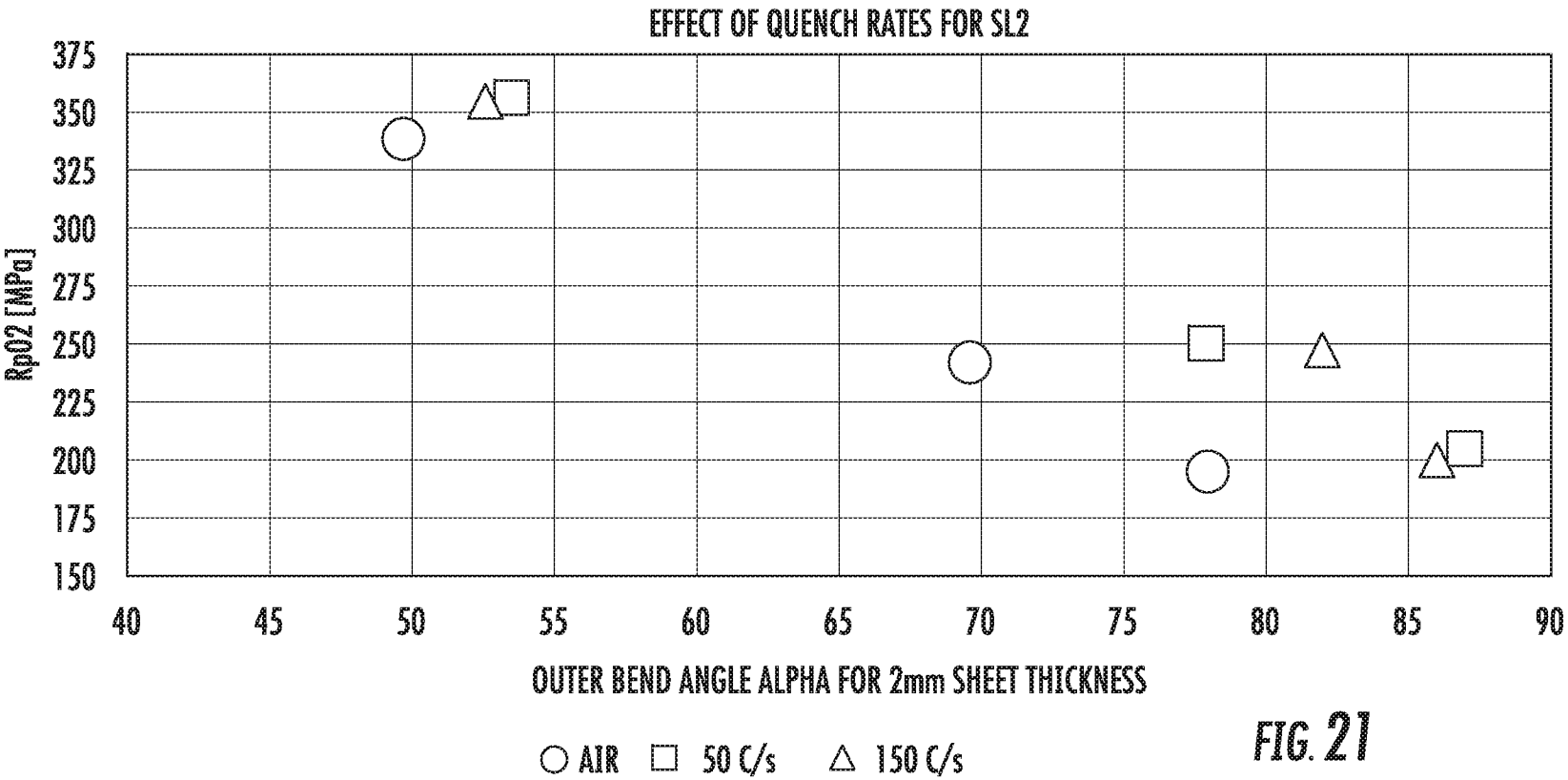
FIG. 21 is a chart that shows the effects of different quenches on the yield strength (Rp02) and bendability of Alloy SL2.

The effects of different quenching conditions on yield strength and bendability were tested for alloy composition SL2 prepared at 550° C. PMT (FIG. 21). An air quench, water quench at 50° C./s, and water quench at 150° C./s were all tested using standard quenching conditions as per Example 4. The results suggested no major effect on yield strength, but improvements in bendability from the water quenches.

Example 6: Effect on Hardness

An additional set of aluminum alloys was prepared (Table 20).

TABLE 20

| Compositions of Alloys (wt. %) | | | | | | |
|---|---|---|---|---|---|---|
| Alloy | Cr | Cu | Fe | Mg | Mn | Si |
| S164 | 0.03 | 0.50 | 0.21 | 1.26 | 0.14 | 1.07 |
| S165 | 0.03 | 0.51 | 0.23 | 0.91 | 0.15 | 1.21 |
| S166 | 0.03 | 0.67 | 0.22 | 1.21 | 0.17 | 0.74 |
| S167 | 0.03 | 0.70 | 0.20 | 1.0 | 0.14 | 1.11 |
| S168 | 0.09 | 0.72 | 0.24 | 1.26 | 0.10 | 0.75 |
| S169 | 0.09 | 0.71 | 0.22 | 1.0 | 0.11 | 1.12 |

Figure 22:
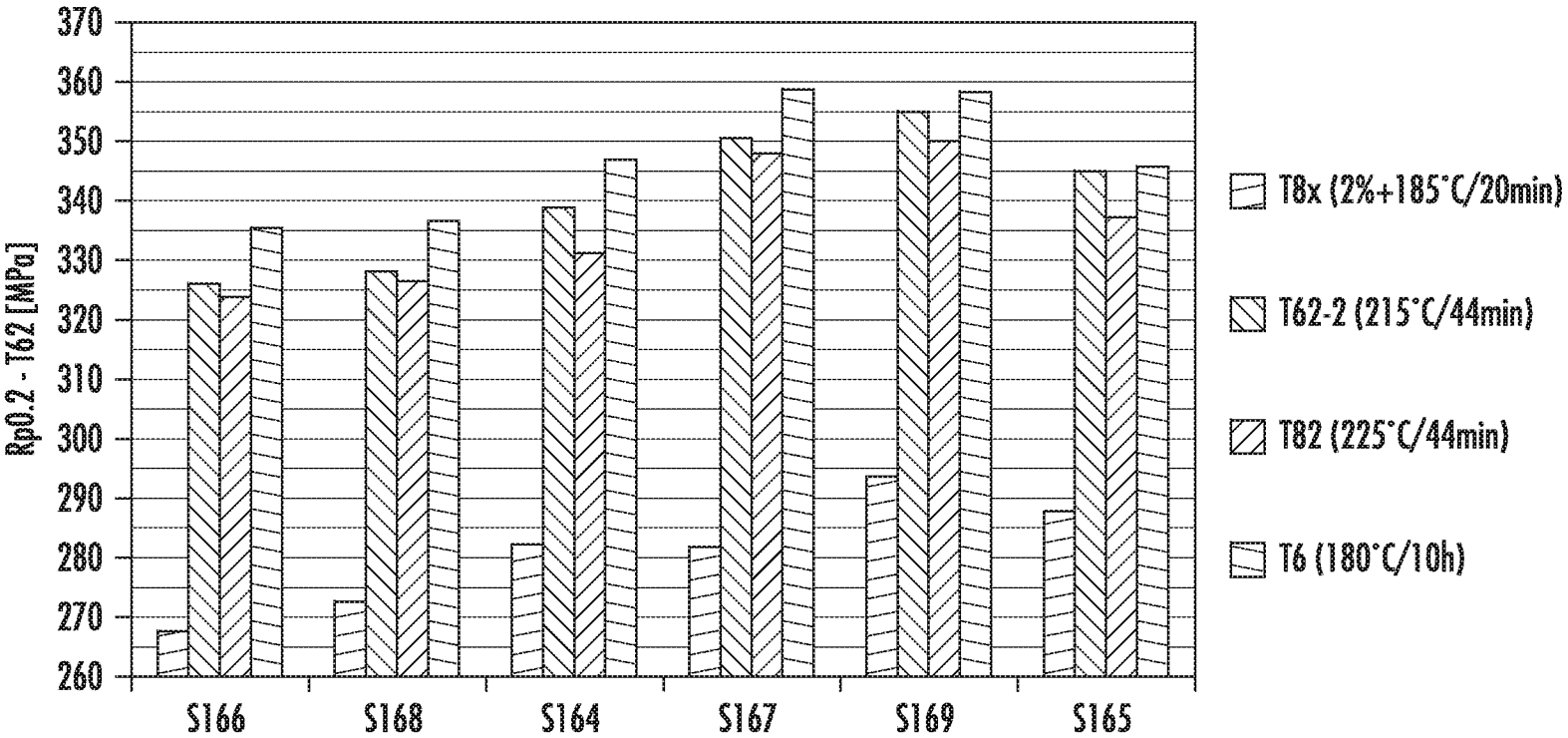
FIG. 22 is a chart that shows the yield strength results (Rp02) of the alloys S164, S165, S166, S167, S168 and S169 after different heat treatments. The left histogram bar in each set represents the heat treatment indicated in the figure legend as T8x. The second from left histogram bar in each set represents the heat treatment indicated in the figure legend as T62-2. The third from left histogram bar in each set represents the heat treatment indicated in the figure legend as T82. The right histogram bar in each set represents the heat treatment indicated in the figure legend as T6.

The alloys were prepared according to Example 1, except that the casting was performed using book molds. The yield strengths of the alloys S164, S165, S166, S167, S168, and S169 after different heat treatments were tested using standard conditions as in Example 4 (FIG. 22). Higher aging temperatures (e.g., 225° C.) led to an overaged condition.

Figure 23:
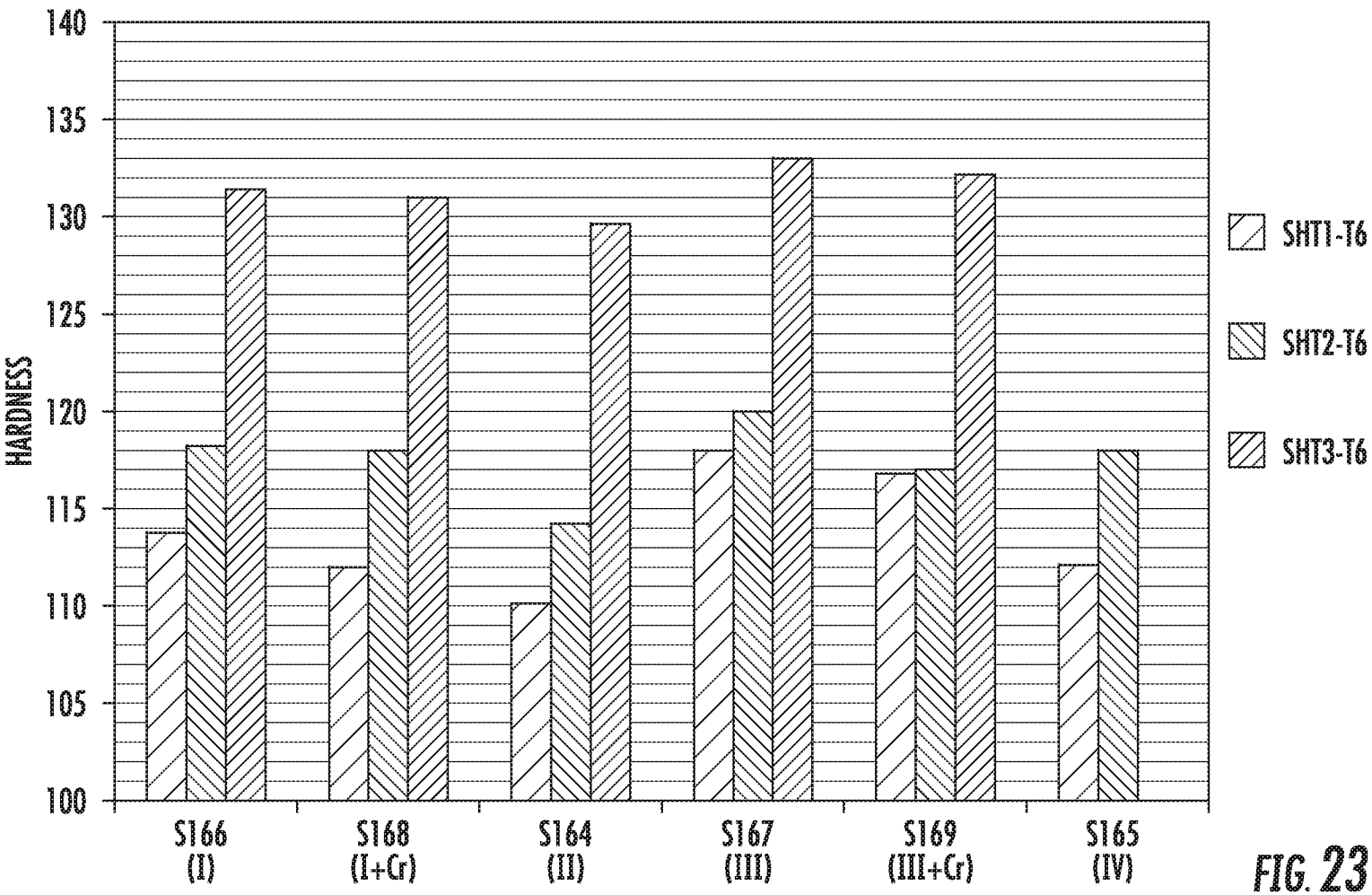
FIG. 23 is a chart that shows the hardness measurements of the alloys S164, S165, S166, S167, S168 and S169 after different solutionizing conditions.

The hardness of the different alloys were also tested at their fully aged T6 conditions at after three heat treatments (SHT1, SHT2, and SHT3 of FIGS. 6-8). The time and temperature during solutionizing heat treatment impacted the hardness of the alloy (FIG. 23).

Example 7: Effect of Zn

An additional set of aluminum alloys was prepared (Table 21).

TABLE 21

| Compositions of Alloys (wt. %) | | | | | | | |
|---|---|---|---|---|---|---|---|
| Alloy | Si | Fe | Cu | Mn | Mg | Zn | Ti |
| S281 | 0.73 | 0.22 | 0.82 | 0.32 | 0.94 | 0.00 | 0.13 |
| S282 | 0.76 | 0.20 | 0.84 | 0.32 | 0.94 | 0.52 | 0.14 |
| S283 | 0.76 | 0.22 | 0.91 | 0.32 | 0.94 | 3.09 | 0.12 |

The alloys were prepared by DC casting the components into ingots and the casting was performed using book molds. The ingots were homogenized at 520° C. to 580° C. for 1-15 hours. The homogenized ingots were then laid down and hot rolled with an entry temperature range of 500° C. to 540° C. and a hot roll exit temperature range of from 250° C. to 380° C. A solution heat treatment step was then performed at 540° C. to 580° C. for 15 minutes to 2 hours, followed by a room temperature quench using water and natural aging to achieve the T4 temper. The T6 temper was achieved by aging the T4 alloys at 180° C. to 225° C. for 15 minutes to 12 hours. The T8 temper was achieved by aging the T6 alloys at 180° C. to 215° C. for 10 minutes to 2 hours.

Figure 24:
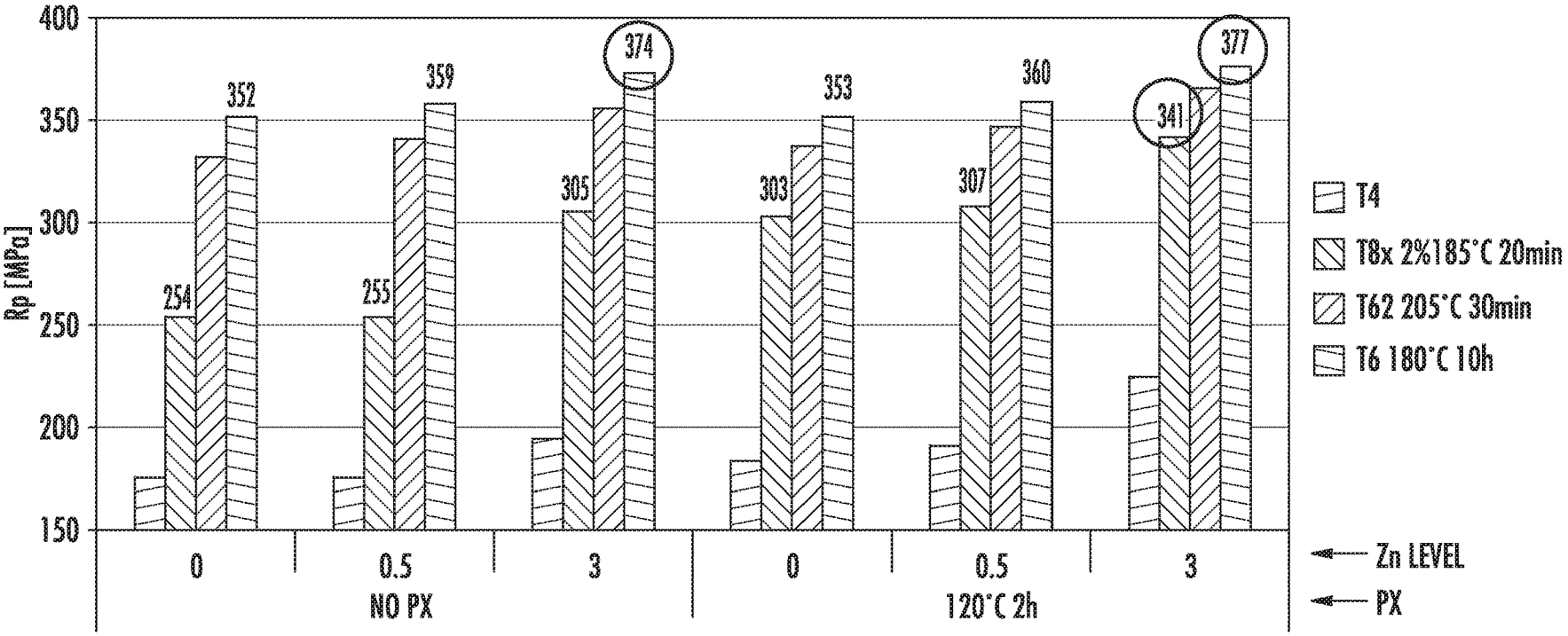
FIG. 24 is a chart that shows tensile strengths of exemplary alloys described herein. The alloys comprise various amounts of Zn in the composition.

Tensile strength of the exemplary alloys is shown in FIG. 24. Zn additions increased the strength of alloys in T4 temper, but more importantly increased the strength of alloys in T6 temper and T8 temper. The graph shows it is possible to achieve tensile strengths greater than 370 MPa without prestraining alloys in T6 temper. The graph shows it is possible to achieve tensile strengths greater than 340 MPa for alloys including up to about 3 wt. % Zn in T8 temper. PX indicates pre-aging or re-heating after solutionizing and quenching. The pre-aging is performed at a temperature between 90° C.-110° C. for a period of time between 1-2 hours.

Figure 25:
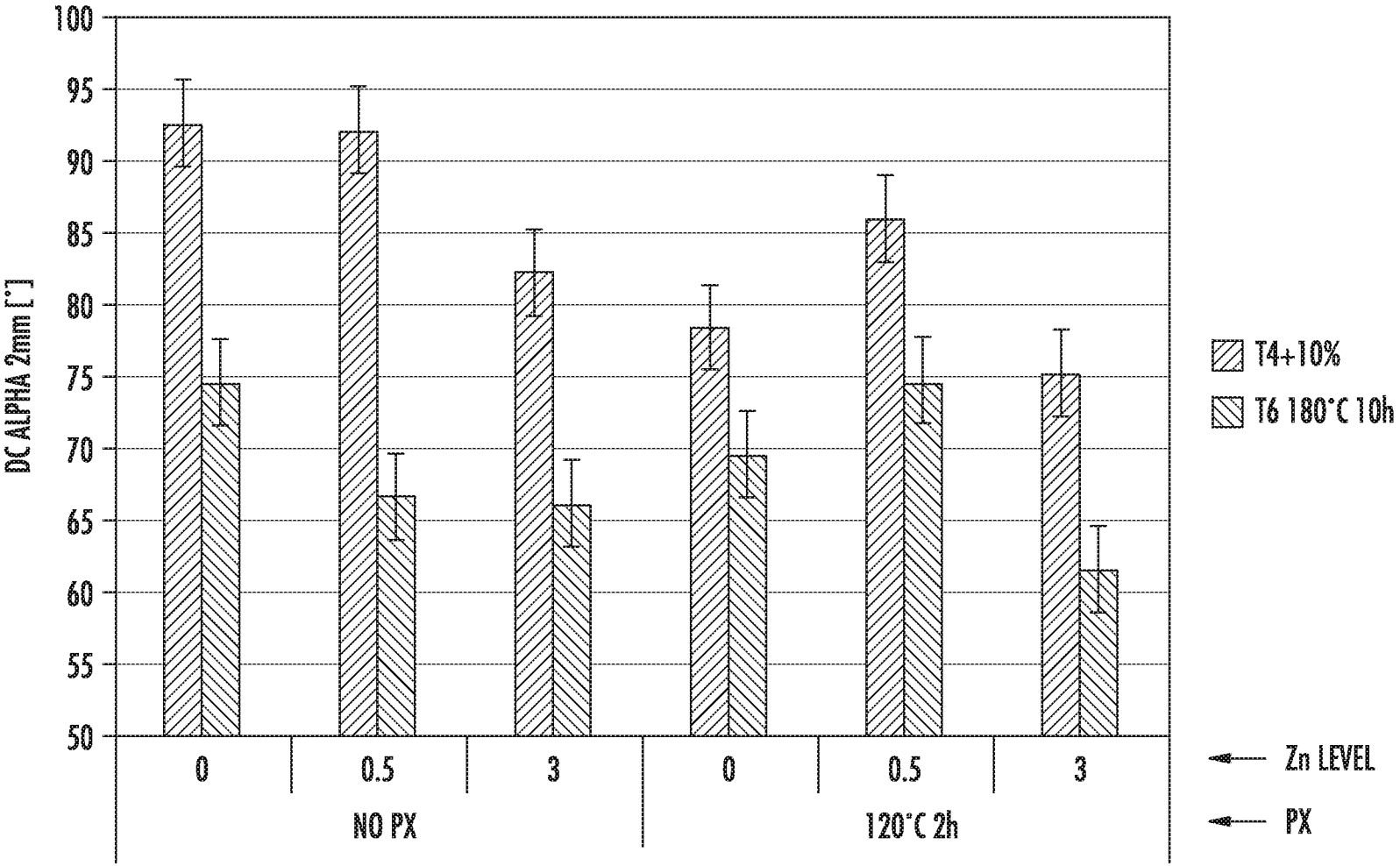
FIG. 25 is a chart that shows formability of exemplary alloys described herein. The alloys comprise various amounts of Zn in the composition.
Figure 26:
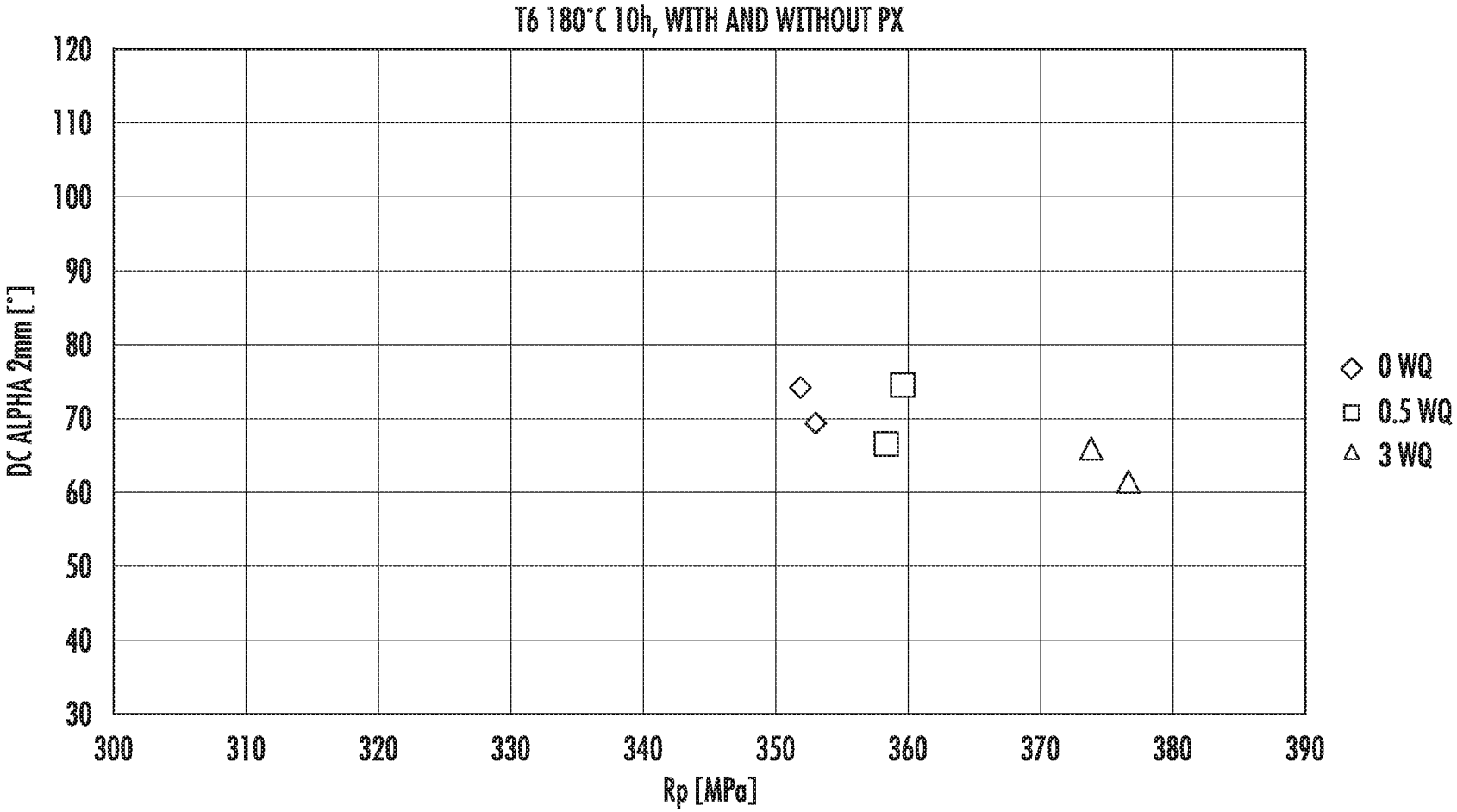
FIG. 26 is a chart that shows the tensile strengths of exemplary alloys described herein to the formability of exemplary alloys described herein. The alloys comprise various amounts of Zn in the composition.

Bending results of the exemplary alloys are shown in FIG. 25. Addition of Zn presents no clear trend in the bending data. The data do indicate a slight decrease in formability. FIG. 26 compares the increased strength to the formability of exemplary alloys. The Zn addition provides a negligible degradation of formability in the exemplary alloys.

Figure 27:
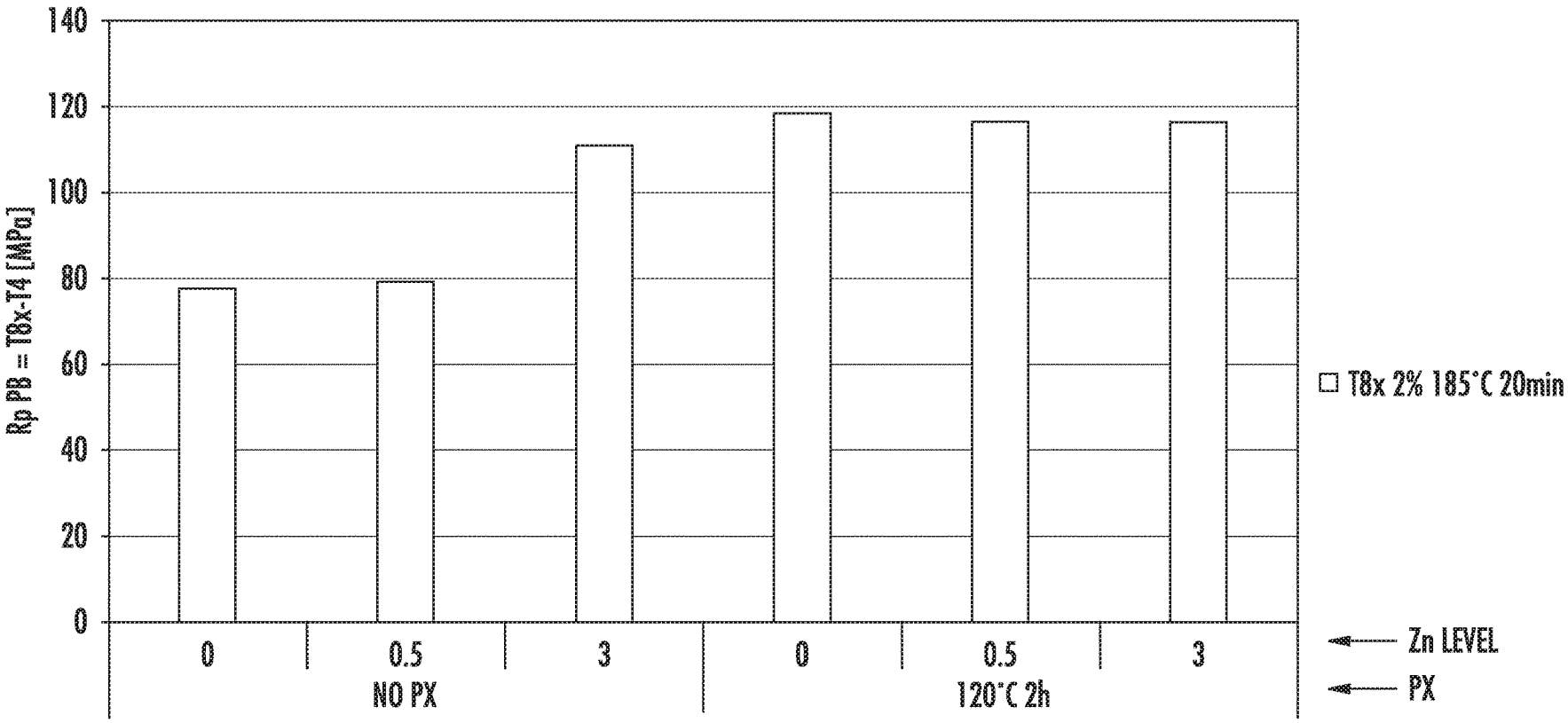
FIG. 27 is a chart that shows the increase in tensile strengths of exemplary alloys described herein. The alloys comprise various amounts of Zn in the composition. The alloys were subjected to various aging methods resulting in various temper conditions.

Paint bake results of the exemplary alloys are shown in FIG. 27. The data shows a paint bake response is not affected by Zn addition, particularly after pre-heating.

Figure 28:
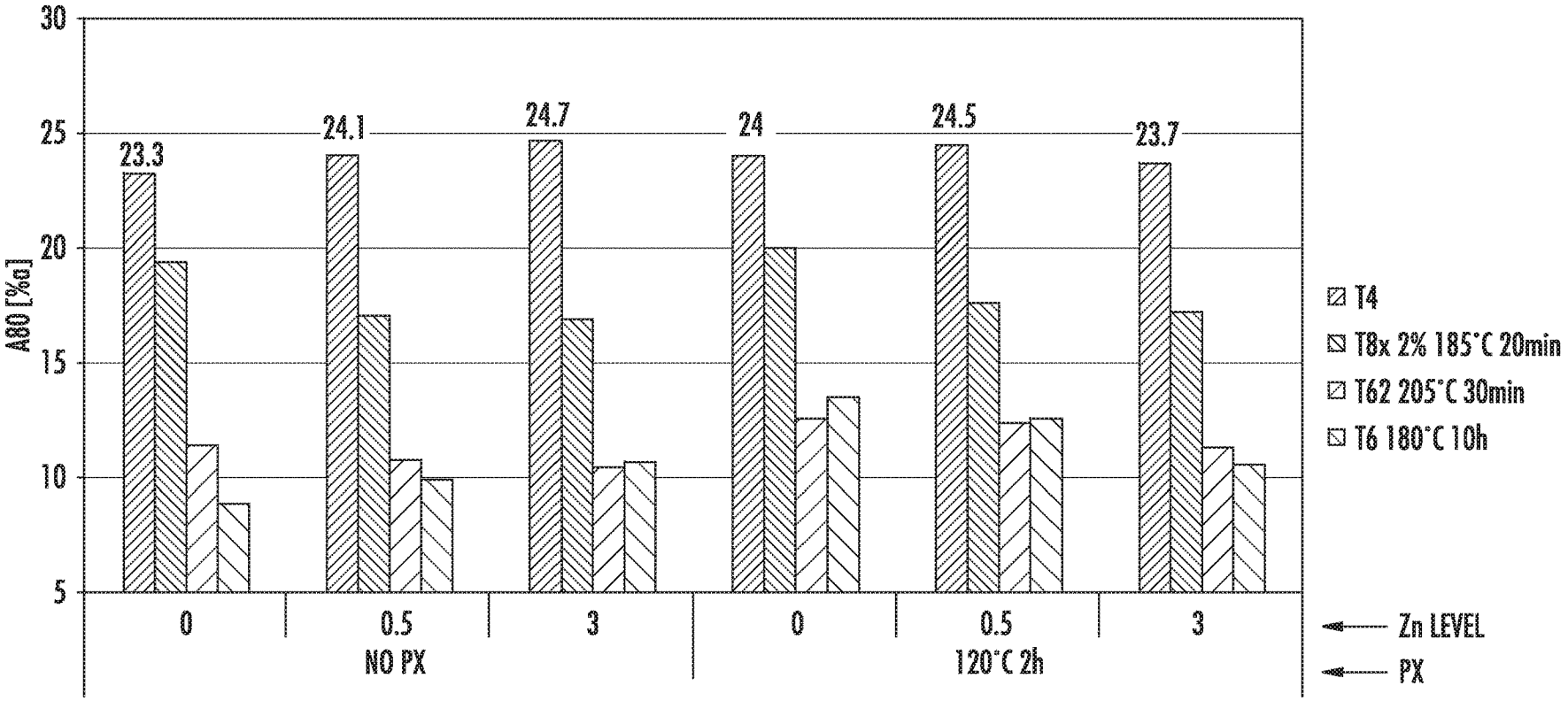
FIG. 28 is a chart that shows elongation of exemplary alloys described herein. The alloys comprise various amounts of Zn in the composition.

Elongation of the exemplary alloys is shown in FIG. 28. The graph demonstrates the elongation of the exemplary alloys is not degraded after Zn addition. Strength increase due to the Zn addition provides a greater formability in a high-strength aluminum alloy. Adding up to 3 wt. % Zn increases strength in exemplary alloys without significantly decreasing formability or elongation.

Example 8: Properties of Exemplary Aluminum Alloys TB7, TB8, PF5, TB13, TB14, PF4, TB15, TB16, PF11, PF12, and Comparative Aluminum Alloys PF13 and TB5

A set of ten exemplary alloys was prepared: TB7, TB8, PF5, TB13, TB14, PF4, TB15, TB16, PF11, PF12 and TB5 (Table 22):

TABLE 22

| Compositions of TB5-TB16 and PF5-PF13 Alloys (wt. %) | | | | | | | | | | |
|---|---|---|---|---|---|---|---|---|---|---|
| Alloy | Cr | Cu | Fe | Mg | Mn | Si | Zr | Zn | Ti | Excess Si |
| TB7 | 0.06 | 0.65 | 0.20 | 1.47 | 0.09 | 1.04 | 0 | 0.04 | 0.01 | −0.49 |
| TB8 | 0.09 | 0.67 | 0.21 | 1.45 | 0.10 | 1.03 | 0 | 0.01 | 0.01 | −0.49 |
| PF5 | 0.06 | 1.28 | 0.14 | 0.82 | 0.20 | 0.97 | 0.10 | 0.006 | 0.013 | 0.08 |
| TB13 | 0.07 | 1.25 | 0.22 | 1.12 | 0.04 | 1.05 | 0 | 0.01 | 0.02 | −0.13 |
| TB14 | 0.06 | 1.27 | 0.13 | 0.96 | 0.18 | 0.78 | 0.09 | 0.005 | 0.014 | −0.24 |
| PF4 | 0.14 | 1.75 | 0.16 | 0.74 | 0.00 | 0.86 | 0.09 | 0.005 | 0.012 | 0.07 |
| TB15 | 0.16 | 1.80 | 0.18 | 1.16 | 0.01 | 1.02 | 0.09 | 0.012 | 0.024 | −0.20 |
| TB16 | 0.16 | 1.82 | 0.18 | 1.16 | 0.00 | 1.04 | 0.10 | 0.005 | 0.136 | −0.18 |
| PF11 | 0.02 | 0.65 | 0.19 | 1.01 | 0.17 | 0.94 | 0.1 | 0.21 | 0.02 | −0.13 |
| PF12 | 0.03 | 0.75 | 0.18 | 0.95 | 0.28 | 0.75 | 0.1 | 0.2 | 0.03 | −0.28 |
| PF13 | 0.03 | 0.74 | 0.19 | 0.93 | 0.27 | 0.73 | 0 | 0.2 | 0.03 | −0.28 |
| TB5 | 0.28 | 0.62 | 0.2 | 0.86 | 0.09 | 0.64 | 0 | 0.67 | 0.02 | −0.32 |

The alloys were prepared by DC casting the components into ingots and homogenizing the ingots at 520° C. to 580° C. for 1-5 hours. The homogenized ingots were then laid down and hot rolled with an entry temperature range of 500° C. to 540° C. and a hot roll exit temperature range of from 250° C. to 380° C. A solution heat treatment step was then performed at 540° C. to 580° C. for 15 minutes to 2 hours, followed by a room temperature quench using water and natural aging to achieve the T4 temper. The T6 temper was achieved by aging the T4 alloys at 150° C. to 250° C. for 15 minutes to 24 hours.

The properties of the TB7, TB8, PF5, TB13, TB14, PF4, TB15, TB16, PF11 and PF12 alloys were determined using testing procedures conventional in the art and compared to the control alloys PF13 and TB5 (Table 23). Corrosion tests were performed according to the ISO 11846 standard.

TABLE 23

Properties of TB7, TB8, PF5, TB13, TB14, PF4, TB15, TB16, PF11, PF12, PF13 and TB5 Alloys

| | Gauge | | | | | |
|---|---|---|---|---|---|---|
| | 10 mm | 10 mm | 2 mm | 2 mm | 2 mm | 2 mm |
| | Temper | | | | | |
| | T6 | T6 | T4 | T6 | T6 | T6 |
| | Property | | | | | |
| Alloy | YS (MPa) | IGC depth (μm) | Bend Angle β (°) | YS (MPa) | Bend Angle β (°) | IGC depth (μm) |
| TB7 | 391 | 211 | 77 | 374 | 133 | 433 |
| TB8 | 394 | 130 | 75 | 376 | 129 | 343 |
| PF5 | 376 | 221 | 61.8 | 377 | 122 | 181 |
| TB13 | 390 | 253 | 68 | 376 | 131 | 335 |
| TB14 | 386 | 245 | 61.7 | 379 | 117 | 84 |
| PF4 | 376 | 239 | 81 | 359 | 132 | 79 |
| TB15 | 390 | 288 | 82.7 | 371 | 131 | 210 |
| TB16 | 387 | 250 | 88.7 | 377 | 131 | 39 |
| PF11 | 388 | 372 | 42 | 378 | 118 | 289 |
| PF12 | 358 | 285 | 38.8 | 353 | 94 | 245 |
| PF13 | 356 | 350 | 33.3 | 343 | 98 | 364 |
| TB5 | 321 | — | — | — | — | — |

Overall, the exemplary alloys demonstrated improved yield strength and corrosion resistance when compared to the comparative PF13 and TB5 alloys.

Example 9: Properties of Exemplary Aluminum Alloys PF1, PF2 and PF6

A set of three exemplary alloys was prepared: PF1, PF2 and PF6 (Table 24).

TABLE 24

Compositions of PF1, PF2 and PF6 Alloys (wt. %)

| Alloy | Cr | Cu | Fe | Mg | Mn | Si | Zr | Ti |
|---|---|---|---|---|---|---|---|---|
| PF1 | 0.08 | 0.69 | 0.17 | 1.15 | 0.08 | 1.26 | 0 | 0.02 |
| PF2 | 0.08 | 0.67 | 0.14 | 1.17 | 0.09 | 1.27 | 0.09 | 0.03 |
| PF6 | 0.07 | 0.67 | 0.14 | 1.15 | 0.19 | 1.27 | 0.09 | 0.02 |

The alloys were prepared by DC casting the components into ingots and homogenizing the ingots at 520° C. to 580° C. for 1-5 hours. The homogenized ingots were then laid down and hot rolled with an entry temperature range of 500° C. to 540° C. and a hot roll exit temperature range of from 250° C. to 380° C. A solution heat treatment step was then performed at 540° C. to 580° C. for 15 minutes to 2 hours, followed by a room temperature quench using water and natural aging to achieve the T4 temper. The T6 temper was achieved by aging the T4 alloys at 150° C. to 250° C. for 15 minutes to 24 hours. The properties of the PF1, PF2, and PF6 alloys were determined using testing procedures conventional in the art. Corrosion tests were performed according to the ISO 11846 standard.

Figure 29:
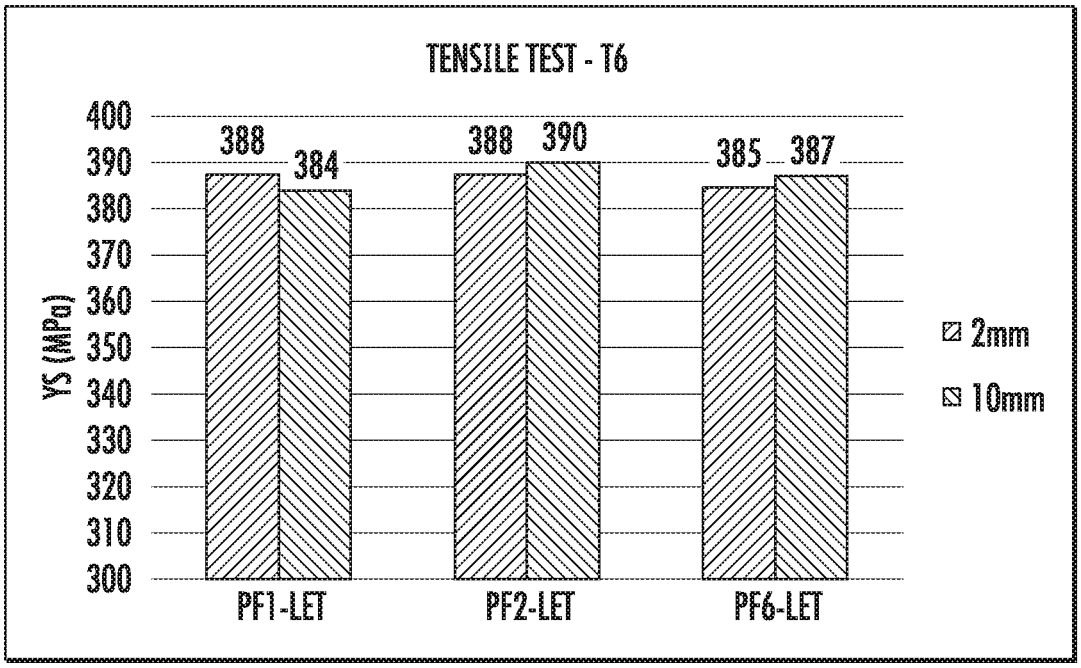
FIG. 29 is a chart that shows the tensile strengths of exemplary alloys described herein. The alloys comprise various amounts of Zr in the composition. The alloys were rolled to 2 mm and 10 mm gauge. The alloys were subjected to aging methods resulting in T6 temper condition.

FIG. 29 is a chart that shows the tensile strengths of exemplary alloys PF1, PF2 and PF6 ("-LET" refers to low exit temperature). The alloys comprise various amounts of Zr in the composition. The alloys were rolled to 2 mm and 10 mm gauge. The alloys were subjected to aging methods resulting in T6 temper condition. The alloys demonstrate high tensile strengths for both gauges in T6 temper.

Figure 30:
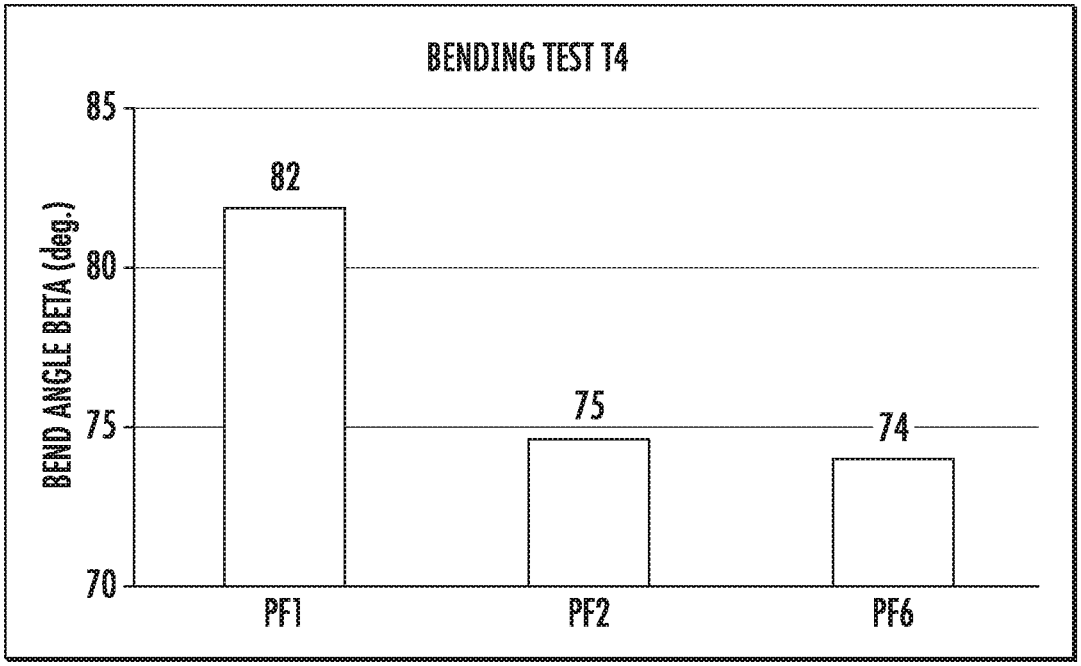
FIG. 30 is a chart that shows formability of exemplary alloys described herein. The alloys comprise various amounts of Zr in the composition. The alloys were rolled to 2 mm gauge. The alloys were subjected to aging methods resulting in T4 temper condition.
Figure 31:
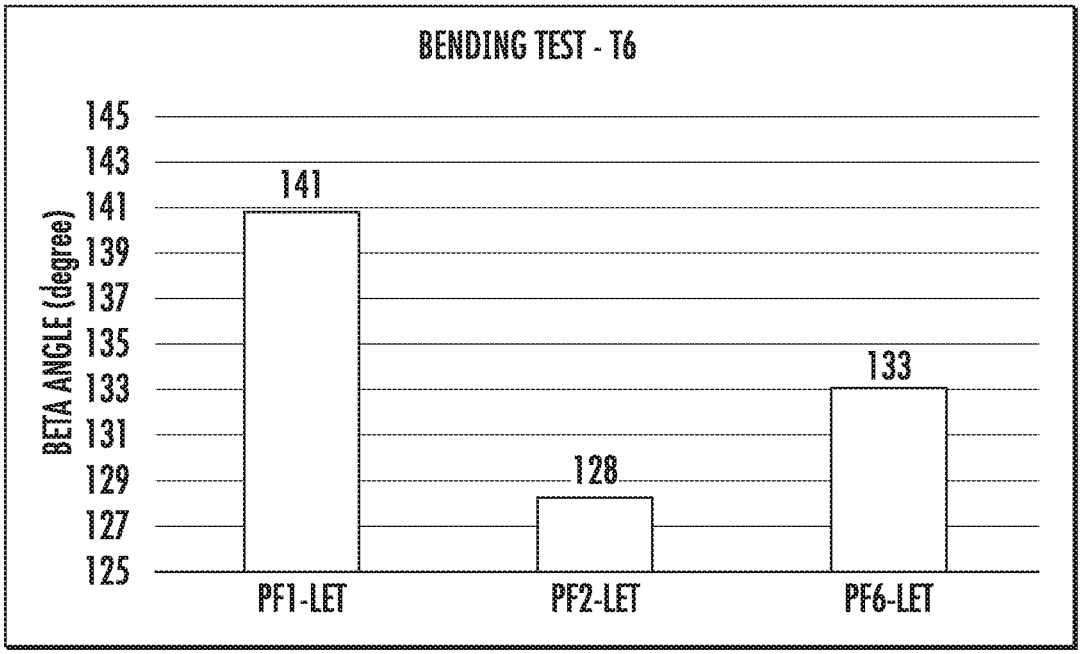
FIG. 31 is a chart that shows formability of exemplary alloys described herein. The alloys comprise various amounts of Zr in the composition. The alloys were rolled to 2 mm gauge. The alloys were subjected to aging methods resulting in T6 temper condition.

FIG. 30 is a chart that shows formability of exemplary alloys PF1, PF2 and PF6. The alloys comprise various amounts of Zr in the composition. The alloys were rolled to 2 mm gauge. The alloys were subjected to aging methods resulting in T4 temper condition. The alloys exhibit a bending angle less than 90° for a 2 mm gauge in T4 temper. FIG. 31 is a chart that shows formability of exemplary alloys PF1, PF2 and PF6 rolled to 2 mm gauge and subjected to aging methods resulting in T6 temper condition. The alloys containing Zr (PF2 and PF6) exhibit a bend angle less than 135° for a 2 mm gauge alloy in T6 temper.

Figure 32:
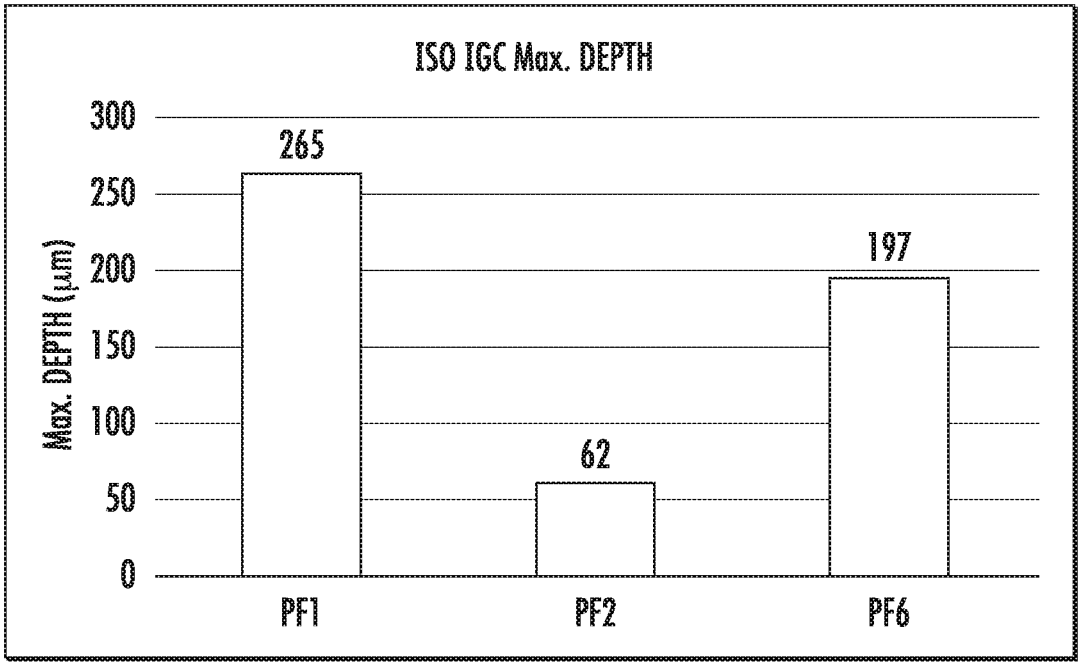
FIG. 32 is a chart that shows maximum corrosion depth of exemplary alloys described herein. The alloys comprise various amounts of Zr in the composition. The alloys were rolled to 2 mm gauge.
Figure 33:
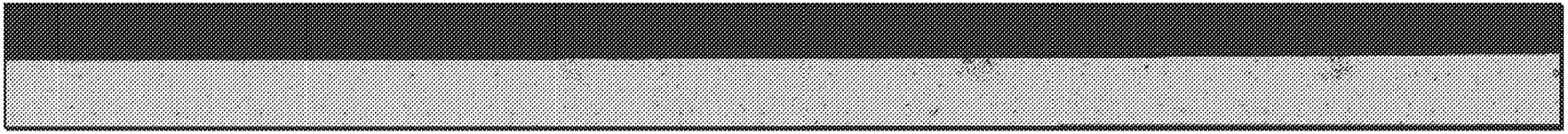
FIG. 33 is a digital image of a cross-sectional view of exemplary alloys described herein after corrosion testing. The alloys comprise various amounts of Zr in the composition. The alloys were rolled to 2 mm gauge.
Figure 34:
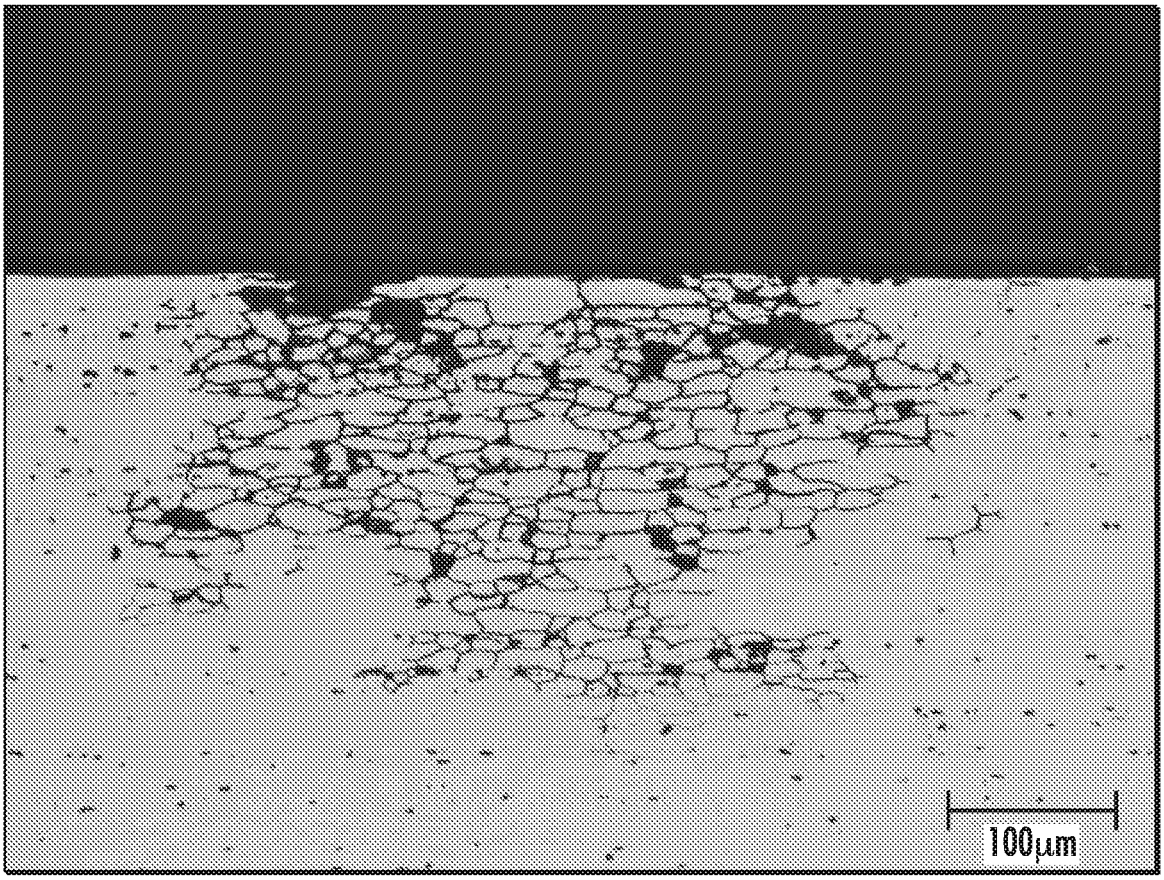
FIG. 34 is a digital image of a cross-sectional view of exemplary alloys described herein after corrosion testing. The alloys comprise various amounts of Zr in the composition. The alloys were rolled to 2 mm gauge.
Figure 35:
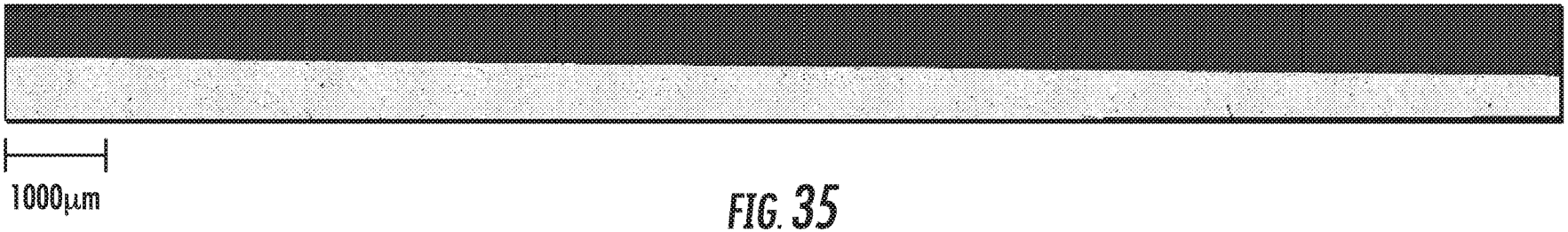
FIG. 35 is a digital image of a cross-sectional view of exemplary alloys described herein after corrosion testing. The alloys comprise various amounts of Zr in the composition. The alloys were rolled to 2 mm gauge.
Figure 36:
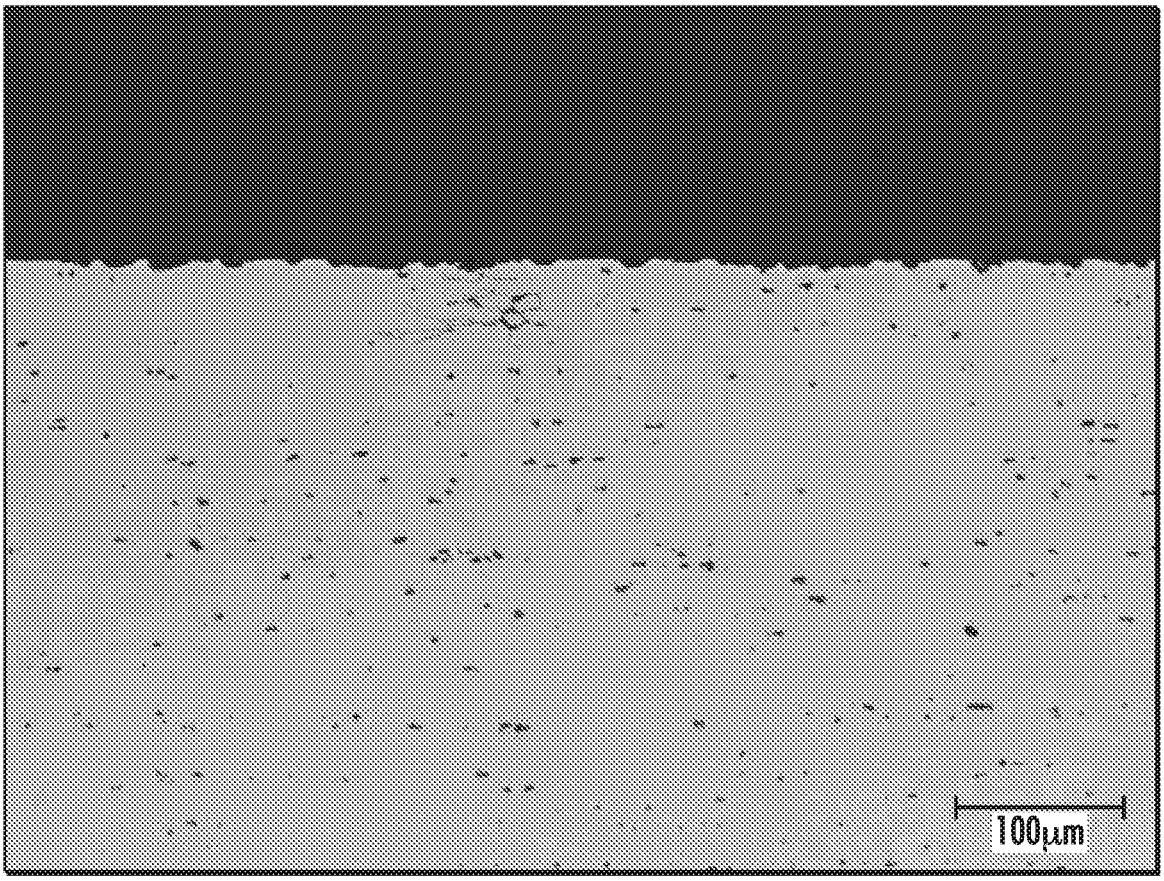
FIG. 36 is a digital image of a cross-sectional view of exemplary alloys described herein after corrosion testing. The alloys comprise various amounts of Zr in the composition. The alloys were rolled to 2 mm gauge.
Figure 37:
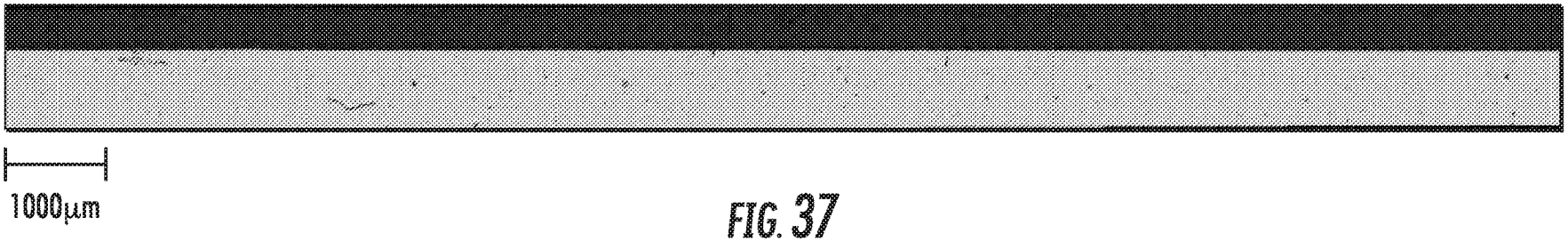
FIG. 37 is a digital image of a cross-sectional view of exemplary alloys described herein after corrosion testing. The alloys comprise various amounts of Zr in the composition. The alloys were rolled to 2 mm gauge.
Figure 38:
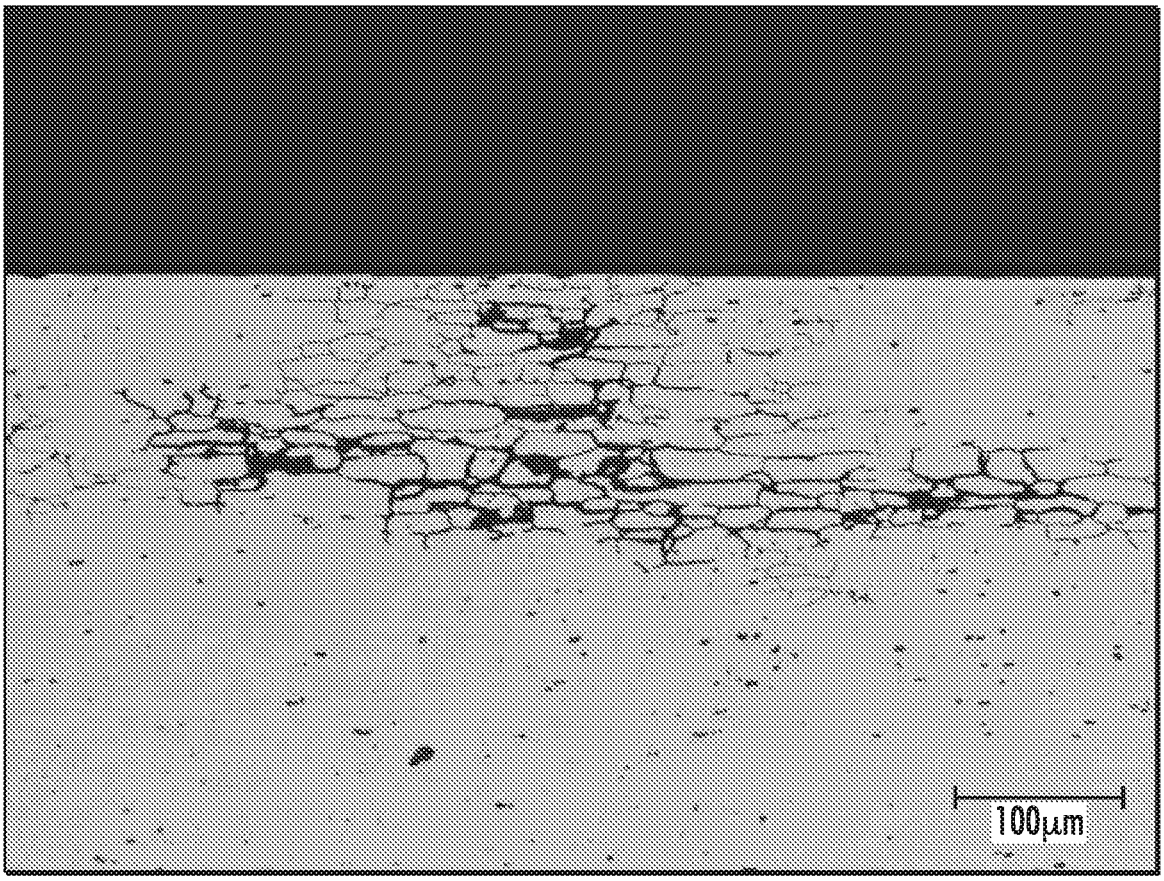
FIG. 38 is a digital image of a cross-sectional view of exemplary alloys described herein after corrosion testing. The alloys comprise various amounts of Zr in the composition. The alloys were rolled to 2 mm gauge.

FIG. 32 is a chart that shows maximum corrosion depth of exemplary alloys PF1, PF2 and PF6. The alloys comprise various amounts of Zr in the composition. The alloys were rolled to 2 mm gauge. The alloys containing Zr demonstrated increased resistance to corrosion indicated by a lower maximum corrosion depth. FIGS. 33-38 show micrographs of cross-sectional views of exemplary alloys PF1, PF2 and PF6 after corrosion testing. The alloys comprise various amounts of Zr in the composition. The alloys were rolled to 2 mm gauge. Alloy PF1 exhibited a higher depth of corrosion compared to alloys PF2 and PF6. FIGS. 33 and 34 show the corrosion in alloy PF1. FIGS. 35 and 36 show the corrosion in alloy PF2. FIGS. 37 and 38 show the corrosion in alloy PF6. The alloys containing Zr (PF2 and PF6) demonstrated a higher resistance to corrosion.

All patents, publications and abstracts cited above are incorporated herein by reference in their entireties. Various embodiments of the invention have been described in fulfillment of the various objectives of the invention. It should be recognized that these embodiments are merely illustrative of the principles of the present invention. Numerous modifications and adaptions thereof will be readily apparent to those skilled in the art without departing from the spirit and scope of the present invention as defined in the following claims.

The invention claimed is:

1. A rolled aluminum alloy product comprising about 0.6-0.9 wt. % Cu, about 0.8-1.3 wt. % Si, about 1.0-1.3 wt. % Mg, about 0.03-0.25 wt. % Cr, about 0.05-0.2 wt. % Mn, about 0.15-0.3 wt. % Fe, up to about 0.2 wt. % Zr, up to about 0.2 wt. % Sc, up to about 0.25 wt. % Sn, up to about 0.9 wt. % Zn, up to about 0.1 wt. % Ti, up to about 0.07 wt. % Ni, and up to about 0.15 wt. % of impurities, with the remainder as Al.

2. The rolled aluminum alloy product of claim 1, wherein the rolled aluminum alloy product has a Si to Mg ratio of from about 0.55:1 to about 1.30:1 by weight.

3. The rolled aluminum alloy product of claim 1, wherein the rolled aluminum alloy product has an excess Si content of from −0.5 to 0.1.

4. A rolled aluminum alloy product comprising about 0.5-2.0 wt. % Cu, about 0.5-1.5 wt. % Si, about 0.5-1.5 wt. % Mg, about 0.001-0.25 wt. % Cr, about 0.005-0.4 wt. % Mn, about 0.1-0.3 wt. % Fe, up to about 0.2 wt. % Zr, up to about 0.2 wt. % Sc, up to about 0.25 wt. % Sn, up to about 4.0 wt. % Zn, up to about 0.15 wt. % Ti, less than 0.1 wt. % Ni, and up to about 0.15 wt. % of impurities, with the remainder as Al.

5. The rolled aluminum alloy product of claim 4, comprising about 0.5-2.0 wt. % Cu, about 0.5-1.35 wt. % Si, about 0.6-1.5 wt. % Mg, about 0.001-0.18 wt. % Cr, about 0.005-0.4 wt. % Mn, about 0.1-0.3 wt. % Fe, up to about 0.2 wt. % Zr, up to about 0.2 wt. % Sc, up to about 0.25 wt. % Sn, up to about 0.9 wt. % Zn, up to about 0.15 wt. % Ti, less than 0.1 wt. % Ni, and up to about 0.15 wt. % of impurities, with the remainder as Al.

6. The rolled aluminum alloy product of claim 4, wherein the aluminum alloy comprises about 0.6-0.9 wt. % Cu, about 0.7-1.1 wt. % Si, about 0.9-1.5 wt. % Mg, about 0.06-0.15 wt. % Cr, about 0.05-0.3 wt. % Mn, about 0.1-0.3 wt. % Fe, up to about 0.2 wt. % Zr, up to about 0.2 wt. % Sc, up to about 0.25 wt. % Sn, up to about 0.2 wt. % Zn, up to about 0.15 wt. % Ti, up to about 0.07 wt. % Ni, and up to about 0.15 wt. % of impurities, with the remainder as Al.

7. The rolled aluminum alloy product of claim 4, comprising about 0.5-1.8 wt. % Cu, about 0.5-1.0 wt. % Si, about 0.6-1.2 wt. % Mg, about 0.05-0.2 wt. % Cr, about 0.05-0.25 wt. % Mn, about 0.1-0.3 wt. % Fe, up to about 0.15 wt. % Zr, up to about 0.15 wt. % Sc, up to about 0.15 wt. % Sn, up to about 0.4 wt. % Zn, up to about 0.15 wt. % Ti, less than 0.05 wt. % Ni, up to about 0.15 wt. % of impurities, and Al.

8. The rolled aluminum alloy product of claim 4, comprising about 0.6-1.7 wt. % Cu, about 0.5-0.9 wt. % Si, about 0.7-1.1 wt. % Mg, about 0.05-0.15 wt. % Cr, about 0.1-0.2 wt. % Mn, about 0.1-0.3 wt. % Fe, up to about 0.1 wt. % Zr, up to about 0.1 wt. % Sc, up to about 0.1 wt. % Sn, up to about 0.25 wt. % Zn, up to about 0.15 wt. % Ti, less than 0.05 wt. % Ni, up to about 0.15 wt. % of impurities, and Al.

9. The rolled aluminum alloy product of claim 4, wherein the rolled aluminum alloy product has a Si to Mg ratio of from about 0.55:1 to about 1.30:1 by weight.

10. The rolled aluminum alloy product of claim 4, wherein the rolled aluminum alloy product has an excess Si content of from −0.5 to 0.1.

11. A rolled aluminum alloy product comprising about 0.9-1.5 wt. % Cu, about 0.7-1.1 wt. % Si, about 0.7-1.2 wt. % Mg, about 0.06-0.15 wt. % Cr, about 0.05-0.3 wt. % Mn, about 0.1-0.3 wt. % Fe, up to about 0.2 wt. % Zr, up to about 0.2 wt. % Sc, up to about 0.25 wt. % Sn, up to about 0.2 wt. % Zn, up to about 0.15 wt. % Ti, up to about 0.07 wt. % Ni, and up to about 0.15 wt. % of impurities, with the remainder as Al.

* * * * *